US011812870B2

(12) United States Patent
Deevers et al.

(10) Patent No.: US 11,812,870 B2
(45) Date of Patent: Nov. 14, 2023

(54) BODY SUPPORT STRUCTURE

(71) Applicant: Steelcase Inc., Grand Rapids, MI (US)

(72) Inventors: Nickolaus William Charles Deevers, E Grand Rapids, MI (US); Kurt R. Heidmann, Grand Rapids, MI (US); Gary Karsten, Wyoming, MI (US); Mark Spoelhof, Grand Rapids, MI (US)

(73) Assignee: STEELCASE INC., Grand Rapids, MI (US)

( * ) Notice: Subject to any disclaimer, the term of this patent is extended or adjusted under 35 U.S.C. 154(b) by 0 days.

(21) Appl. No.: 17/667,792

(22) Filed: Feb. 9, 2022

(65) Prior Publication Data

US 2022/0248856 A1 Aug. 11, 2022

Related U.S. Application Data

(60) Provisional application No. 63/192,408, filed on May 24, 2021, provisional application No. 63/148,006, filed on Feb. 10, 2021.

(51) Int. Cl.
*A47C 7/44* (2006.01)
*A47C 7/00* (2006.01)

(52) U.S. Cl.
CPC ..... *A47C 7/441* (2013.01); *A47C 7/004* (2013.01); *A47C 7/443* (2013.01); *A47C 7/445* (2013.01)

(58) Field of Classification Search
CPC ..... A47C 7/44; A47C 7/441; A47C 7/443; A47C 7/445
See application file for complete search history.

(56) References Cited

U.S. PATENT DOCUMENTS

| | | | |
|---|---|---|---|
| 87,184 | A | 2/1869 | Mattson |
| 541,747 | A | 6/1895 | Hamilton |
| 546,174 | A | 9/1895 | Menzenhauer |
| 1,982,516 | A | 7/1933 | Holmsted |
| 2,102,196 | A | 12/1937 | Craske |
| 2,414,978 | A | 12/1942 | Richardson |
| 2,711,211 | A | 6/1955 | Tidcombe |
| 2,818,911 | A | 1/1958 | Syak |
| 2,992,605 | A | 7/1961 | Trotman et al. |

(Continued)

FOREIGN PATENT DOCUMENTS

| | | |
|---|---|---|
| CH | 243823 | 1/1947 |
| CN | 205513541 U | 8/2016 |

(Continued)

OTHER PUBLICATIONS

International Search Report and Written Opinion for International Application No. PCT/US22/15777 dated Jun. 21, 2022 (15 pages).

*Primary Examiner* — Rodney B White
(74) *Attorney, Agent, or Firm* — Crowell & Moring LLP

(57) ABSTRACT

A body support structure includes a base, a seat and a backrest, with the backrest connected to the base with a torsion leaf spring. The torsion leaf spring may be configured with a plurality of fingers, and/or one or more flex regions. One or more struts may be connected between the seat or backrest and the base. In another aspect, the seat and/or backrest may be supported with one or more links that provide a counter-intuitive motion. In another aspect, a link may be coupled to a support with a flexible blade.

24 Claims, 36 Drawing Sheets

(56) References Cited

U.S. PATENT DOCUMENTS 3,027,195 A 3/1962 Nelson et al.
3,120,407 A 2/1964 Propst
3,137,523 A 6/1964 Karner
3,162,487 A 12/1964 Trotman
3,514,156 A 4/1969 Fields
3,740,792 A 6/1973 Werner
4,143,916 A 3/1979 Trotman et al.
4,153,293 A 5/1979 Sheldon
4,337,931 A 7/1982 Mundell et al.
4,383,714 A * 5/1983 Ishida ..... A47C 3/03 297/261.3
4,399,574 A 8/1983 Shuman
4,451,085 A 5/1984 Franck et al.
4,567,615 A 2/1986 Fanti
4,585,272 A 4/1986 Ballarini
4,640,548 A 2/1987 Desanta
4,641,885 A 2/1987 Brauning
4,713,854 A 12/1987 Graebe
4,840,426 A 6/1989 Vogtherr et al.
4,856,846 A 8/1989 Lohmeyer
4,889,385 A 12/1989 Chadwick et al.
4,895,091 A 1/1990 Elmali et al.
4,911,501 A 3/1990 Decker
4,988,145 A 1/1991 Engel
5,022,709 A 6/1991 Marchino
5,026,117 A * 6/1991 Faiks ..... A47C 7/441 297/303.4
5,029,939 A 7/1991 Smith et al.
5,046,780 A 9/1991 Decker et al.
5,102,196 A 4/1992 Kaneda et al.
5,114,211 A 5/1992 Desanta
5,160,184 A * 11/1992 Faiks ..... A47C 3/026 297/303.4
5,195,801 A 3/1993 Franck et al.
5,224,758 A 7/1993 Takamatsu et al.
5,249,839 A 10/1993 Faiks et al.
5,267,777 A 12/1993 Valtri
5,282,285 A 2/1994 de Gelis et al.
5,356,199 A 10/1994 Elzenbeck et al.
5,403,067 A 4/1995 Rajaratnam
5,417,473 A 5/1995 Brauning
5,461,741 A 10/1995 Graebe
5,486,035 A 1/1996 Koepke et al.
5,517,877 A 5/1996 Hancock
5,518,294 A 5/1996 Ligon, Sr. et al.
5,577,802 A * 11/1996 Cowan ..... A47C 3/0257 297/303.2
5,774,911 A 7/1998 Stube et al.
5,775,774 A 7/1998 Okano
5,871,258 A 2/1999 Battey et al.
5,951,109 A 9/1999 Roslund, Jr. et al.
6,250,715 B1 6/2001 Caruso et al.
6,318,800 B1 11/2001 DeKraker
6,334,650 B1 1/2002 Chien-Chuan
6,367,876 B2 4/2002 Caruso et al.
6,412,869 B1 7/2002 Pearce
6,460,928 B2 10/2002 Knoblock et al.
6,598,251 B2 7/2003 Habboub et al.
6,616,228 B2 9/2003 Heidmann
6,701,550 B2 3/2004 Baeriswyl
6,726,285 B2 4/2004 Caruso et al.
6,729,688 B2 5/2004 Erne
6,755,467 B1 6/2004 Chu
6,793,289 B2 9/2004 Kuster et al.
6,811,218 B2 11/2004 Deimen et al.
6,820,933 B2 11/2004 Fereira Da Silva
6,848,744 B1 2/2005 Raftery et al.
6,869,142 B2 3/2005 Heidmann et al.
6,901,617 B2 6/2005 Sprouse, II et al.
6,957,863 B2 10/2005 Heidmann et al.
6,986,549 B2 1/2006 Kniese
6,991,291 B2 1/2006 Knoblock et al.
7,004,543 B2 2/2006 Caruso et al.
7,032,971 B2 4/2006 Williams
7,048,335 B2 5/2006 Norman et al.
7,131,700 B2 11/2006 Knoblock et al.
7,165,811 B2 1/2007 Bodnar et al.
7,237,841 B2 7/2007 Norman et al.
7,320,503 B2 1/2008 Eysing
7,422,287 B2 9/2008 Heidmann
7,441,758 B2 10/2008 Coffield et al.
7,441,829 B2 10/2008 Pennington et al.
7,455,365 B2 11/2008 Caruso et al.
7,461,892 B2 12/2008 Bajic et al.
7,472,962 B2 1/2009 Caruso et al.
7,497,515 B2 * 3/2009 Krehm ..... A47C 7/443 297/303.2
7,568,768 B1 8/2009 Tsai
7,604,298 B2 10/2009 Peterson et al.
7,622,579 B2 11/2009 Gaul et al.
7,625,045 B2 12/2009 Hatcher et al.
7,637,570 B2 12/2009 Becker et al.
7,648,201 B2 1/2010 Eysing
7,695,069 B2 4/2010 Prust
7,712,834 B2 5/2010 Knoblock et al.
7,740,321 B2 6/2010 Brill et al.
7,794,017 B2 9/2010 Kan et al.
7,794,022 B2 9/2010 Caruso et al.
7,798,573 B2 9/2010 Pennington et al.
7,806,478 B1 10/2010 Cvek
7,841,666 B2 11/2010 Schmitz et al.
7,857,388 B2 12/2010 Beford et al.
7,857,390 B2 12/2010 Schmitz et al.
7,874,619 B2 1/2011 Harley
7,909,402 B2 3/2011 Chu et al.
7,922,248 B2 4/2011 Aldrich et al.
7,926,879 B2 4/2011 Schmitz et al.
7,931,257 B2 4/2011 VanDeRiet et al.
8,029,060 B2 10/2011 Parker et al.
8,113,582 B2 2/2012 Liu
8,276,986 B2 10/2012 Kim
8,282,169 B2 10/2012 Schmitz et al.
8,419,133 B2 4/2013 Holt et al.
8,590,978 B2 11/2013 Jaranson et al.
8,745,783 B2 6/2014 Jansen
8,845,024 B2 9/2014 Beyer et al.
8,926,016 B2 1/2015 Behar et al.
8,939,507 B2 1/2015 Thomaschewski et al.
8,973,995 B2 3/2015 Donati
8,998,322 B2 4/2015 Horiki et al.
9,022,475 B2 5/2015 Brncick et al.
9,173,496 B2 11/2015 Coffield et al.
9,211,014 B2 12/2015 Schmitz et al.
9,215,933 B2 12/2015 Coffield et al.
9,282,822 B2 3/2016 Hogue
9,414,684 B2 8/2016 Park et al.
9,486,081 B2 11/2016 Sander et al.
9,498,066 B2 11/2016 Christianson et al.
9,504,325 B2 11/2016 Sander et al.
9,504,326 B1 11/2016 Cartis et al.
9,510,684 B2 12/2016 Schmitz et al.
9,538,849 B2 1/2017 Beyer et al.
9,622,579 B2 4/2017 Wilkinson et al.
9,668,580 B2 6/2017 Schmitz et al.
9,833,074 B2 12/2017 Bohmann et al.
9,861,201 B2 1/2018 Battey et al.
10,016,059 B2 7/2018 Leonard et al.
10,017,082 B2 7/2018 Zwaan
10,021,984 B2 7/2018 Ludwig et al.
10,028,586 B2 7/2018 Schneider
10,107,082 B2 7/2018 Zwaan
10,098,466 B2 10/2018 Donati
10,111,525 B2 10/2018 Sander et al.
10,194,750 B2 2/2019 Ludwig et al.
10,321,763 B2 6/2019 Bonneywell
10,357,955 B2 7/2019 Ziolek
10,575,648 B2 3/2020 Ludwig et al.
10,624,457 B2 4/2020 Schmitz et al.
10,765,218 B2 * 9/2020 Donati ..... A47C 7/40
10,820,703 B2 11/2020 Maier et al.
11,134,780 B2 10/2021 Maier et al.
11,178,972 B2 11/2021 Ballendat et al.
2001/0043003 A1 11/2001 Knoblock et al.
2002/0000745 A1 1/2002 Conte

(56) References Cited

U.S. PATENT DOCUMENTS

| | | | |
|---|---|---|---|
| 2002/0036420 | A1 | 3/2002 | Footitt |
| 2002/0109384 | A1 | 8/2002 | Hansen |
| 2003/0047982 | A1 | 3/2003 | Ball et al. |
| 2003/0052520 | A1 | 3/2003 | Erne |
| 2003/0178882 | A1 | 9/2003 | Schmitz et al. |
| 2004/0007910 | A1 | 1/2004 | Skelly |
| 2004/0051358 | A1 | 3/2004 | Bodnar et al. |
| 2005/0146185 | A1 | 7/2005 | Fookes et al. |
| 2005/0187080 | A1 | 8/2005 | Bowser |
| 2005/0264071 | A1 | 12/2005 | Costaglia |
| 2005/0275263 | A1 | 12/2005 | Norman et al. |
| 2006/0181126 | A1 | 8/2006 | Eysing |
| 2007/0102987 | A1 | 5/2007 | Chen |
| 2007/0108831 | A1 | 5/2007 | Ueda |
| 2007/0222268 | A1 | 9/2007 | Saez et al. |
| 2007/0273190 | A1 | 11/2007 | Gehner |
| 2008/0079298 | A1 | 4/2008 | Whelan et al. |
| 2008/0084100 | A1 | 4/2008 | Curiger |
| 2008/0290712 | A1 | 11/2008 | Parker et al. |
| 2009/0001793 | A1 | 1/2009 | Knoblock et al. |
| 2009/0102268 | A1 | 4/2009 | Schmitz et al. |
| 2009/0261637 | A1 | 10/2009 | Schmitz et al. |
| 2009/0261644 | A1 | 10/2009 | Piretti |
| 2010/0117433 | A1 | 5/2010 | Cassady |
| 2012/0025574 | A1 | 2/2012 | Wilkinson et al. |
| 2012/0061988 | A1 | 3/2012 | Jaranson et al. |
| 2012/0080920 | A1 | 4/2012 | Humer et al. |
| 2013/0169017 | A1 | 7/2013 | Masunaga et al. |
| 2014/0077542 | A1 | 3/2014 | Vander Veen et al. |
| 2014/0084652 | A1 | 3/2014 | Norman et al. |
| 2014/0110983 | A1 | 4/2014 | Sander et al. |
| 2014/0152064 | A1 | 4/2014 | Sander et al. |
| 2015/0102648 | A1 | 4/2015 | Park et al. |
| 2015/0245714 | A1 | 9/2015 | Schneider |
| 2016/0029801 | A1 | 2/2016 | Potrykus et al. |
| 2016/0296026 | A1 | 10/2016 | Ludwig et al. |
| 2016/0316916 | A1 | 11/2016 | Pectol |
| 2018/0125246 | A1 | 5/2018 | Ludwig et al. |
| 2018/0153306 | A1 | 6/2018 | Schmitz et al. |
| 2018/0295996 | A1 | 10/2018 | Ludwig et al. |
| 2018/0332967 | A1 | 11/2018 | Jin et al. |
| 2018/0352961 | A1 | 12/2018 | Deevers et al. |
| 2019/0029440 | A1 | 1/2019 | Schmitz et al. |
| 2019/0038033 | A1 | 2/2019 | Schmitz et al. |
| 2019/0045934 | A1 | 2/2019 | Deisig et al. |
| 2019/0133327 | A1 | 5/2019 | Ludwig et al. |
| 2019/0150621 | A1 | 5/2019 | Deevers et al. |
| 2019/0365108 | A1 | 12/2019 | Deevers et al. |
| 2020/0085194 | A1 | 3/2020 | Maier et al. |
| 2020/0138195 | A1 | 5/2020 | Schmitz et al. |
| 2020/0352335 | A1 | 11/2020 | Maier et al. |
| 2020/0367655 | A1 | 11/2020 | Ballendat et al. |
| 2021/0177144 | A1 | 6/2021 | Theesfeld et al. |
| 2021/0267375 | A1 | 9/2021 | Deevers et al. |

FOREIGN PATENT DOCUMENTS

| | | | |
|---|---|---|---|
| DE | 31 16 459 | A1 | 11/1982 |
| DE | 3834614 | A1 | 4/1990 |
| DE | 44 24 096 | A1 | 1/1996 |
| DE | 4424096 | A1 | 1/1996 |
| DE | 297 04 906 | U1 | 5/1997 |
| DE | 19611345 | A1 | 9/1997 |
| DE | 197 14 546 | A1 | 10/1998 |
| DE | 199 11 785 | A1 | 9/2000 |
| DE | 20 2006 005 645 | | 8/2007 |
| DE | 102007026327 | A1 | 12/2008 |
| DE | 20 2010 008 739 | | 11/2011 |
| EP | 0 250 199 | | 12/1987 |
| EP | 0 284 272 | | 9/1988 |
| EP | 0 888 739 | A2 | 1/1999 |
| EP | 1 579 787 | A1 | 9/2005 |
| EP | 2 070 446 | B1 | 6/2009 |
| EP | 2 100 539 | A1 | 9/2009 |
| EP | 2 520 199 | A1 | 11/2012 |
| EP | 3 409 144 | A1 | 12/2018 |
| EP | 3 622 860 | A1 | 3/2020 |
| JP | 2000-116458 | | 4/2000 |
| JP | 3075832 | U | 3/2001 |
| JP | 2009-268780 | A | 11/2009 |
| JP | 2013-132403 | A | 7/2013 |
| JP | 5242088 | B2 | 7/2013 |
| KR | 2013-0000274 | U | 1/2013 |
| WO | WO 2007/067997 | A1 | 6/2007 |
| WO | WO 2007/095960 | A1 | 8/2007 |
| WO | WO 2008/000295 | A1 | 1/2008 |
| WO | WO 2009/033535 | A1 | 3/2009 |
| WO | WO 2009/134451 | A1 | 11/2009 |
| WO | WO 2013/083562 | A1 | 6/2013 |
| WO | WO 2016/124317 | A1 | 8/2016 |
| WO | WO 2016/124328 | A1 | 8/2016 |
| WO | WO 2017/135831 | A1 | 8/2017 |
| WO | WO 2019/064321 | A1 | 4/2019 |
| WO | WO 2020/007410 | A1 | 1/2020 |
| WO | WO 2020/007411 | A1 | 1/2020 |
| WO | WO2020/104376 | A1 | 5/2020 |
| WO | WO 2022/091214 | A1 | 5/2022 |

* cited by examiner

BODY SUPPORT STRUCTURE

This application claims the benefit of U.S. Provisional Application No. 63/148,006, filed Feb. 10, 2021 and U.S. Provisional Application No. 63/192,408, filed May 24, 2021, both entitle "Body Support Structure," the entire disclosures of which are hereby incorporated herein by reference.

FIELD OF THE INVENTION

The present application relates generally to a body support structure such as a chair, and more specifically to a body support structure having a link connecting various components.

BACKGROUND

Body supporting structures, including for example, office chairs, vehicular and aircraft seating, sofas, beds and other pieces of furniture, that provide for kinematic movement are often made with multiple assemblies and parts, including various linkages and springs that must be mechanically coupled. For example, a conventional tilt control may include dozens of parts, including various metal parts that must be machined, stamped or cast, which are then assembled using various mechanical fasteners, such as pivot pins. The manufacturing and assembly process may involve complex and expensive tooling, which is difficult to modify and adapt to other assemblies.

In addition, due to the rigid construction of the various components such as links, the control mechanism typically requires a supplemental biasing member, such as a spring, to resist the recline load. Moreover, the links typically extend between hard pivot points, thereby dictating the aesthetic appearance of the control mechanism.

SUMMARY

The present invention is defined by the following claims, and nothing in this section should be considered to be a limitation on those claims.

In one aspect, one embodiment of a body support structure includes a base, a body support component and a link having a centerline. The link extends between and movably supports the body support component on the base. The link is pivotally connected to the base at a first pivot positioned on a first side of the centerline, and is pivotally connected to the body support component at a second pivot on a second side of the centerline opposite the first side. A virtual link is defined between the first and second pivots, wherein the virtual link crosses or intersects the centerline. The centerline and virtual link may have different slopes (e.g., negative or positive) respectively.

In another aspect, one embodiment of a body support structure includes a support, a link overlying a portion of the support and a flexible blade. The flexible blade has a first surface abutting and connected to the support at a first location and a second surface opposite the first surface abutting and connected to the link at a second location. The first and second locations are longitudinally spaced apart along the blade. The flexible blade is bendable, or elastically deformable, between at least an at-rest configuration and a biased configuration. The link is pivoted relative to the support from a first position to a second position as the blade is bent between the at-rest configuration and the biased configuration. The blade biases the link toward the first position from the second position. In one embodiment, a stop is engageable with the link to limit pivoting of the link at the second position.

In another aspect, one embodiment of a body support structure includes a base, a seat pivotally connected to the base at a first pivot joint, a backrest pivotally connected to the seat at a second pivot joint, and a laterally extending torsion leaf spring. The leaf spring has a first portion connected to the base and a laterally spaced opposite end portion connected to the backrest. The torsion leaf spring is bendable and twistable between an at-rest configuration and a biased configuration. The backrest is pivotable and translatable relative to the base from an upright position to a reclined position as the torsion leaf spring is bent and twisted between the at-rest configuration and the biased configuration. The torsion leaf spring biases the backrest toward the upright position from the reclined position. In one embodiment, the leaf spring may be connected to the base at an intermediate portion with a pair of opposite, laterally spaced, end portions connected to the backrest, for example the uprights.

In another aspect, a body support structure, for example a chair, includes a base, a body support component and a leaf spring. The leaf spring has a first portion connected to one of the base and the body support component and a laterally spaced opposite end portion connected to the other of the base and body support component. The end portion includes a plurality of fingers, or bands, connected to the body support component, for example a backrest. The leaf spring is deformable between an at-rest configuration and a biased configuration. The body support component is movable relative to the base from an upright position to a reclined position as the leaf spring is deformed. The leaf spring biases the body support component toward the upright position from the reclined position. In one embodiment, the leaf spring may be connected to the base at an intermediate portion with a pair of opposite ends portions connected to the backrest, for example the uprights, with each end portion having a plurality of fingers.

In another aspect, one embodiment of a body support structure includes a base, a seat pivotally connected to the base at a first location and a backrest pivotally connected to the seat at a second location and fixedly connected to the base at a third location. The backrest includes a flexible portion disposed between the second and third locations. The backrest is pivotable and translatable relative to the base from an upright position to a reclined position as the flexible portion is bent and twisted between an at-rest configuration and a biased configuration.

In another aspect, one embodiment of a biasing component includes a plurality of spaced apart fingers, otherwise referred to as bands. At least some of the fingers have a first portion extending in a first direction and a second portion extending in a second direction, wherein the first and second directions are non-planar. In one embodiment, the fingers extend from a base portion, which may be solid, or have a solid cross-section, in one embodiment.

In another aspect, a deformable link is connected between first and second components that are moveable relative to each other along a path. The deformable link is configured with the plurality of spaced apart elongated slits. The deformable link may include an elbow portion with the slits extending along the elbow portion.

In another aspect, one embodiment of a body support member includes a seat carrier and a seat support having a rear portion and a front portion. The rear portion is slideably coupled to the seat carrier. The seat support is slideable fore and aft along a longitudinal direction relative to the seat carrier such that a depth of the seat support may be adjusted. The front portion is cantilevered forwardly from the rear portion in an unsupported and vertically spaced apart relationship relative to the seat carrier. A body support member may be coupled to the seat support.

In another aspect, one embodiment of a body support structure includes a base and a body support component movably mounted on the base. The body support component is moveable relative to the base between an upright position to a reclined position. At least one strut has a first end coupled to one of the base and the body support component, and a second end moveably coupled to the other of the base and the body support component. The second end is moveable (for example and without limitation translatable) relative to the other of the base and the body support component between an at-rest position and a stop position. The at least one strut limits the movement of the body support component relative to the base when the strut is in the stop position. In one embodiment, a biasing member may bias the strut toward the at-rest position.

In another aspect, one embodiment of a backrest includes a frame having a pair of uprights. A lateral support extends between and is fixedly coupled to the pair of uprights. The lateral support is twistable between at least first and second configurations. A lumbar support is vertically spaced from the lateral support. The lumbar support is deformable between at least first and second configurations. A strut extends between the lateral support and the lumbar support. The strut twists the lateral support between the first and second configurations as the lumbar support is deformed between the first and second configurations.

In another aspect, one embodiment of a body support structure includes a base, a body support component and at least one strut. The body support component is movably mounted on the base, wherein the body support component is moveable relative to the base between an upright position to a reclined position. The at least one strut has a first end coupled to one of the base and the body support component, and a second end moveably coupled to the other of the base and the body support component, wherein the second end is translatable relative to the other of the base and the body support component between an at-rest position and a reclined position. A biasing component biases the second end toward the at-rest position.

The various embodiments of body support structures and methods provide significant advantages over other body support structures, and methods for the manufacture and assembly thereof. The body support structures provide a simple structure for supporting the body of a user, without the need for complex linkages and biasing structures. For example, and without limitation, the biasing structure may be integrated into one or more of the links. In addition, the pivot connections in some embodiments are configured without hard pivot pins, which simplifies the overall mechanism, allows for the integration of various stops or limits, provides an integrated, low-profile appearance. In one embodiment, the configuration of the link and connections may allow for counterintuitive recline motion of the body support structure.

The foregoing paragraphs have been provided by way of general introduction, and are not intended to limit the scope of the following claims. The various preferred embodiments, together with further advantages, will be best understood by reference to the following detailed description taken in conjunction with the accompanying drawings.

DETAILED DESCRIPTION OF THE PRESENTLY PREFERRED EMBODIMENTS

Figure 1:
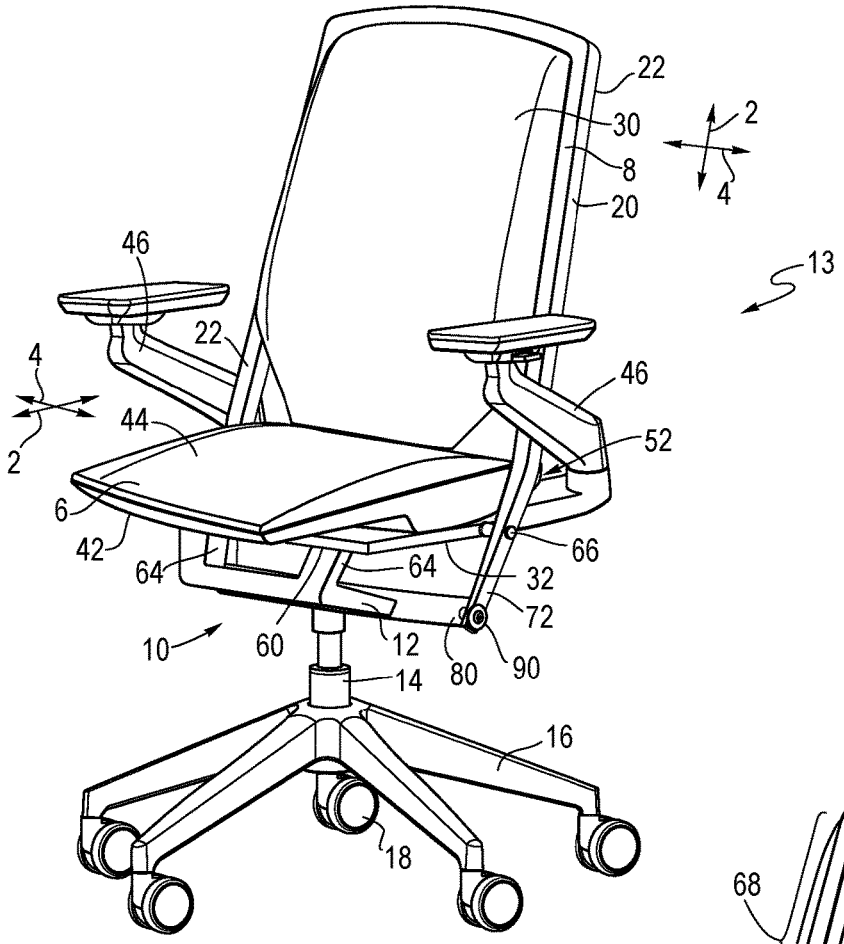
FIG. 1 is a front perspective view of one embodiment of a body support structure.
Figure 2:
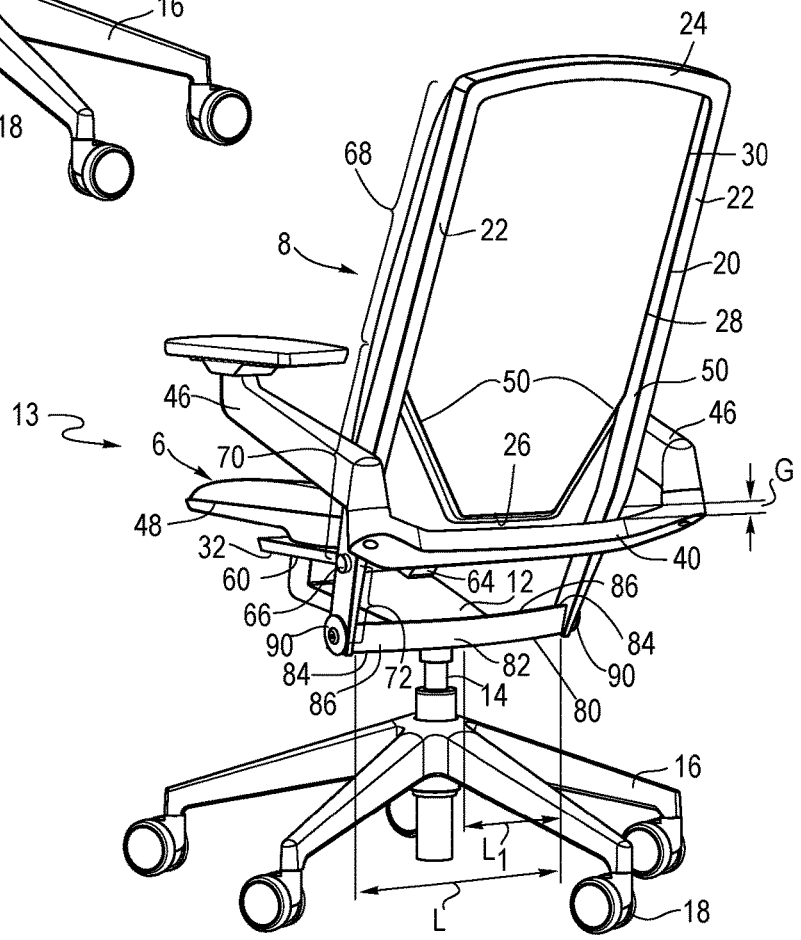
FIG. 2 is a rear perspective view of the body support structure shown in FIG. 1.
Figure 3:
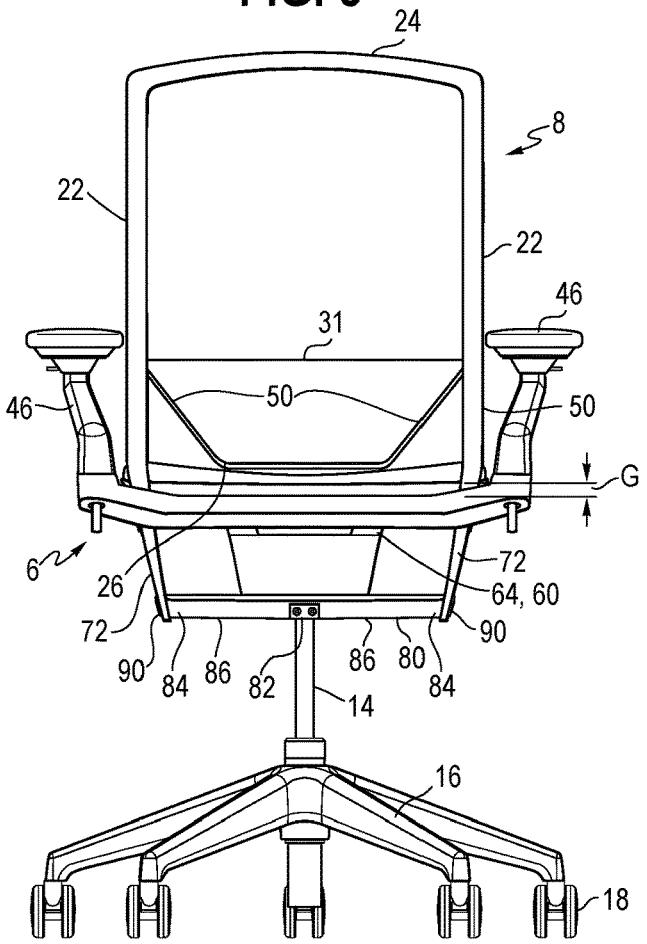
FIG. 3 is a front view of the body support structure shown in FIG. 1.
Figure 4:
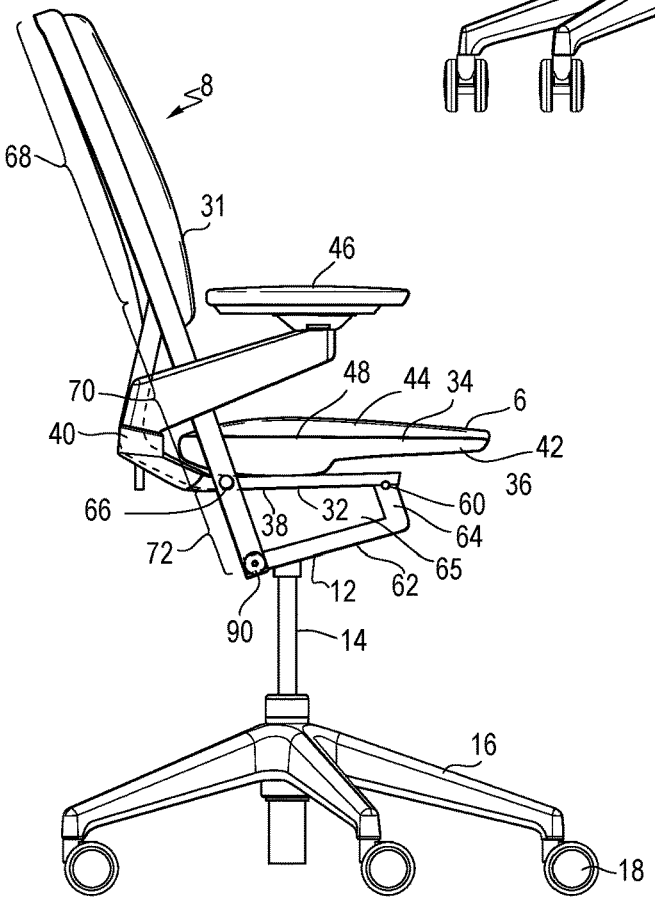
FIG. 4 is a right side view of the body support structure shown in FIG. 1, with a left side view being substantially a mirror image thereof.
Figure 14:
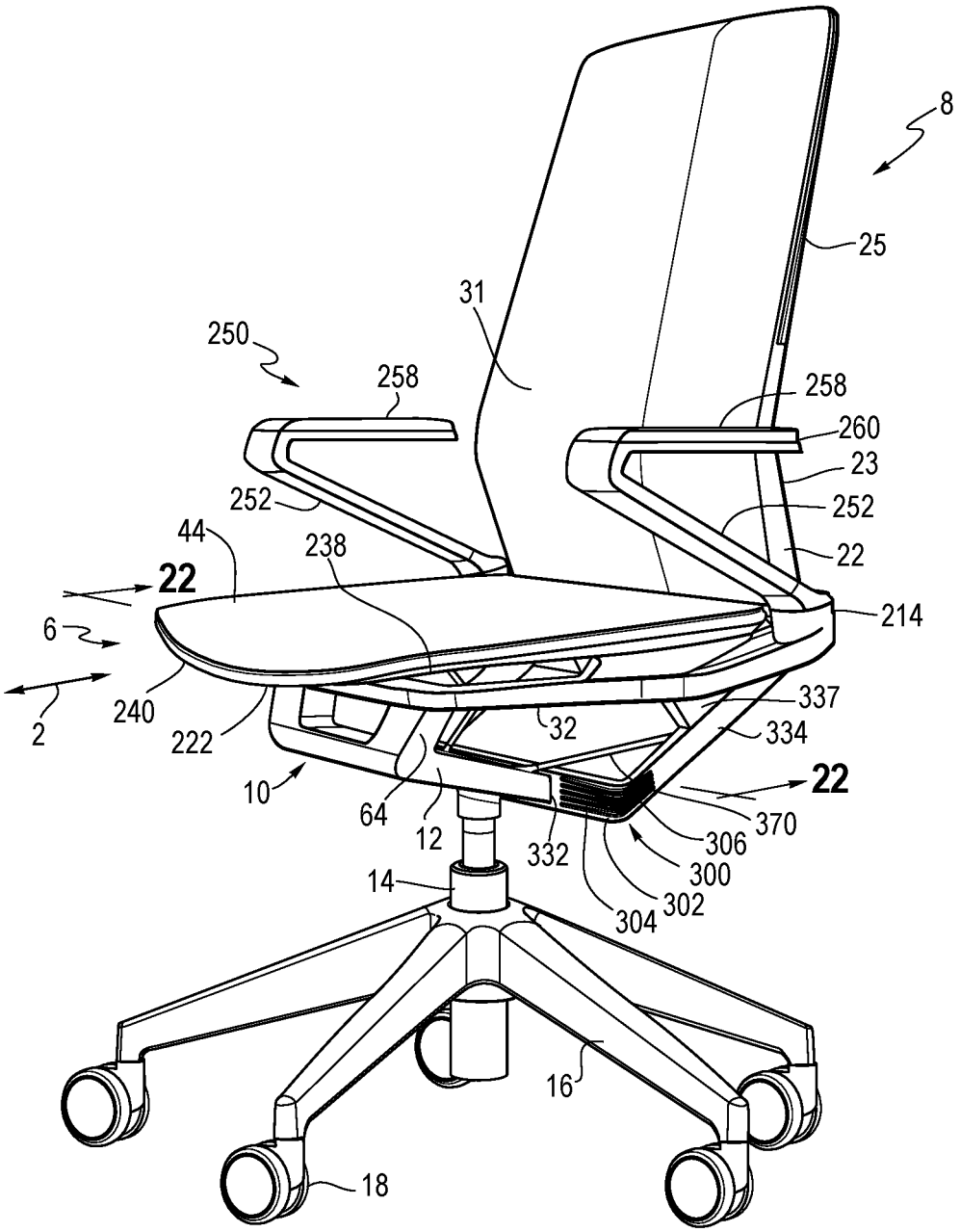
FIG. 14 is a perspective view of another embodiment of a body support structure.

It should be understood that the term "plurality," as used herein, means two or more. As shown in FIGS. 1 and 14, the term "longitudinal," as used herein, means of or relating to a length or lengthwise direction 2, for example a direction running from a top to bottom of a backrest 8, or a front to back of a seat 6, and vice versa (bottom to top and back to front), or along the length of a component, for example a leaf spring 80. The term "lateral," as used herein, means situated on, directed toward or running in a side-to-side direction 4 of the backrest or seat, for example between a pair of uprights 22. The term "coupled" means connected to or engaged with whether directly or indirectly, for example with an intervening member, and does not require the engagement to be fixed or permanent, although it may be fixed or permanent. The term "fixed" means not moveable. The terms "first," "second," and so on, as used herein, are not meant to be assigned to a particular component or feature so designated, but rather are simply referring to such components and features in the numerical order as addressed, meaning that a component or feature designated as "first" may later be a "second" such component or feature, depending on the order in which it is referred. It should also be understood that designation of "first" and "second" does not necessarily mean that the two components, features or values so designated are different, meaning for example a first direction may be the same as a second direction, with each simply being applicable to different components or features. The terms "upper," "lower," "rear," "front," "fore," "aft," "vertical," "horizontal," and variations or derivatives thereof, refer to the orientations of the exemplary body support structure 13 as shown in FIGS. 1 and 2 from the perspective of a such sitting thereon. The phrase "body support structure" refers to a structure that supports a body, including without limitation office furniture, home furniture, outdoor furniture and vehicular seating, including automotive, airline, marine and passenger train seating, and may include without limitation beds, chairs, sofas, stools, and other pieces of furniture or types of seating structures.

Referring to FIGS. 1-5, 14-21, 45-53 and 60-63, the seat 6 and backrest 8 are supported by a control mechanism 10 (kinematic control system), which includes a base or support 12, which may be configured as a tilt control housing. The base or support 12 is coupled to and supported by a support column 14, which is supported in turn by a bottom base 16 configured with one or more floor engaging components 18, such as glides, casters or other types of feet. The bottom base may be configured with multiple legs. Alternatively, the base support may be supported by other types of support platforms and legs, including a sled base, fixed legs (e.g., 2 or more), a pedestal support, rocker support or other suitable support platforms.

The backrest 8 includes a frame 20 configured with a pair of laterally spaced apart uprights 22. In one embodiment, the frame 20 has a top cross member 24 extending laterally between and connected to the uprights 22, and a bottom cross member 26 extending laterally between and connected to the uprights 22, with the top and bottom cross members 24, 26 being longitudinally spaced. In the embodiment shown in FIGS. 1-5, a pair of struts 50 extend downwardly, inwardly and rearwardly from an intermediate position on the uprights 22 to the bottom cross member 26, such that the struts 50 and upper portions 68 of the uprights 22 define a bow shape, which has a forwardly facing convex curvature. In the embodiments shown in FIGS. 14-27, a bottom portion 23 of the uprights 22 may extend downwardly and rearwardly from an upper or intermediate portion 25 of the uprights 22.

Figure 29:
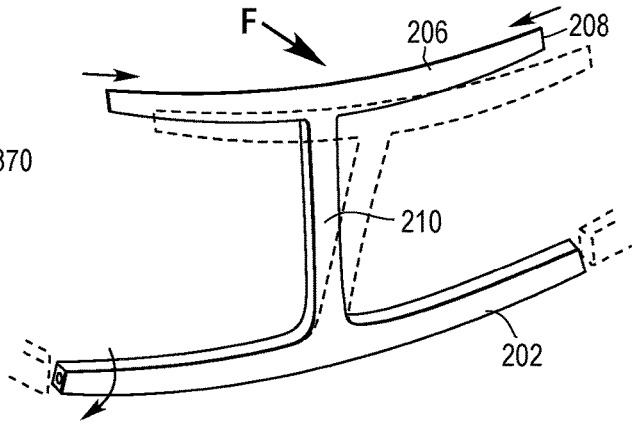
FIG. 29 is a schematic of a lumbar support device.
Figure 30:
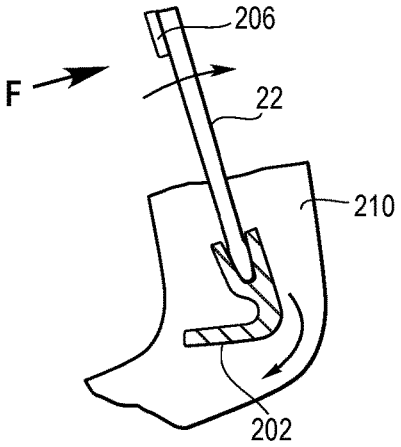
FIG. 30 is a partial side cross-sectional view of the lumbar support device shown in FIG. 29.
Figure 41:
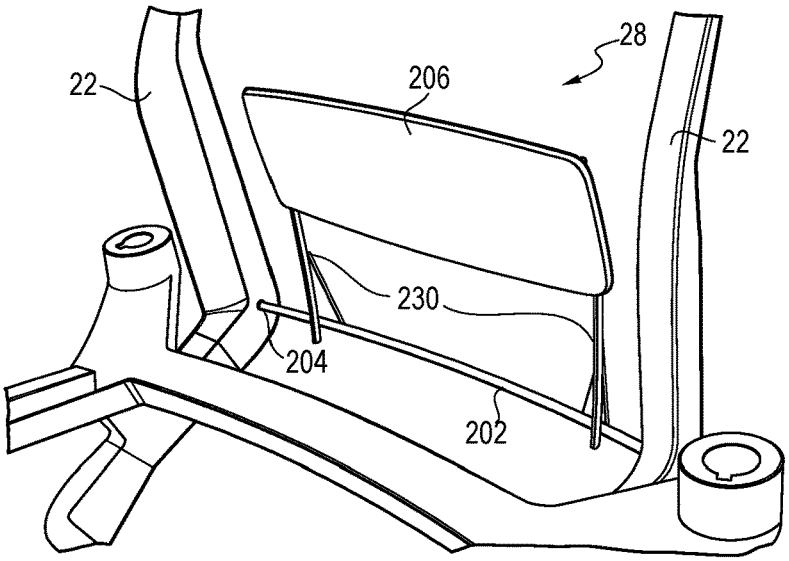
FIG. 41 is a partial, front perspective view of a lumbar support device.

In the embodiment of FIGS. 18-21, 29, 30, 41 and 45-52, the frame 20 includes a lateral support 202, or cross member, that extends laterally between the uprights 22, and has opposite ends 204 coupled to bottom portions 23 of the uprights 22. In one embodiment, the ends are fixedly coupled to the uprights. A lumbar support 206 also extends laterally between the uprights 22 and has opposite ends 208 coupled to the uprights 22. Alternatively, the lumbar support 206 has laterally spaced ends or free edges that are not connected to the uprights, as shown in FIG. 41. The lumbar support 206 is spaced from the lateral support 202, for example vertically spaced above the lateral support 202, which defines a lower support 203. In one embodiment, the opposite ends 208 of the lumbar support 206 are moveable relative to the uprights 22, for example laterally translatable or slideable relative to the uprights 22 such that the lumbar support 206 may deform or bend in response to a load applied by a user's specific lumbar region. For example, the lumbar support 206 may bend or deform, or is deformable and bendable, between at least a first and second configuration in response to the load (F) applied by the user as shown in FIGS. 29 and 30. In the embodiment of FIG. 41, the entire lumbar support may deflect rearwardly, as well as bend and deform.

Figure 42:
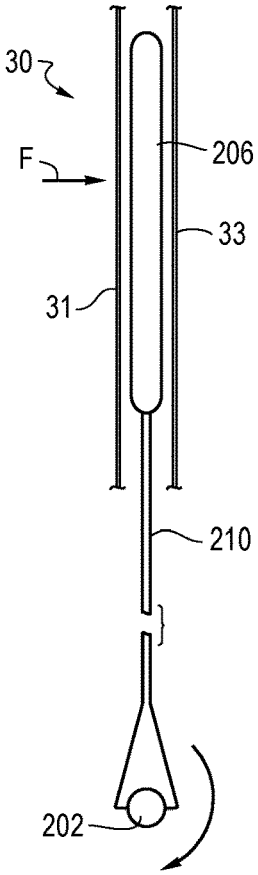
FIG. 42 is a cross-sectional view of the lumbar support device disposed in a body support member.

In one embodiment, shown in FIGS. 29 and 30, a strut 210, or column/beam, may extend between the lumbar support 206 and lateral support 202. In one embodiment, the strut 210 has a vertical orientation. As shown in FIG. 41, a pair of laterally spaced struts 210 extend between the lateral support 202 and lumbar support 206. As the lumbar support 206 bends or deforms, the strut(s) 210 or beam applies a compressive force (F) to the lumbar support 206, which applies a twisting load or torque T, as well as a bending load, to the lateral support 202. Because the lateral support 202 is fixedly connected to the uprights 22 at the ends 69 thereof, the lateral support 202 is torqued, or is twistable between at least first and second configurations as the lumbar support 206 is deformed between the first and second configurations and provide a restorative force to the lumbar support 206 through the strut 210. In this way, the lateral support 202 acts as a torsion spring acting on the strut(s) 210 and lumbar support 206, with a middle portion of the lateral support 202 being rotatably displaced from the compressive force and/or twisting from the strut 210 while the ends of the lateral support 202 are rotationally fixed. The lateral support 202, and/or the strut(s) 210, may also experience bending if the load (F) has a vertical vector component. In one embodiment, the strut 210 may be disposed between the pair of uprights 22, and may be centrally located between the pair of uprights 22 along a centerline of the backrest. In other embodiments, as shown in FIG. 41, a plurality of struts may be disposed between the lumbar support 206 and lateral support 202. As shown in FIG. 42, the lumbar support 206 and/or struts may be disposed between one or more layers or substrates defining a body support member 30. For example, the body support member 30 may be configured with a pair of fabric or textile front and rear layers 131, 33 defining a pocket in which the lumbar support 206 is disposed. Alternatively, in one embodiment, one of the front and rear layers 131, 33 may be omitted.

The portions 68, 25 of the uprights 22, struts 50 and cross members 24, 26 define a central opening 28 in the embodiment of FIGS. 1-5, while the uprights 22, lower support 202 and cross member 24 define a central opening in the embodiment of FIGS. 14-27 and 45-52. The body support member 30, such as a shell (e.g., plastic) or suspension material (e.g., woven or knit textile material), may be disposed across the central opening 28 and may be secured to the frame 20, for example to the uprights 22 (e.g. upper portions 68), struts 50, lower support 202 and/or cross members 24, 26. The body support member 30 has a bow shape, with a forwardly protruding lumbar section 31 defined at the junction between the upper portions 68 of the uprights and struts 50 or bottom portion 23 of the uprights 22. In the embodiment of FIGS. 18-27, the lumbar support 206 is disposed immediately below the junction, although it may be disposed at or above the junction. Lower side edges of the body support member 30 may be free of attachment to, and spaced from, the lower portions of the uprights 22 below the lumbar support 206. A cushion or other user interface may be secured across the front of the body support member 30.

Referring to FIGS. 60-63, the body support member, configured for example as a cover, which may be a suspension material, and includes a rear portion 800, or cape, that extends from a front portion 804 and wraps around the backrest and over the cross member 24, thereby covering the top and a portion of the rear of the backrest. The rear portion may be connected to the rear surface of the uprights 22. The rear portion may include a laterally extending stiffener 802 located along an edge thereof.

Referring to FIGS. 1-4, 14-20, 45-53 and 60-63, the seat 6 includes a longitudinally extending platform, otherwise referred to as a seat carrier 32 or frame, having a front edge 36, side supports 38 and one or more rear support platforms 40, 214. The seat carrier 32 is spaced above the base and creates an open space therebetween that extends from one side of the body support assembly to the other. In one embodiment, the opening 65 may have a polygonal shape, and may be a quadrilateral or pentagonal shape. It should be understood that the overall appearance of the seat, base and backrest, individually and collectively, including for example the size, shape and orientation of the opening, seat, backrest, frame members, and base, and various links or components interconnected therewith, may be varied, or configured in a manner that presents a different appearance without impairing the operation and function of the elements shown, for example without affecting the relative motion, interface and interaction of those components, including the relative movement therebetween. Those of skill in the art will appreciate that the present configuration shown in those drawing figures, as well as other potential embodiments, are chosen based upon a selected aesthetic for presenting a desired ornamental design appearance that is operational but is not dictated by the functionality of the components and embodiments shown.

A cross member 215 extends between and connects the platforms 214. A body support assembly 34 may be supported on the platform, or seat carrier 32. The body support assembly 34 may include a secondary frame, otherwise referred to as a seat support 42, defining a central opening 236. A body support member 44, such as a shell or suspension material, is disposed across the central opening 236 and may be secured to the secondary frame/seat support 42. In other embodiments, the platform, or seat carrier 32, may define a central opening supporting the body support assembly 34, or the body support assembly 34 may include an upholstered foam cushion.

In one embodiment, shown in FIGS. 18-20, and 22, the seat support 42 includes a rear portion 220 and a front portion 222. The rear and front portions form an upper platform 238 defining the central opening 236. The rear portion 220 may be slideably coupled to the seat carrier 32. For example, the seat carrier may define a pair of laterally spaced tracks or rails 224, having an upper flange 226 defining a channel 228 that opens laterally outwardly. The seat support 42 has a pair of laterally spaced rails or guides, defined by an edge portion 230 of side webs 234 on the rear portion 220 that extend downwardly and inwardly from the platform 238, with the edge portions 230 extending horizontally and laterally inwardly where they may be received in the channels 228. A cross member 229 extends rearwardly along the rear portion 220. The seat support 42 may slide fore and aft in a longitudinal direction 2 relative to the seat carrier 32 to a desired seat depth position. A detent or lock may interface between the seat support and carrier to secure the seat in the desired seat depth position.

Figure 15:
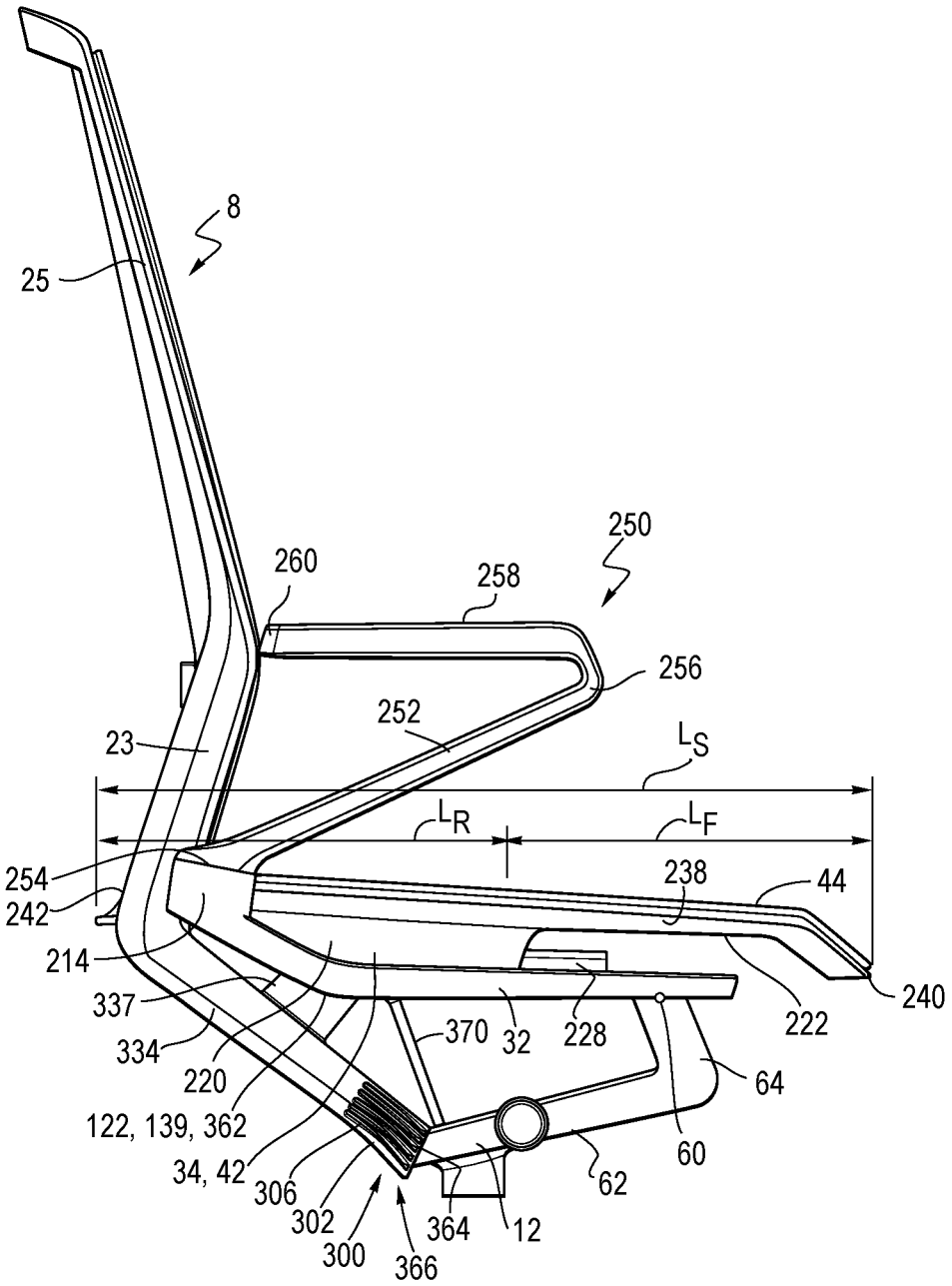
FIG. 15 is a partial right side view of the body support structure shown in FIG. 14 without a support column extending there below.
Figure 16:
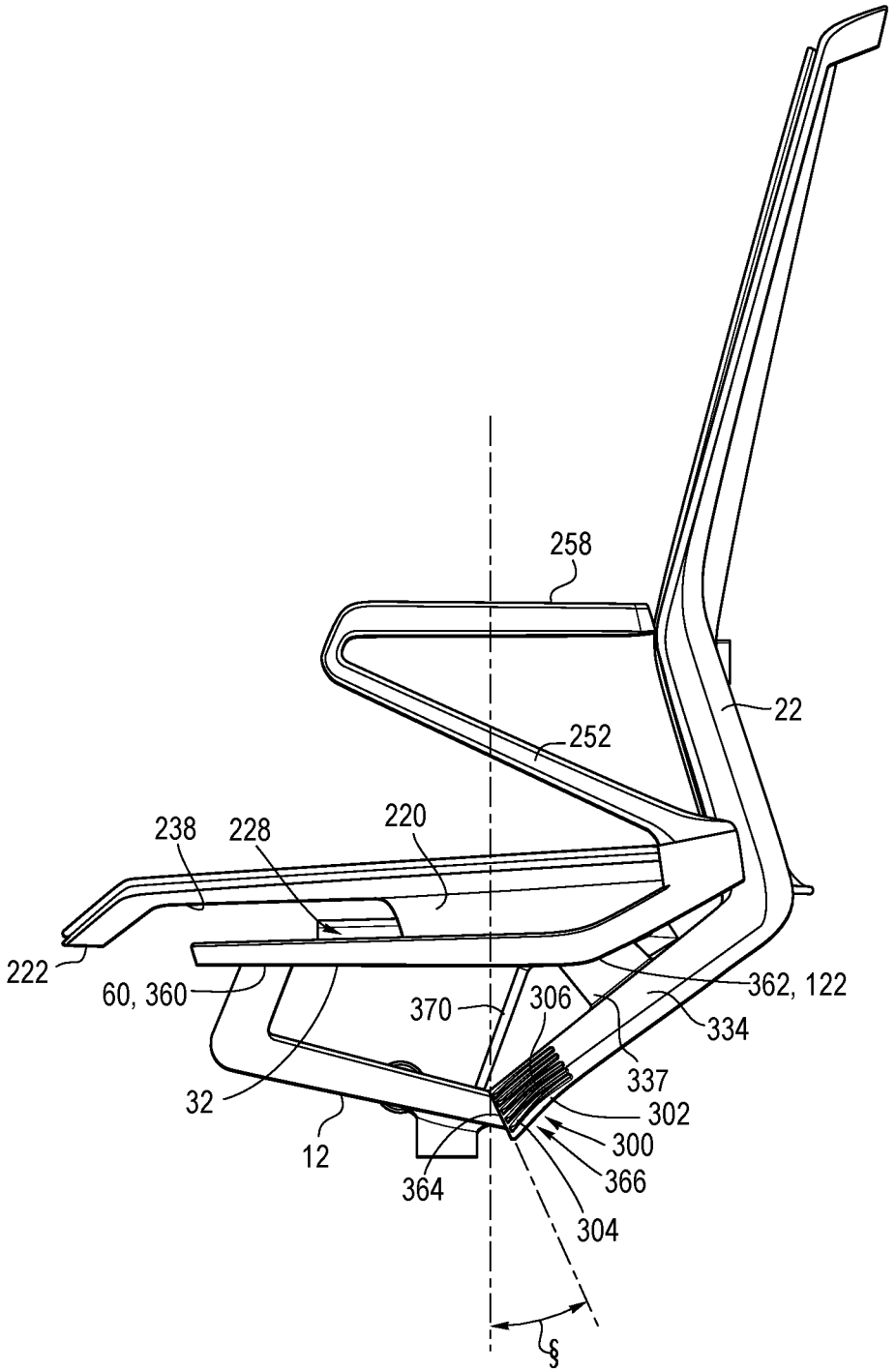
FIG. 16 is a partial left side view of the body support structure shown in FIG. 14.
Figure 17:
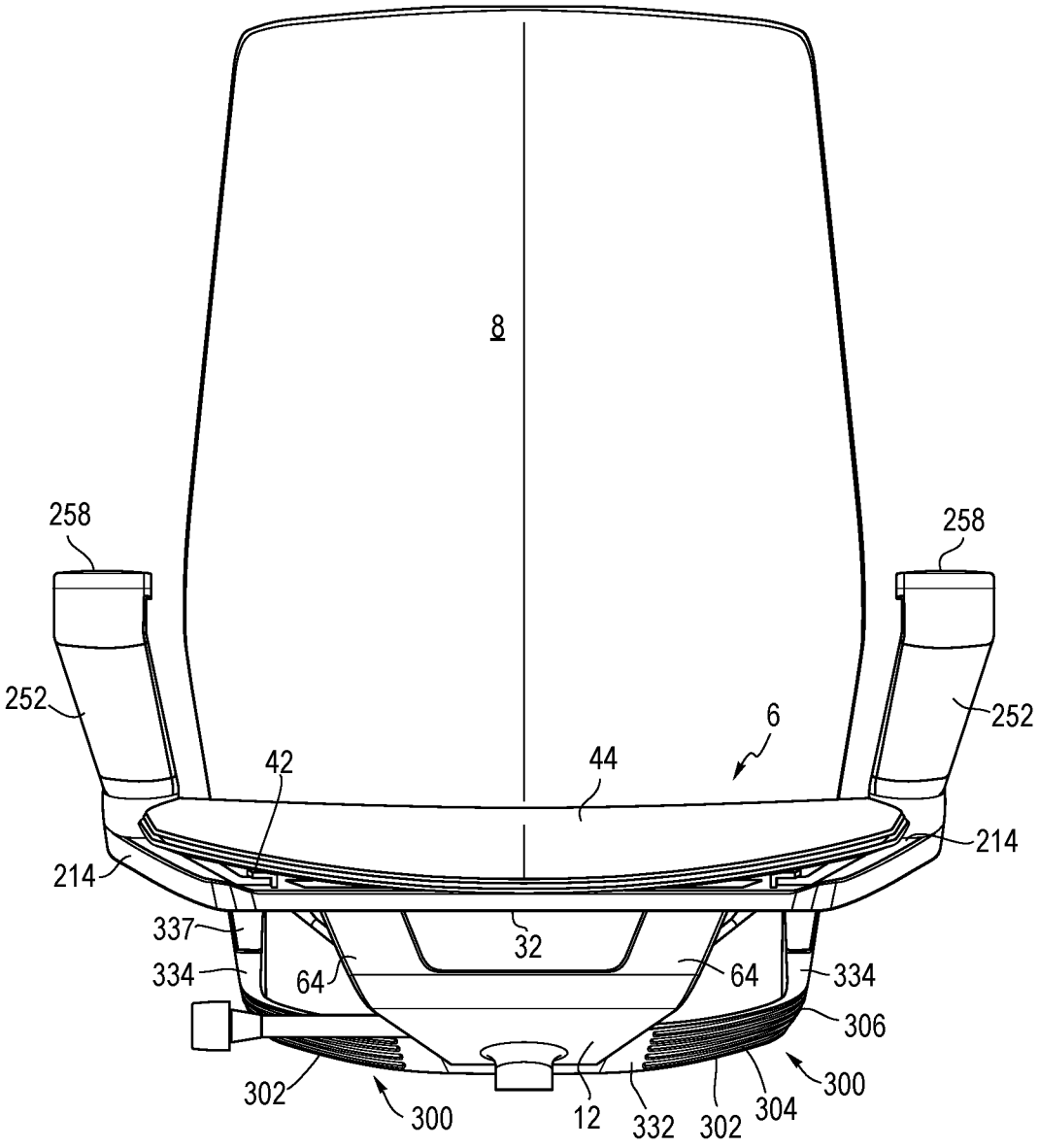
FIG. 17 is a front view of the body support structure shown in FIG. 14.
Figure 18:
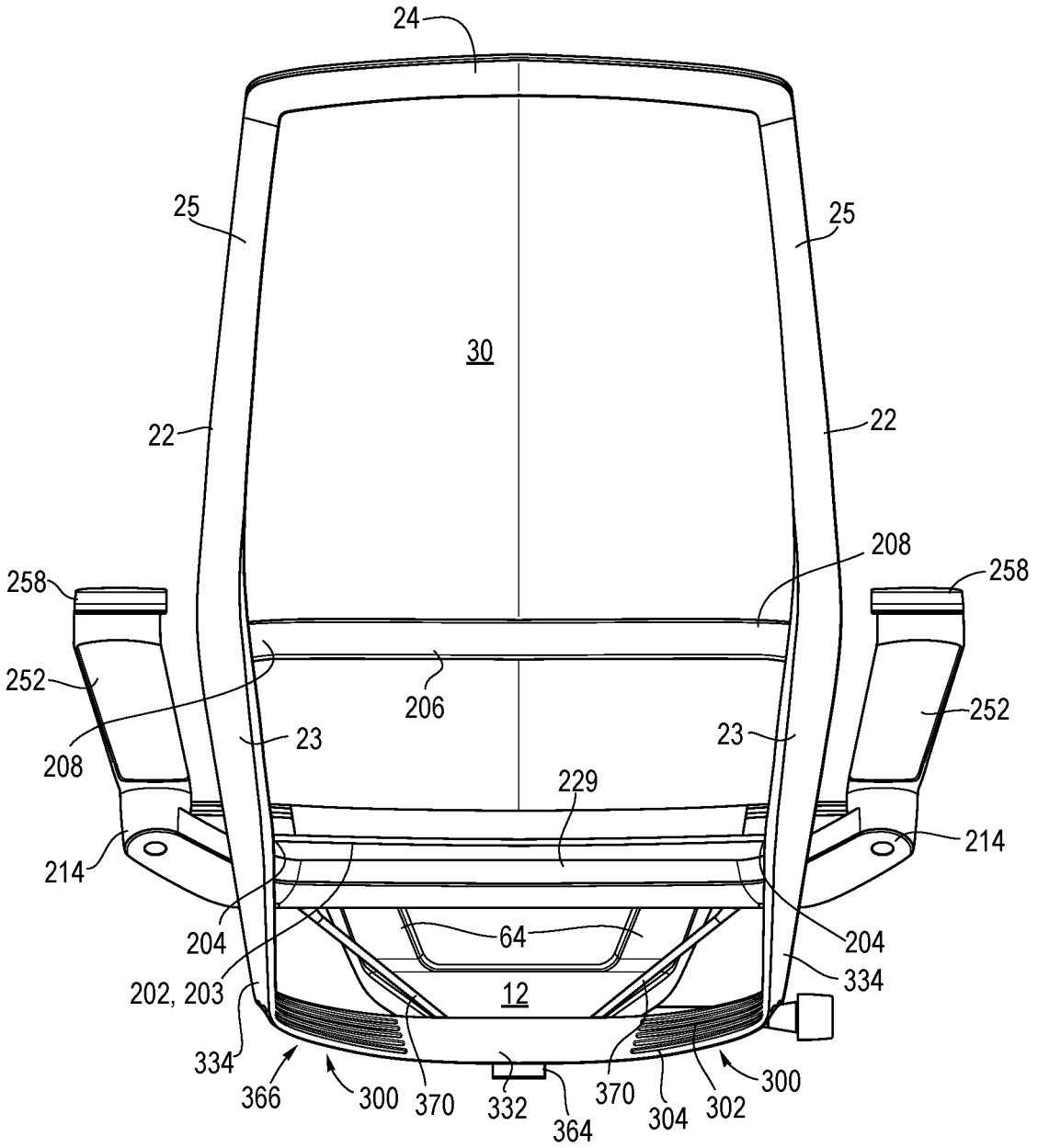
FIG. 18 is a rear view of the body support structure shown in FIG. 14.
Figure 19:
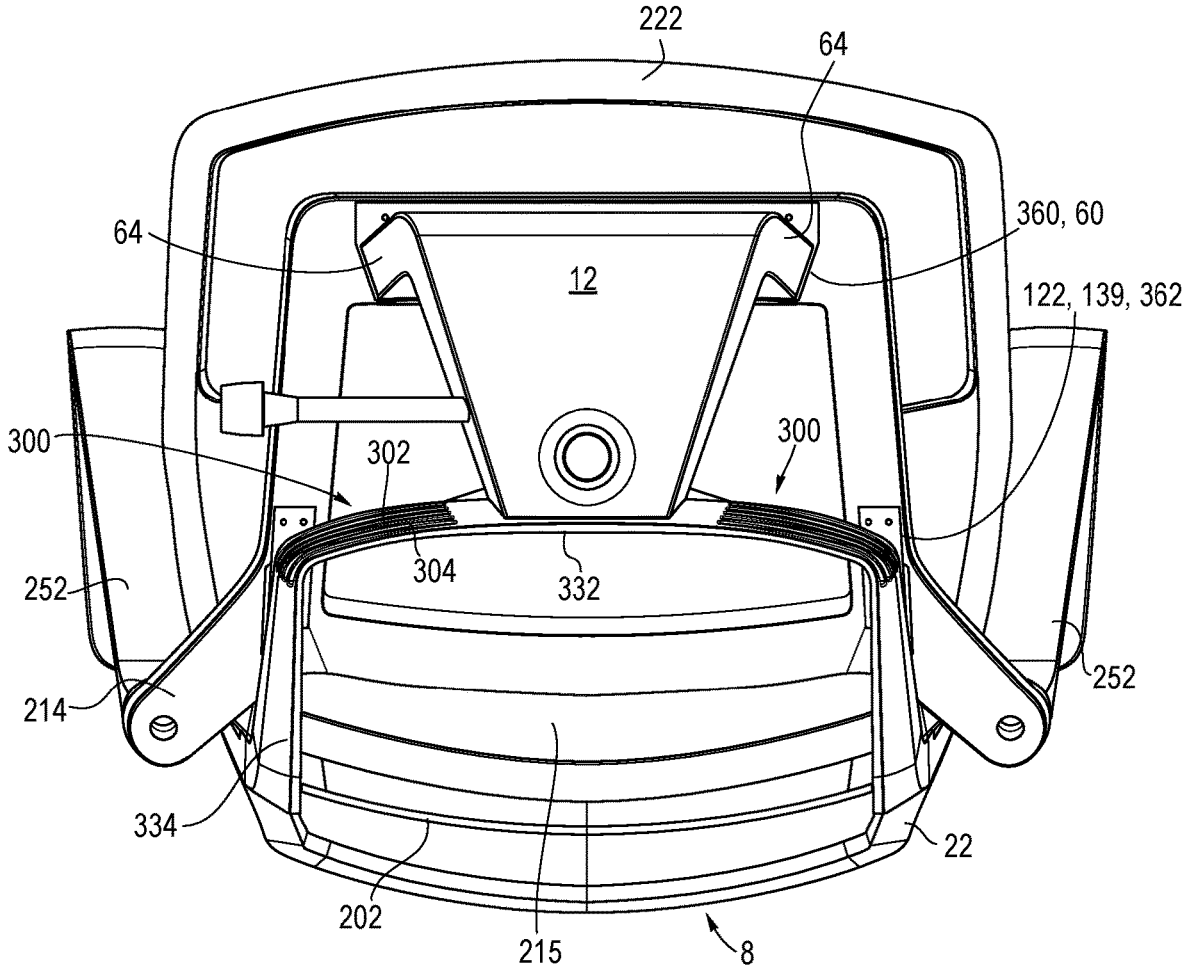
FIG. 19 is a bottom view of the body support structure shown in FIG. 14.
Figure 20:
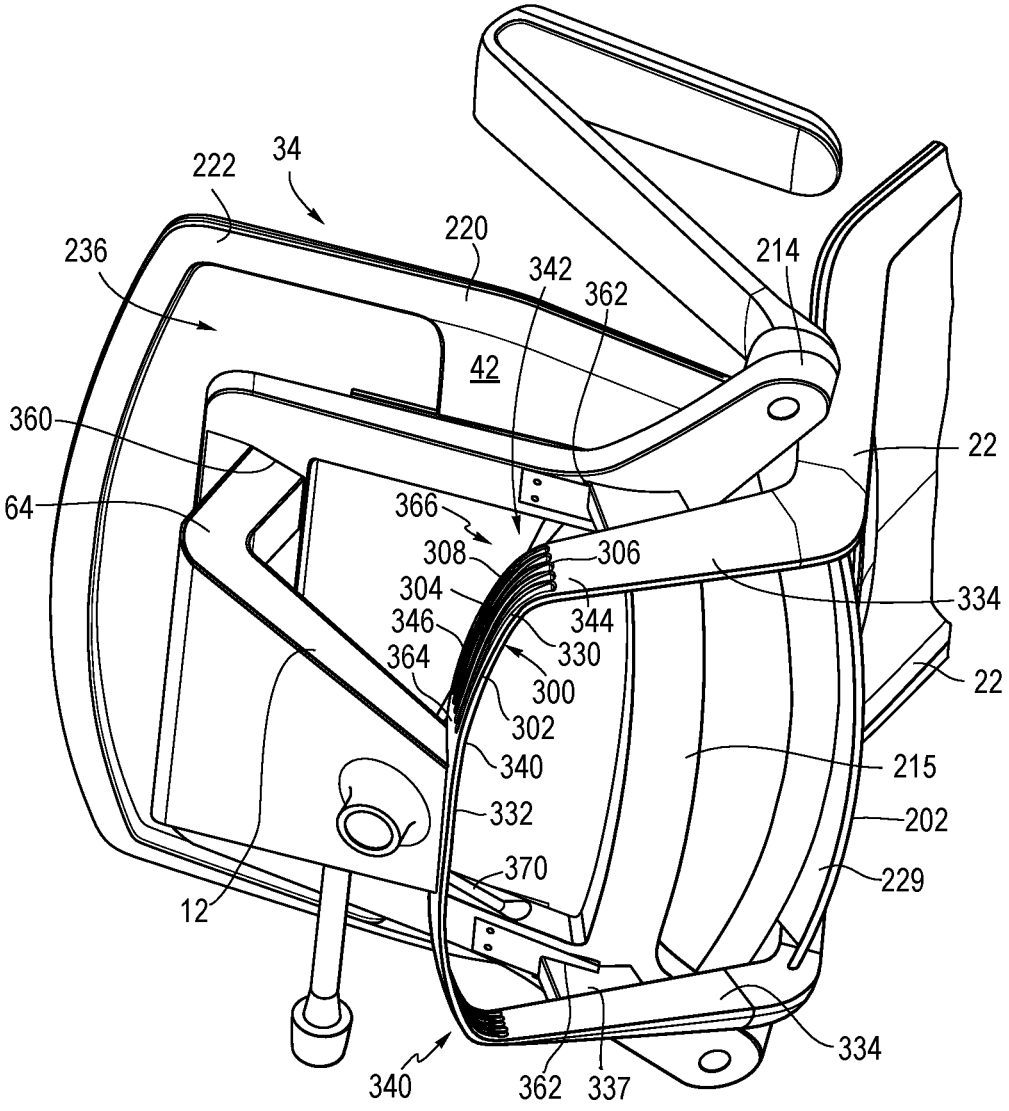
FIG. 20 is a partial, bottom perspective view of the body support structure shown in FIG. 14.
Figure 21:
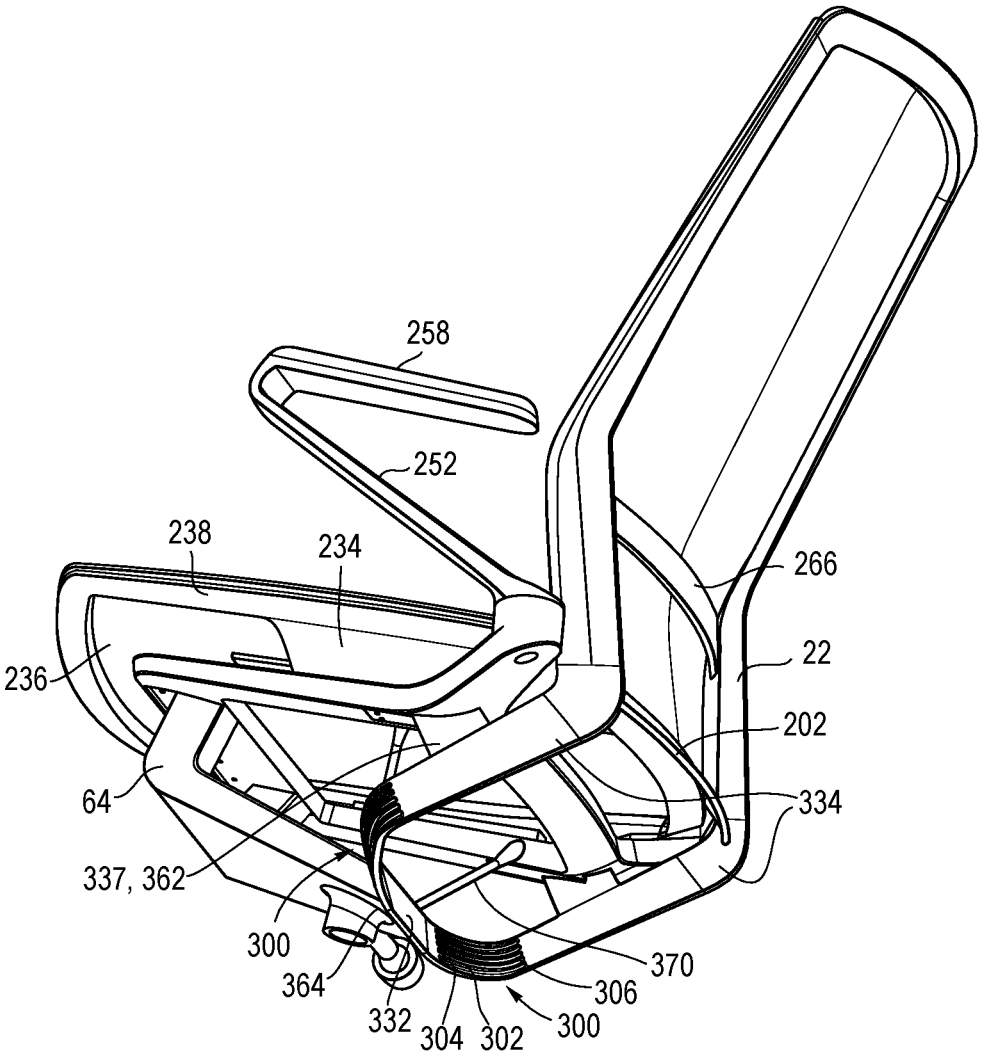
FIG. 21 is a partial bottom perspective view of the body support structure shown in FIG. 14.

The front portion 222 is cantilevered forwardly from the rear portion 220 in an unsupported and vertically spaced apart relationship relative to the seat carrier 32, or platform. When loaded by a user, the front portion 222 may deflect downwardly. In one embodiment, the seat has an overall length $L_s$ between front and rear edges 240, 242 thereof as shown in FIG. 15. The front portion 222 has a length $L_f$ while the rear portion 220 has a length $L_R$, with $L_S=L_F+L_R$. In one embodiment, the length $L_F$ of the unsupported front portion 222 defines 50% or less of the overall length $L_S$ of the seat support 42. A body support member 44, such as a shell or suspension material, is disposed across the central opening 236 and may be secured to the seat support 42, for example along an edge thereof. The body support member may also include a foam cushion supported by the shell and a cover disposed over the foam.

Figure 27:
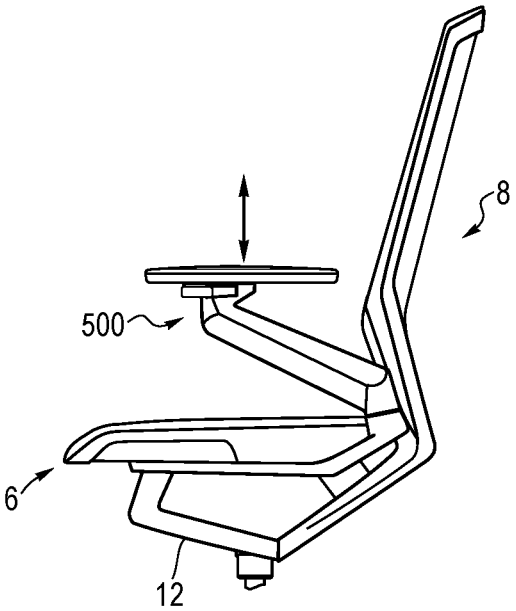

Referring to FIGS. 1-5 and 53, a pair of armrests 46 are coupled to and extend upwardly and forwardly from the rear support platform 40, such that the armrests 46 move with the seat, or platforms 32, 40. The platform 40 extends rearwardly under, and has a rear portion positioned rearwardly from, the bottom cross member 26 of the backrest frame. The platforms may each include an upwardly extending post 41, which engages or receives a bottom of the armrest 46, which is inserted onto the post. In this way, the armrests 46 move with the seat, but also do not obstruct the space along the side of the seat such that a user may position their legs along the side thereof. The bottom member 26 of the backrest frame is spaced apart from the support platform 40, and defines a space or gap ("G") therebetween. As such, the backrest 8 may move relative to the seat 6. The armrests 46 are outwardly, laterally spaced from the backrest uprights 22 and extend forwardly from the backrest 8, intersecting a lateral projection of the uprights 22, such that they are exposed above the sides of the seat 6. The seat 6 is nested between and positioned laterally inboard from the respective uprights 22 on adjacent sides of the chair. A notch 52 may be formed in opposite sides 48 of the seat to receive the uprights 22 and allow for relative movement therebetween. In other embodiments, the armrests 46 may be coupled to the platform, or seat carrier 32 in front of the backrest, and in front of a pivot joint 66 connecting the seat, and platform, or seat carrier 32 in particular, to the backrest uprights 22. The armrests may be variable height armrests 500 as shown in FIG. 27 with a parallelogram support structure, or may be fixed, for example configured with a fixed height stem and arm pad.

Figure 62:
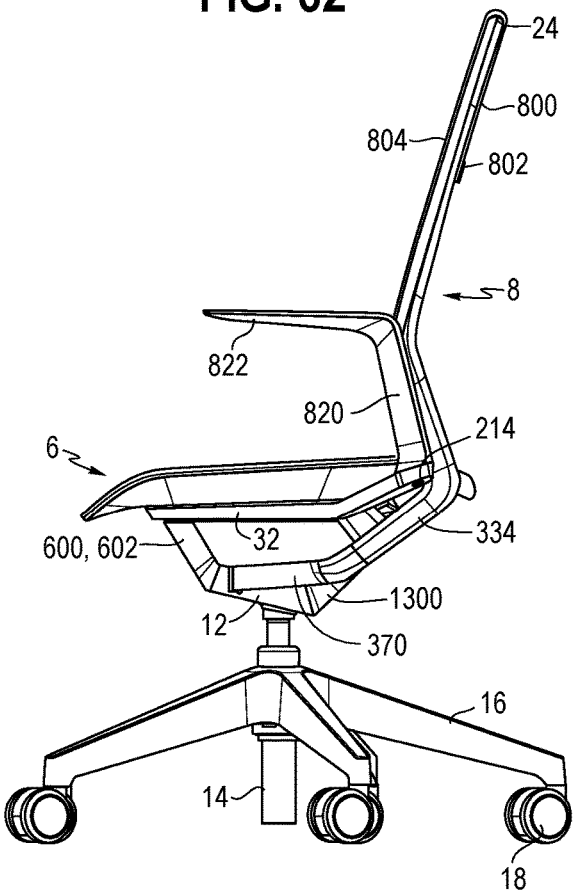
FIG. 62 is a side view of another embodiment of a body support structure.
Figure 63:
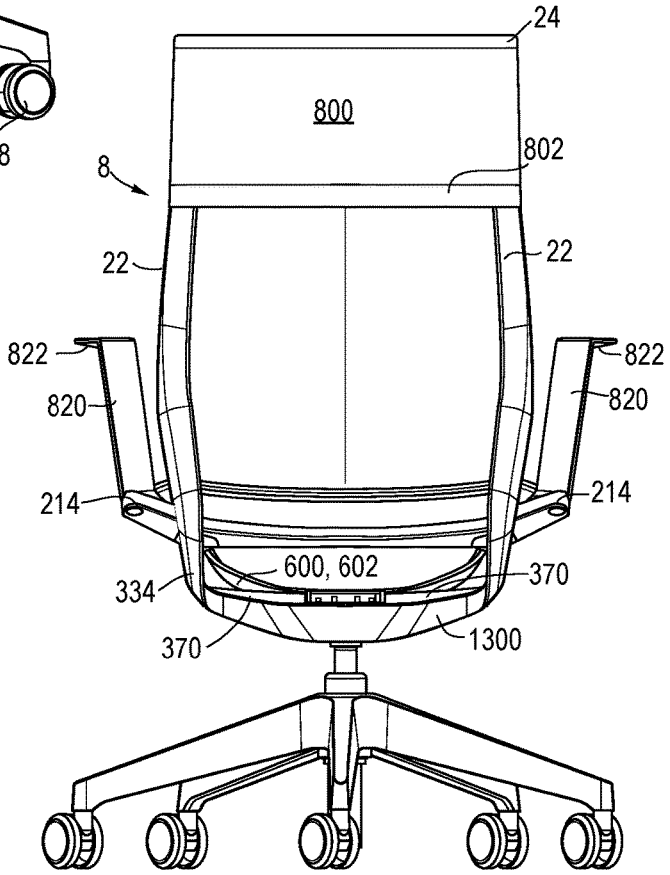
FIG. 63 is a rear view of the body support structure shown in FIG. 62.

Referring to FIG. 14-17, an alternative embodiment of the body support structure includes a pair of armrests 250, which are coupled to and extend upwardly and forwardly from a pair of rear support platforms 214 extending laterally outwardly from the seat carrier 32, such that the armrests 250 move with the seat carrier or platforms 32, 214. In this embodiment, the armrests 250 may include a lower portion 252 having a first end 254 coupled to the support platform 214 and a second end 256. The lower portion 252 extends upwardly and forwardly from the platform 214. A horizontal and longitudinally extending arm support 258 is coupled to the second end 256 of the lower portion and is cantilevered rearwardly. The arm support has a free end 260 disposed in front and outboard of the front surface of the backrest 8. As shown in FIGS. 62 and 63, the armrest includes an upright portion 820 coupled to the platform and a horizontal, cantilevered portion 822 extending forwardly from the upright portion 822. The cantilevered portion 822 may include a padded portion on a top thereof.

Figure 24:
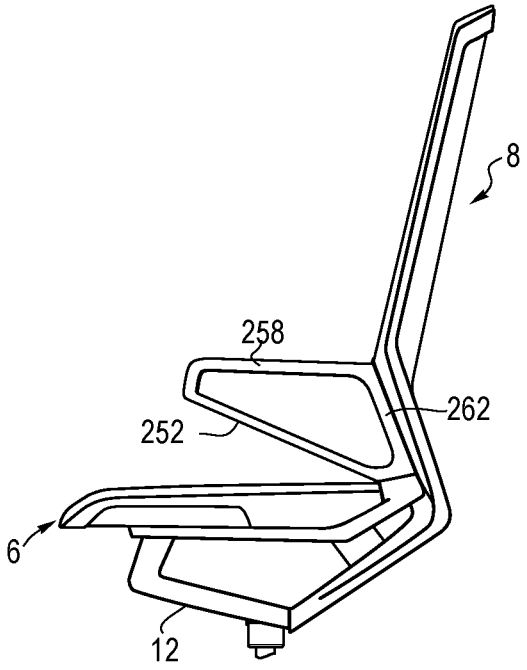
FIGS. 24-27 are left side views of a body support structure with alternative armrest configurations.
Figure 25:
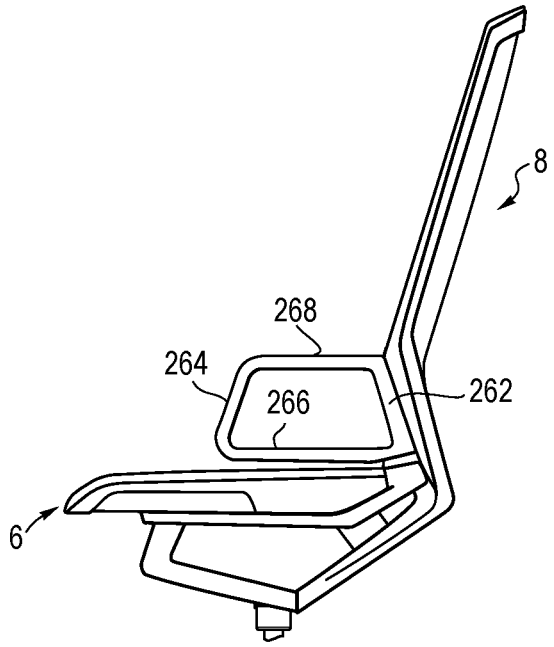
Figure 26:
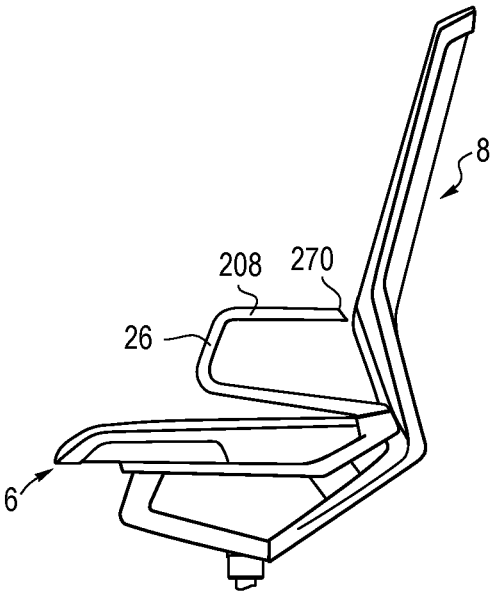

In an alternative embodiment shown in FIG. 24, an armrest may be configured as a closed loop, with a rear support joining the arm support 258 and a lower portion 252, which may include a lower portion of the uprights 22 in one alternative embodiment. The lower portion 252 may or may not be connected to the uprights. In another embodiment shown in FIG. 25, the armrest may again be formed as a closed loop, but with a quadrilateral shape. The armrest has front and rear supports 264, 262 joined with an upper armrest support 268 and a lower support 266, with the lower support 266 and rear support 262 joined with the support platform. In yet another embodiment shown in FIG. 26, the rear support may be omitted, with the upper support 268 again having a free end 270.

Referring to FIGS. 1-4 and 14-17, the seat 6, and in particular the platform, or seat carrier 32, is pivotally connected to the base 12 at a first pivot joint 60, which is positioned adjacent a front portion of the seat and base. In one embodiment, the base 12 has a bottom member 62 that is connected to the support column 14 and extends longitudinally, or is cantilevered, forwardly from the support column. The base further includes a front upturned support or yoke, which may have a U-shape, comprising a pair of laterally spaced support platforms 64. The pivot joints 60 may be defined by a living hinge, or by a pivot pin.

Referring to FIGS. 45-55, a U-shaped yoke 600 defines the support with a pair of spaced apart arms 602 defining the support platforms 64. A bottom, central portion 604 of the yoke is secured to the base 12, which may be configured as a housing, made for example from a casting. A plate 606, or cross member, extends laterally across the space between the arms 602 and connects to the support platforms 64, for example with fasteners. In one embodiment, the plate is rigid, and may be made of metal such as steel.

Referring to FIGS. 1-4, the backrest 8, and in particular the uprights 22, is pivotally connected to the seat 6 at the second pivot joint 66, which is longitudinally spaced and positioned rearwardly of the first pivot joint 60. The uprights 22 have an uppermost portion 68 defining in part the central opening, an intermediate portion 70 between the upper portion and the pivot joint 66 and a lower portion 72 extending downwardly from the pivot joint 66. The pivot joint 66 may be defined by a living hinge, or by a pivot pin.

In an illustrative embodiment, a laterally extending torsion leaf spring 80 has an intermediate, or central, portion 82 connected to the base 12 and laterally spaced opposite end portions 84 connected to the uprights 22. In illustrative embodiments, the end portions 84 are connected particularly to the lower portions 72 of the uprights 22. Opposite arm portions 86 of the torsion leaf spring 80 extend between the intermediate portion 82 and the end portions 84 and define a pair of links coupling the backrest 8 to the base 12. In one embodiment, the connection between the leaf spring 80 and base 12 is positioned rearwardly of the support column 14. The leaf spring 80 may be coupled to the base 12, or the rear of the platform, with fasteners, adhesives, bonding, welding or other types of connections, or may be integrally formed therewith as a one-piece unitary structure. In other embodiments, a pair of separate leaf springs may be secured between the base and the pair of uprights, one on each side of the base, or a pair of leaf springs may overlap along the central portion. In other embodiments, a single torsion leaf spring may suffice to connect two components, such as a base and backrest and/or seat.

Figure 40:
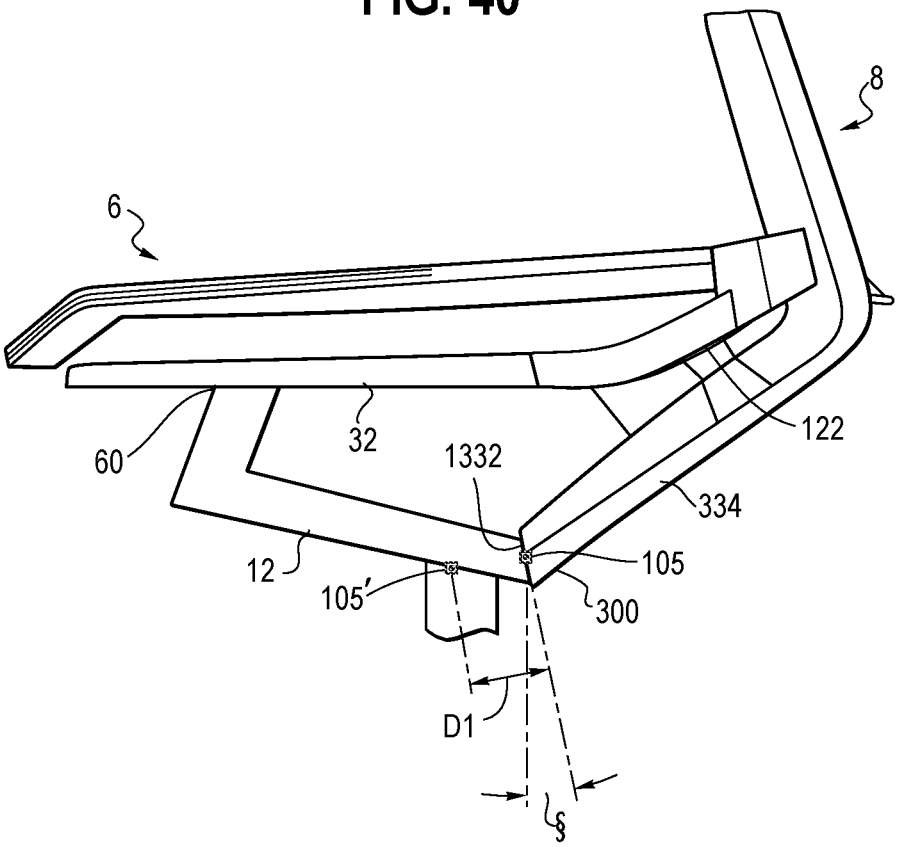
FIG. 40 is a side view of a schematic of one embodiment of a body support structure.

The torsion leaf springs, and in particular the arm portions 86, define a pair of links or flexible portions that are both bendable and twistable between an at-rest configuration and a biased configuration. The backrest 8 is pivotable and translatable relative to the base 12 from an upright position to a reclined position as the torsion leaf spring 80, and in particular the arm portions 86, are bent and twisted between the at-rest configuration and the biased configuration. The torsion leaf spring 80, and in particular the arm portions 86, biases the backrest 8 toward the upright or at-rest position from the reclined position. The torsion leaf spring 80, or arm portions 86, each provide two degrees of freedom, which allows the seat 6 and backrest 8 to pivot relative to the base about an axis and each other, with the lower portions 72 of the uprights 22 in an illustrative example both pivoting about an axis 90, and with the axis 90 translating relative to the base 12, i.e., moving fore/aft and/or up/down relative to the base 12 as shown in FIG. 40. In one embodiment, the axis 90 moves in at least a forward direction during recline. In one embodiment shown in FIGS. 40 and 43A, the end 105 of the longitudinal portion of a biasing component 300, configured as a torsion leaf spring 80, e.g., the outboard end 105 of the biasing component 300 positioned along the axis 104 of the biasing component, moves forwardly and downwardly a distance (D1) to a second position 105'. In this way, the torsion leaf spring 80, or biasing component 300, provides an additional degree of freedom by flexing (bending about a principal axis 100 of the leaf spring 80 and twisting about a lateral axis 104) instead of sliding and rotating. In other words, the bending and twisting mimics a sliding/rotation joint or crank and slide joint. In this way, the control mechanism 10, or kinematic control system, includes the leaf spring 80 or biasing component 300, the base 12, seat carrier 32 and lower portion 72, which define three links joined by two pivot joints 60, 66. The control mechanism 10, and the overall linkage mimics a three-bar slide mechanism. It should be understood that the torsion leaf spring, with the twisting and bending deformation, may be used in combination with other linkages and systems. In combination, the overall system is provided with sufficient degrees of freedom to allow the seat and back to recline relative to the base and each other. In addition, the torsion leaf spring provides a restoring or biasing force to the back uprights, resisting the recline of the user and causing the backrest and seat to be biased from the reclined position to the upright (e.g., at-rest) position. The ends of the spring may be rotatably connected to the uprights 22, or may be fixedly, non-rotatably connected to the uprights 22, with the rotation axis thereby defined along a neutral axis of the leaf spring as the spring twists in torsion. In one embodiment, the torsion leaf spring is the only component directly connecting the uprights 22 and base 12, and the backrest is only connected to the seat at the pivot axis 66, 129, and to the base via the torsion leaf spring 80, and is not otherwise supported by any other links or components.

Figure 5:
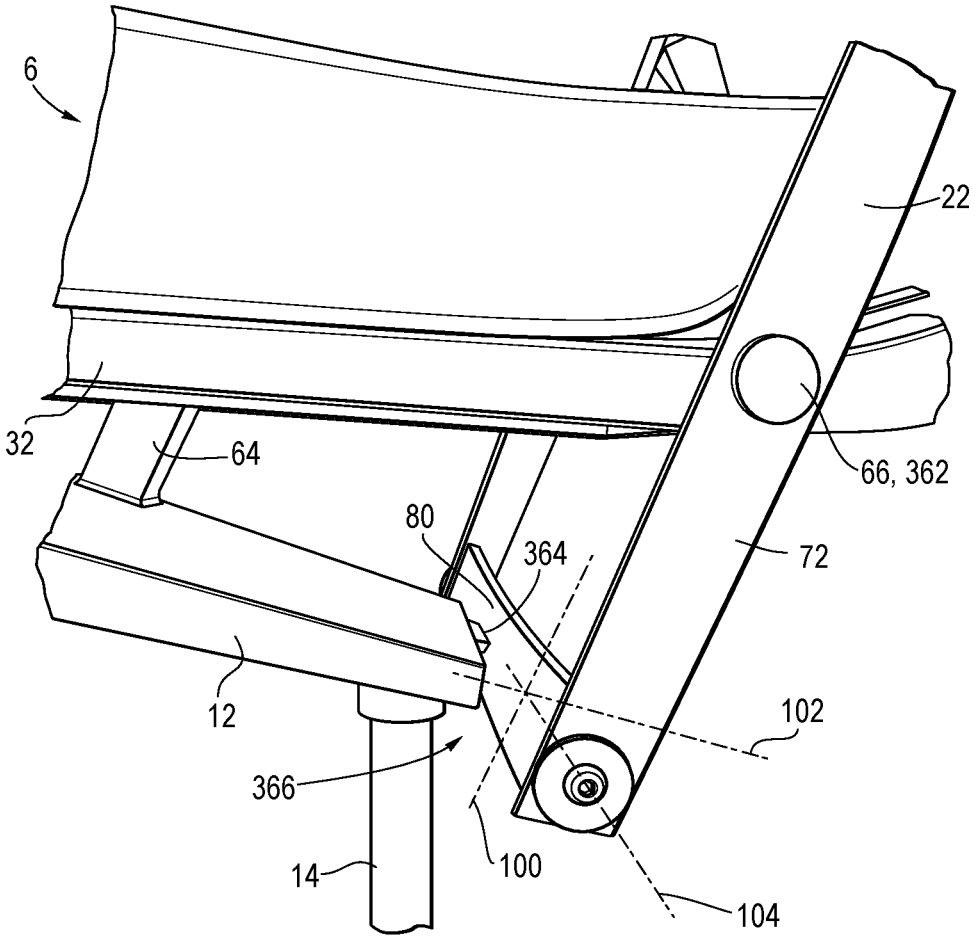
FIG. 5 is an enlarged, partial view of a portion of tilt control mechanism.
Figure 6A:
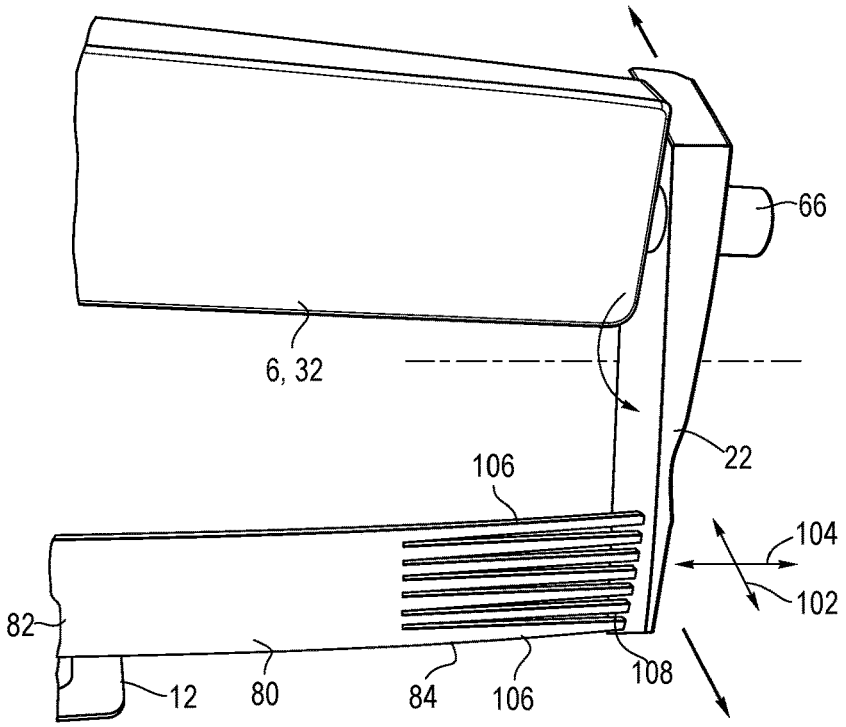
FIGS. 6A and B are partial front views of a torsion leaf spring in a biased and an at-rest configuration respectively.
Figure 6B:
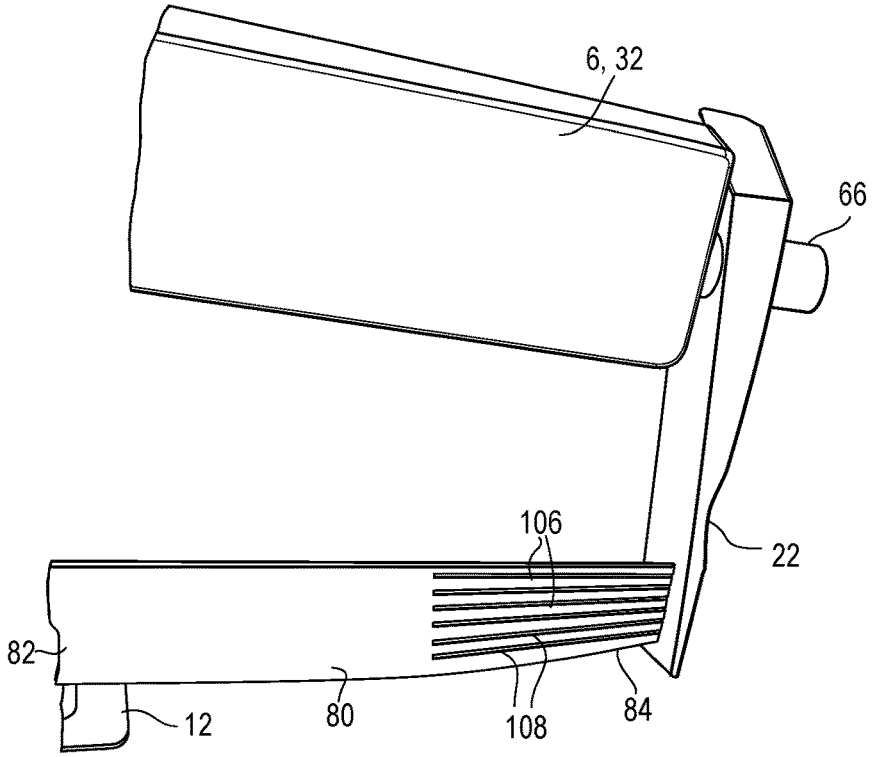

In one embodiment, the torsion leaf spring 80 has a rectangular cross section as shown in FIGS. 5-6B, and is configured as a thin blade having principal bending axes 100, 102. The cross section may be constant along the length of the leaf spring, or may vary. The leaf spring 80 may be configured with first and second principle axes 100, 102 and a longitudinal or neutral axis 104, wherein the torsion leaf spring is bendable about at least the first principle axis 100 (i.e., translation), and wherein the torsion leaf spring is twistable about at least the neutral axis 104 (rotation). In this way, the spring provides for multi-directional deformation as it is elastically deformed. The torsion leaf spring may have other cross sections that are not rectangular, for example circular, or may have varying cross sections, both in shape and size.

In one embodiment, shown in FIGS. 6A and B, each of the end portions 84 includes a plurality of fingers 106, otherwise referred to as bands, connected to the backrest uprights 22. The fingers/bands may be individually connected to the uprights with a non-rotatable or a rotatable connection. In one embodiment, the fingers/bands 106 are spaced apart along the second principle axis 100, and are defined by spaced apart and longitudinally extending slits 108 made in the leaf spring. In one embodiment, the slits 108 are linear and parallel to each other. In one embodiment, the slits 108 are through-openings or extend through the entire thickness of the torsion leaf spring 80, and may have the same width, while in other embodiments, the slits 108 may have varying widths, both individually and relative to each other (i.e., the space between the slits may vary). In an alternative embodiment, the slits 108 may terminate short of the end of the leaf spring 80, with the end of the leaf spring 80 being connected to the backrest upright 22. In an alternative embodiment, the fingers 106 may be located adjacent to, and be connected to, the base 12, or the spring 80 may have two sets of fingers, with one set located adjacent the base and the other set located adjacent the uprights. The fingers/bands 106 and/or slits 108 may have different or the same lengths than other fingers and/or slits. For example, the fingers/bands 106 and and/or slits 108 may be longer along a bottom of the spring 80, and shorter along the top of the spring 80, with or without a gradual lengthening from bottom to top. Likewise, the fingers/bands and/or slits may have different or the same widths, measured along the second principle axis 100. In one embodiment, each of the plurality of fingers/bands have lengths less than 50% of an overall length (L) of the leaf spring 80. Each of the plurality of fingers/bands may have a length less than 25% of an overall length (L) of the leaf spring, defined between the end portions 84 of the spring 80. In another embodiment, the entirety of the leaf spring 80 is defined by a plurality of fingers/bands, or individual leaf springs 80 positioned adjacent one another with a space or gap between each pair of adjacent fingers. The overall length Li may also be considered as the length of a single arm (e.g., approximately ½ L), measured between the central location and an end of the spring, in an alternative embodiment. In one embodiment, at least a portion of the cross-section of the leaf spring, for example the intermediate portion 82 is solid material, or has a solid cross section without voids (except for fastener openings if applicable). The leaf spring may be made of various resilient materials, including a composite material such as a glass filed thermoplastic. The length and number of fingers/bands may affect the biasing force of the leaf spring 80, making the spring softer or harder (less or more stiff), with longer fingers/bands, or more fingers/bands, for example making the spring less stiff. The leaf spring may have various thin regions extending across a width thereof to define flex joints, with the spring having isolated compliance wherein the leaf spring is elastically deformed (e.g., through bending) primarily at the flex joints.

Figure 22:
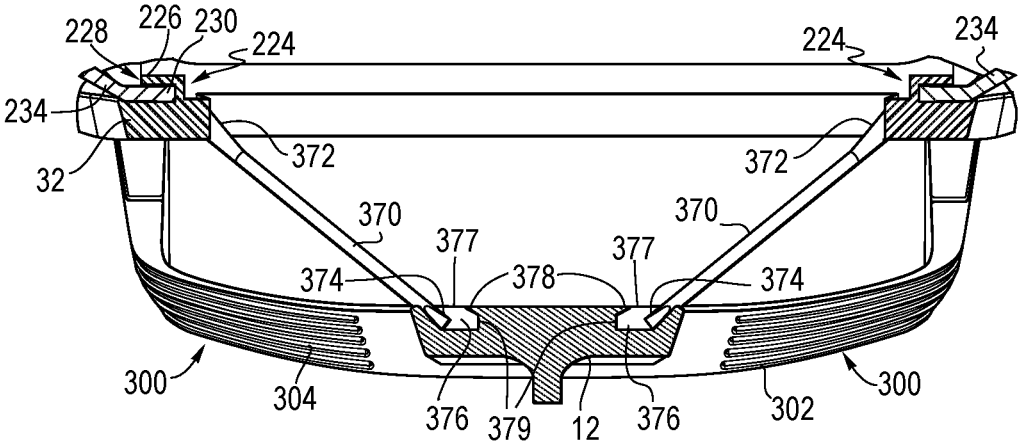
FIG. 22 is a partial cross sectional view of the body support structure taken along line 22-22 of FIG. 14.
Figure 23:
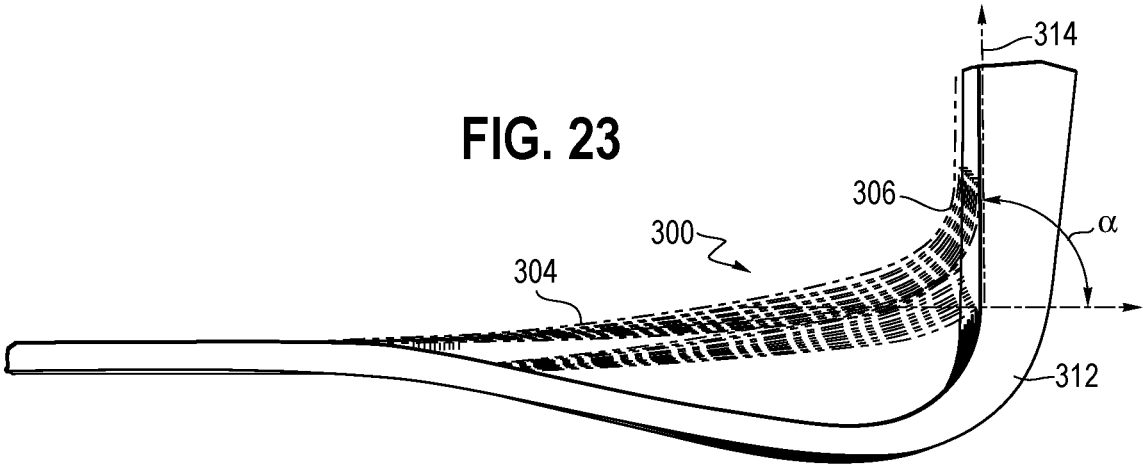
FIG. 23 is a top view of one embodiment of the torsion leaf spring in at rest and biased configurations.

In another embodiment, shown in FIGS. 14-23, the biasing component 300, configured as a torsion leaf spring, again includes a plurality of spaced apart fingers/bands 302 defined by spaced apart slits 330 formed in the biasing component. In one embodiment, the biasing component, or torsion leaf spring, is the only component directly connecting the backrest and base, and the backrest is only connected to the seat at the pivot axis or joint 66, 129, and to the base via the biasing component 300, and is not otherwise supported by any other links or components. At least some of the fingers/bands 302 have a laterally extending first portion 304 extending in a first direction, for example a lateral direction 4, a second portion 306 extending in a second direction, for example a longitudinal direction 2, and a curved transition portion 308, or region, between the first and second portions. It should be understood that first and second portions 304 and 306 may also be curved, or have curvature, but with the term "direction" referring to the orientation of a tangential vector. For example, a first direction refers to a vector/tangent 312 tangential to the first portion 304 at a first end thereof and a second direction refer to a vector/tangent 314 tangential to the second portion 306 at the second end thereof as shown in FIG. 23. The first and second directions, or vectors 312, 314, are non-planar. In various embodiments, the first and second directions, or vectors/tangents 312, 314, define an angle (a) of 90 degrees or less therebetween. In one embodiment, the first and second vectors/tangents are substantially orthogonal, although in other embodiments the angle may be greater than 90 degrees. The fingers/bands 302 may have an L-shape, with a first leg defined by the first portion 304 and defining the end 105 of the longitudinal portion 304, a second leg defined by the second portion 306 and the transition portion 308 defined therebetween. The fingers/bands 302 are spaced apart and defined by slits.

Put another way, slits 330 may be formed in a leaf spring having a laterally extending component and a longitudinally extending component joined by a transition region, which may be curved. It should be understood that the longitudinally extending component may have a combined fore/aft and up/down orientation. The slits 330 extend continuously in the laterally and longitudinal extending components and transition region. In one embodiment, the slits 330 are formed as through-openings extending through the entirety of the thickness of the leaf spring. In one embodiment, the slits 330 may be filled with a secondary material, such as overmolding. The slits 330, including the portions thereof defined in the laterally and longitudinally extending component and transition region may be planar, and lie parallel to each other, meaning the entirety of (e.g., entire length of) one slit is equally spaced from an adjacent slit, or the length thereof. In other embodiments, the slits may be non-planar, or curvilinear, although they be equally spaced from adjacent slits, or not. The biasing component may further include a base portion 332. The first portions of the fingers/bands 302 may extend from and be coupled to the base portion. In one embodiment, the base portion 332 and fingers/bands 302 may be integrally formed. It should be understood that in one embodiment, the slits 330 may extend across the entirety of the base portion 332 such that the slits on both sides are integrally formed as a continuous slits.

In one embodiment, the biasing component 300 is integrated into the backrest frame 20, with the second portions 306 extending from and coupled to longitudinally extending and laterally spaced back support members 334 extending forwardly from and connected to the uprights 22. The support members 334 are relatively rigid and do not elastically deform during recline of the backrest. The entire backrest frame 20, including the uprights 22, support members 334, and biasing component 300 may be integrally formed as a one-piece member. In one embodiment, the body support structure 13 includes a pair of laterally spaced biasing components 300, which are joined by and include a central base portion 332. The base portion 332 is coupled to the rear of the base 12, for example with fasteners, adhesive, or integral molding. In one embodiment, the base portion 332 may have a first outermost surface profile, and the first portion 304 includes a second outermost surface profile. The first and second profiles may be the same at a junction of the first portion 304 and the base portion 332.

Alternatively explained, the biasing component/torsion leaf spring 300 defines a laterally extending deformable link 340 connected between first and second components that are moveable relative to each other along a path, for example the base 12 and backrest 8 are moveable relative to each other. The deformable link 340, which may have distributive or isolated compliance, may join other components moveable relative to each other, including for example the seat and base, or the seat and backrest, or any two structures (not limited to body support structures) that are moveable relative to each other, with the deformable link defining the path of movement between the components through the deformation thereof, which path may include multiple degrees of freedom including translation along any of axes 100, 102, 104, and/or rotation about axis 104. In other words, the deformable link 340 may twist about an axis 104 while bending about a principal axis 100, and may also bend about a principal axis 102, with the deformable link thereby mimicking a slider/crank joint. The deformable link 340 may be configured with the plurality of spaced apart elongated slits 330, or one or more flex regions as explained in more detail below, or combinations thereof. The deformable link is non-planar, and includes a first portion 346, defining an end 105, connected to the first component, for example the base 12 or uprights 22, and a second portion 344 connected to the second component, for example the other of the base 12 or uprights 22. The first and second portions may be joined by an elbow portion 342 in one embodiment. In one embodiment, the slits 330 may extend continuously along at least portions of the first, second and elbow portions. The first and second portions define an angle therebetween (e.g., 90 degrees or less), and may be substantially orthogonal in one embodiment, for example with the first portion 346 extending laterally and the second portion 344 extending longitudinally (e.g., rearwardly and/or upwardly/downwardly. The first, second and elbow portions 346, 344, 342 are integrally formed as a one-piece component. The movement path may include bending and twisting of one or more (or all) of the first, second end elbow portions.

In one embodiment, and referring to FIGS. 33-40, 43A, 43B and 44, a biasing component 1300, or torsion leaf spring, is configured as a deformable link 1340 having one or more flex regions 1302, 1304 that provide isolated compliance at those flex regions. The biasing component 1300, or deformable link 1340, is non-planar, and includes a first portion 1346 connected to the first component, for example and without limitation the base 12, and a second portion 1344 connected to the second component, for example and without limitation the uprights 22. One or both of the first and second portions 1346, 1344 may be relatively rigid and not undergo any substantial elastic deformation during recline. The first and second portions 1346, 1344 may be joined by an elbow portion 1342 in one embodiment. In other embodiments, the elbow portion may be omitted, with the flex region 1304 defining the junction between the first and second portions 1346, 1344. In one embodiment, the first and second portions 1346, 1344 define an angle therebetween (e.g., 90 degrees or less), and may be substantially orthogonal in one embodiment, for example with the first portion 1346 extending laterally (outwardly and/or upwardly/downward) and the second portion 1344 extending longitudinally (e.g., rearwardly and/or upwardly/downwardly). In one embodiment, the first, second and elbow portions 1346, 1344, 1342 may be integrally formed as a one-piece component.

Figure 39:
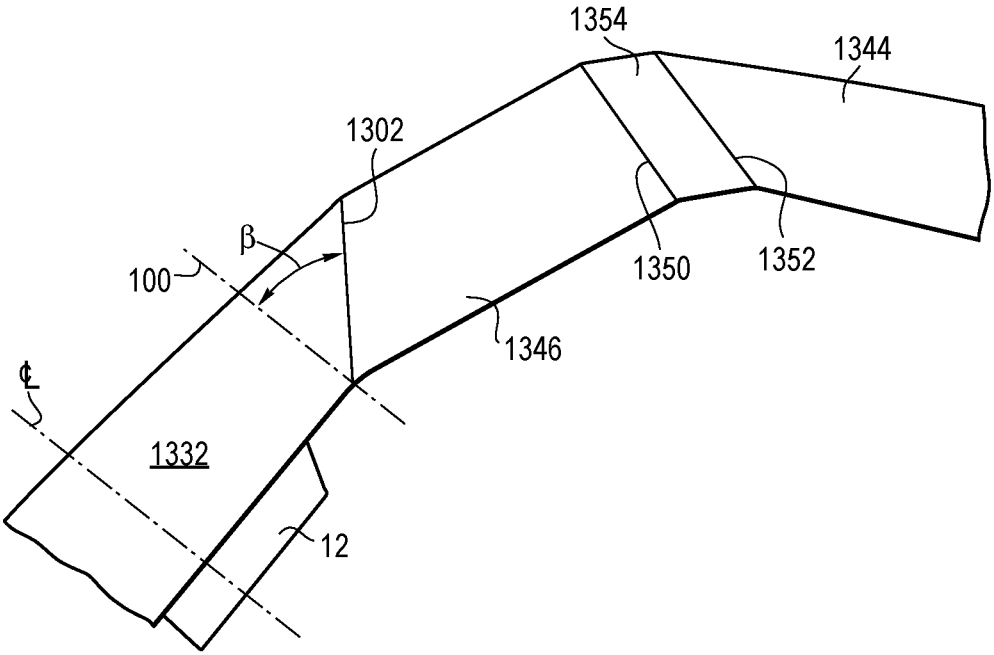
FIG. 39 is a partial rear view of one embodiment of a biasing component.

In one embodiment, the biasing component 1300, or deformable link 1340, may include a base portion 1332, which is coupled to the base 12. The base portion 1332 and first portions 1346 may lie in, or define, one or more substantially vertical planes (the same or different), or may be oriented in non-vertical planes, for example tilted clockwise or counterclockwise from a vertical plane when viewing the biasing component from the right hand side. The flex region 1302 separates and joins the base portion 1332 and the first portion 1346. It should be understood that the description of the biasing component is with reference to one side of the body support structure, but with the understanding that the biasing component 1300 is symmetrical relative to the centerline of the body support structure, meaning for example there are two flex regions 1302 on each side of the centerline. In one embodiment, the flex region 1302 may be substantially linear and extends upwardly and outwardly from a bottom of the biasing component to the top thereof at an angle β of between 20 degrees and 60 degrees relative to a principle axis 100, e.g., a vertical axis in one embodiment, and may define an angle β of about 35 or 40 degrees in exemplary embodiments. The vertical axis and the axis of the flex region, and the angle β measured therebetween, is defined within the plane of the base portion 332, 1332. Described another way, β is measured normal to the plane of the base portion 332, 1332 that the blade, or portion 1346, reacts against. Conversely, the flex region 1302 may define an angle in exemplary embodiments of 50-55 degrees relative to a horizontal axis. The base portion 332, 1332, or plane defined thereby, may be vertical, or may be angled rearwardly at an angle §, as shown for example in FIGS. 16 and 40, wherein § may be between and including 0 to 30 degrees, and is 15 degrees in one embodiment. The angle(s), orientation and location of the flex region 1302, or flex regions 1302 and 1304, control the rate of the change of angle of the frame 20 of the backrest relative to a given recline angle and the base. The flex region 1304 separates and joins the first and second portions 1346, 1344. The flex region 1304 may be substantially linear, or non-linear, and extend along the principle axis 100, although it may be oriented at other angles relative to the principle axis 100. It should be understood that only a single flex region, e.g. flex region 1302, may be incorporated into the biasing component, with the other portions of the deformable link providing distributive compliance through twisting and/or bending to provide the additional degrees of freedom. Alternatively, as shown in FIG. 39, more than two flex regions 1350, 1352 may be provided, including a pair of flex regions 1350, 1352 at the junction between the laterally extending and longitudinally extending portions 1346, 1344, with a transition portion 1354 extending between the flex regions 1350, 1352.

The biasing component 1300 may be configured for example with strategic deformable locations that allow for predetermined deformations, or isolated compliance, and define the flex regions 1302, 1304, 1350, 1352, otherwise referred to as "flex joints," or virtual pivot locations. The phrase "flex region" refers to a portion of the structure that allows for flexing or bending in the designated region, through elastic deformation, thereby allowing or providing for relative flexing movement (e.g., pivoting or bending) of the component, or portions or structure on opposite sides of the flex region, and also thereby defining a virtual pivot location, with the understanding that the virtual pivot axis may move during the flexing, rather than being defined as a hard fixed axis. The various flex regions 1302, 1304, 1350, 1352 may be formed as living hinges, folds or thin flexible hinges made from the same material as the more rigid adjacent portions 1332, 1346, 1344, 1354 of the biasing component, but with a thinner cross-section and lower (area) moment of inertia along the principal axis 100 or axis of the fold at an angle β so as to provide for relative rotation or pivoting between the more rigid pieces by bending or folding of the flex regions 1302, 1304, 1350, 1352 or living hinges. It should be understood that in alternative embodiments, the flex regions may be configured as fixed hinge points. It should also be understood, however, that the portions 1332, 1346, 1344, 1354 may also bend (about principal axis 100), twist (about axis 104) and deform elastically during recline of the body support assembly, and provide for deformation of the overall biasing component through bending and twisting of those portions 1336, 1344, 1354 (i.e., distributive compliance) between the flex regions, but with the majority (or entirety in some embodiments) of the elastic deformation intentionally occurring at the flex regions 1302, 1304, 1350, 1352.

In one embodiment, as shown in FIGS. 33-38, 43A, 43B and 44, the biasing component 1300, and the portions 1332, 1346, 1344, 1354, may be configured as a blade, having a height and thickness, both of which may vary, but which allow for bending about the principal axis 100, or about the flex region 1302, but are resistant to bending about the principal axis 102. The biasing component 1300 may also twist about the axis 104. In one embodiment, each of the blades may have a greater thickness along a longitudinal centerline thereof, with the blade having an elliptical cross section. In one embodiment, the flex regions 1302, 1304, 1350, 1352 are formed by making the blade thinner than the surrounding regions, and also making the blade flat or planar across the width of the blade at the flex region. For example, in one embodiment, the adjacent regions of the blade may have a thickness of 2 to 3 times the thickness of the blade in the flex region. In other words, the flex regions 1302, 1304, 1350, 1352 are introduced by making the blade thin and flat. As such, the flex region has a lesser area moment of inertia, and is less capable of resisting bending, than the adjacent regions. Conversely, the portions 1346, 1354, 1344 may be relatively thick between the flex regions 1302, 1304, 1350, 1352.

Figure 43A:
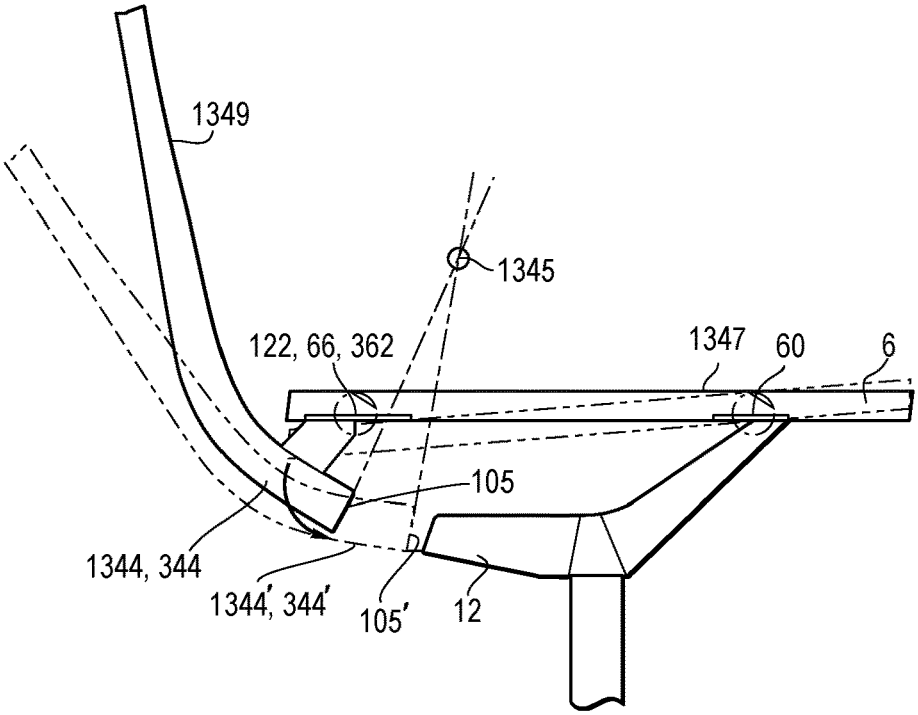
FIGS. 43A and B are side and rear schematic views showing a kinematic control system.

In operation, the backrest 8 is movable relative to the base 12 from an upright position to a reclined position as the leaf spring 80, or biasing component 300, 1300 is deformed to define the path of movement of the backrest. The leaf spring 80 or biasing component 300, 1300 biases the backrest 8 toward the upright (at-rest) position from the reclined position. In one embodiment, the leaf spring 80 or biasing component 300, 1300 is bendable and twistable between an at-rest configuration (shown in FIG. 6B) and a biased configuration (shown in FIG. 6A) as the backrest 8 is pivotable (e.g., about axis 104) and is translatable (e.g., along axis 102) relative to the base 12 from the upright position to the reclined position, with the axis 90, or end portion 105, moving forwardly and/or downwardly depending on the other constraints of the system as shown in FIGS. 40 and 43A The uprights may also move slightly inboard along the axis 100 as the leaf spring 80 or biasing component 300, 1300 deforms. The leaf spring 80 and biasing components 300, 1300 experience elastic deformation when bending and twisting, as shown in FIGS. 23 and 43A, and applies a return force to the backrest 8 resisting the recline of the user. In the embodiment of FIGS. 6A and B, the fingers 106 each act as an independent torsion leaf spring that experiences torsion and bending.

In one embodiment, and referring to FIGS. 14-21, the body support structure includes three basic components, including the base 12, the seat 6 and the backrest 8. The seat is pivotally connected to the base 12 at a first location 360, which may be defined by pivot joint 60. The backrest 8 is pivotally connected to the seat at a second location 362, which may be defined by pivot joint 122, and is fixedly connected to the base 12 at a third location 364, which may be defined in one embodiment as the connection between the base portion 332 and the base 12. The backrest 8 includes a flexible portion 366, which may be defined by the fingers/band and/or slits, or alternatively the portions 1346, 1344, 1354 and flex regions 1302, 1304, 1350, 1352, disposed between, or connecting, the second and third locations 362, 364. In some embodiments, the flexible portion 366 may include the isolated compliance aspects, such as strategic flex regions 1302, 1304, 1350, 1352, and distributed compliance components such as the portions 1346, 1344, 1354, which may provide for elastic deformation through bending and twisting. Alternatively, the flexible portion may only include isolated compliance aspects, such as strategic flex regions 1302, 1304, 1350, 1352, with the other portions/regions 1346, 1344, 1352 remaining rigid and not undergoing distributed compliance or elastic deformation. The backrest 8 is pivotable and translatable relative to the base 12 from an upright position to a reclined position as the flexible portion 366 is bent about the principal axis 100 and/or twisted about axis 104 between an at-rest configuration and a biased configuration. In this way, the flexible portion 366 may provide at least 2 degrees of freedom, allowing for a translation and rotation of the backrest relative to the base and rotation of the seat relative to the base, as shown for example and without limitation by the movement of the end 105 of the biasing component in FIGS. 40 and 43A, thereby providing a synchro tilt mechanism wherein the seat and backrest recline at different ratios. In other embodiments, the flexible portion 366 may have more than 2 degrees of freedom defining the movement thereof. In one embodiment, the flexible portion 366 provides distributive compliance, with the entirety of the flexible portion capable of undergoing elastic deformation, whether through torsion or bending. The isolated compliance, distributive compliance, or combination of isolated and distributive compliance, allows for the motion of the seat and back but eliminates the need for a slide and pivot joint between the backrest and base, or between the seat and backrest.

Figure 43B:
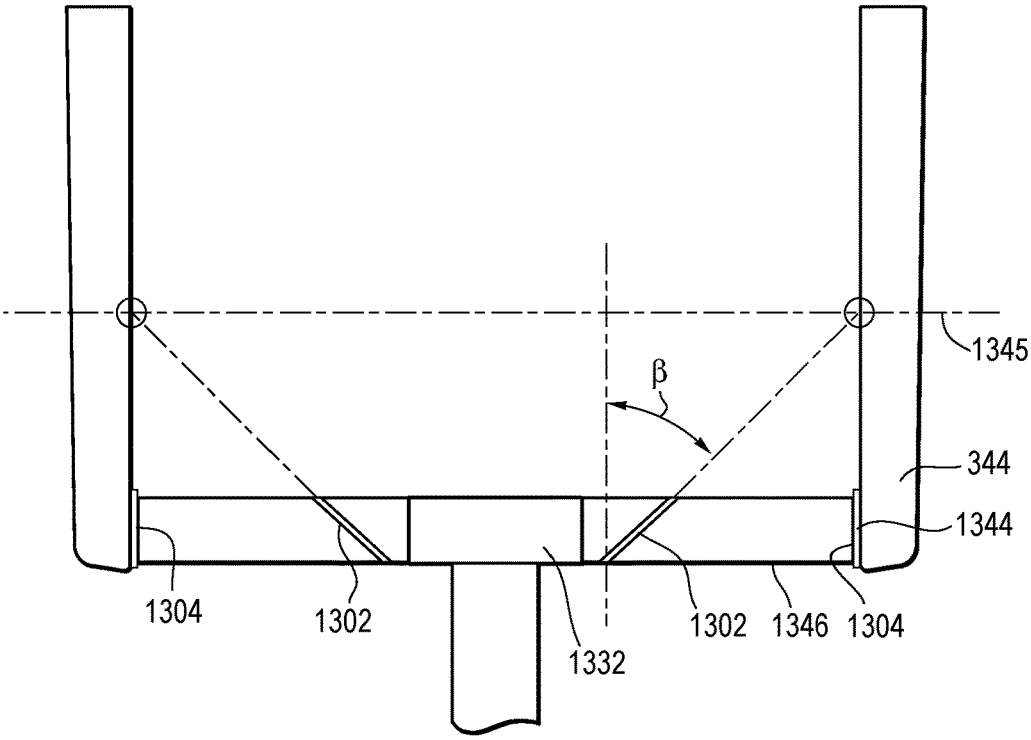
Figure 44:
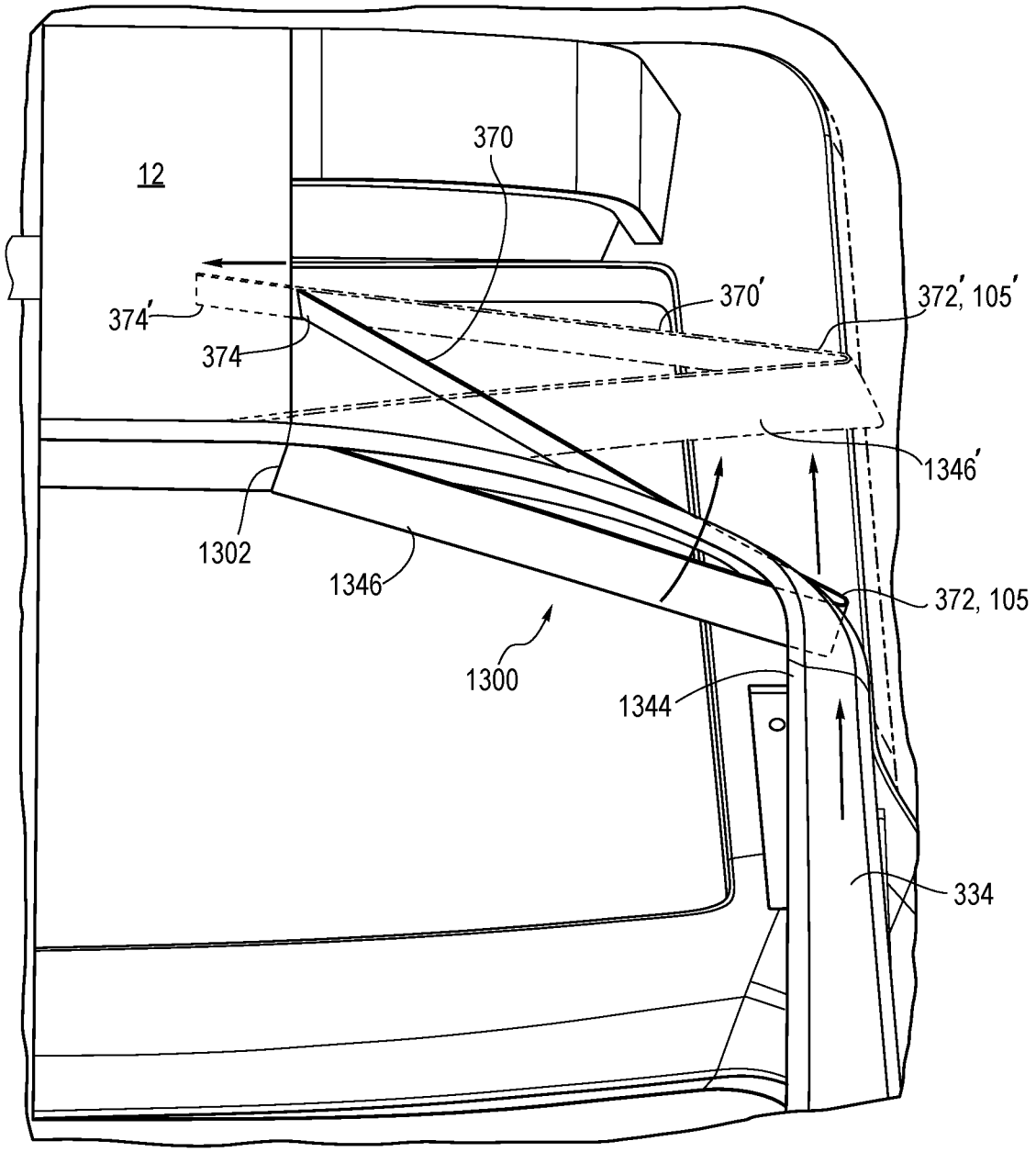
FIG. 44 is partial top view of a kinematic control system.
Figure 45:
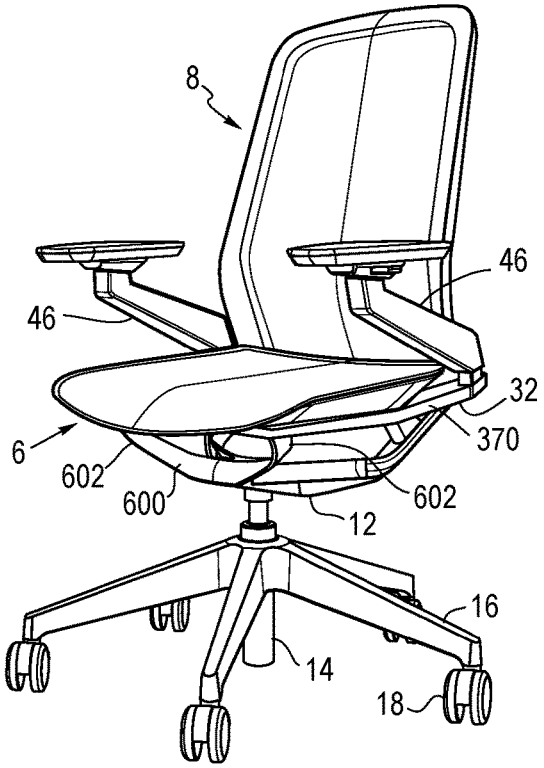
FIG. 45 is a front perspective view of another embodiment of the body support structure.
Figure 46:
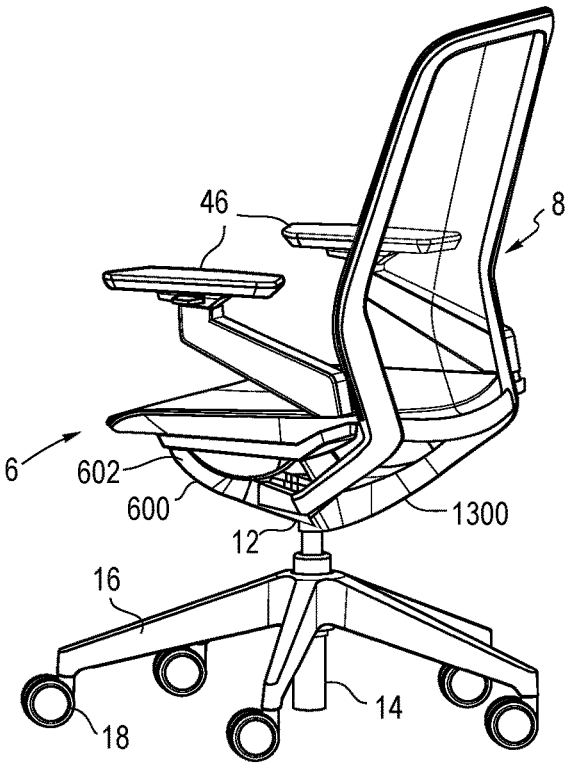
FIG. 46 is a rear perspective view of the body support structure shown in FIG. 45.
Figure 47:
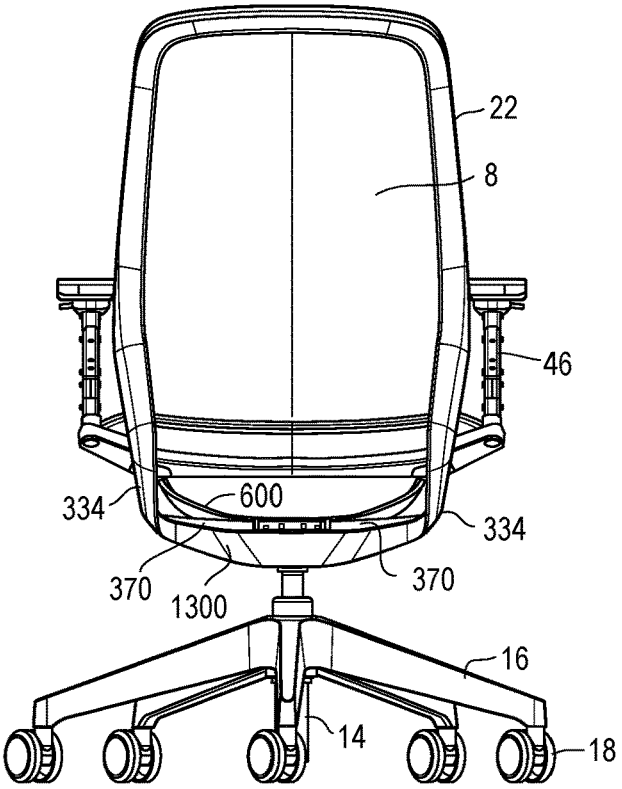
FIG. 47 is a rear view of the body support structure shown in FIG. 45.
Figure 48:
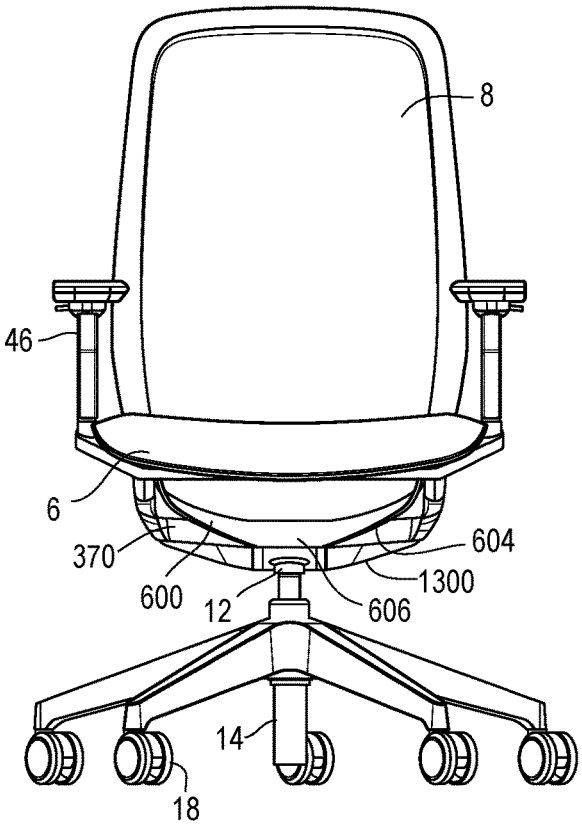
FIG. 48 is a front view of the body support structure shown in FIG. 45.
Figure 49:
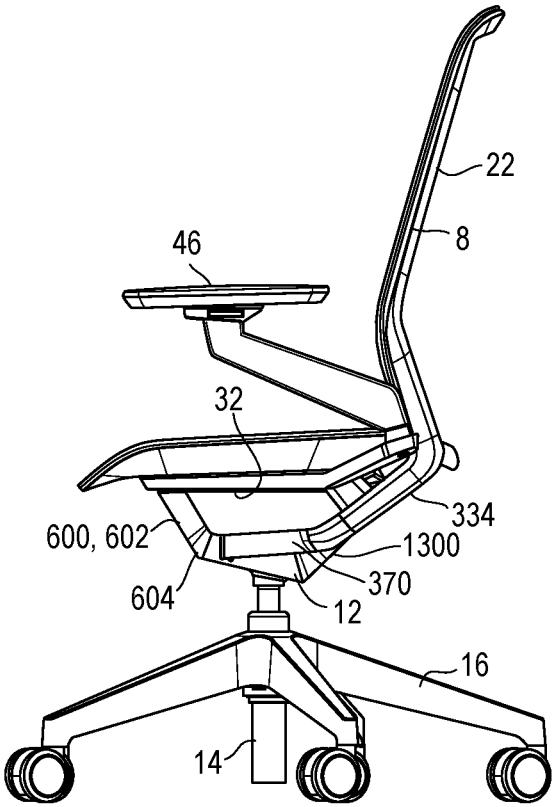
FIG. 49 is a left side view of the body support structure shown in FIG. 45.
Figure 50:
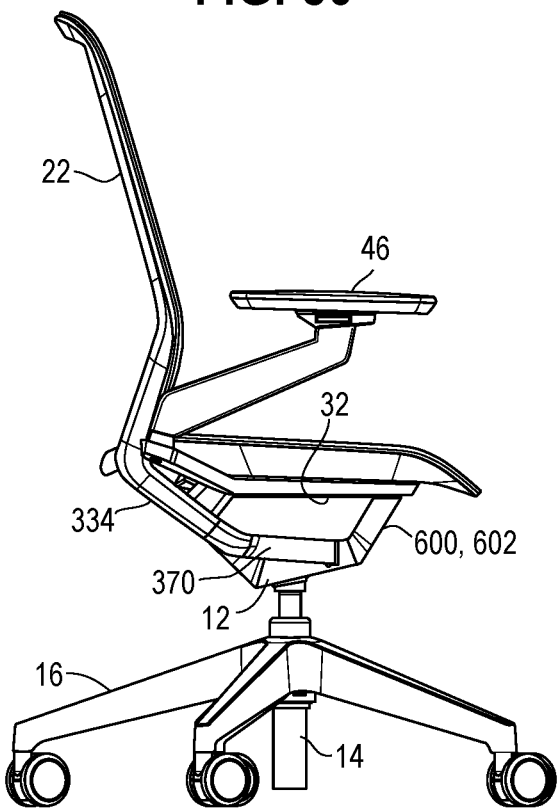
FIG. 50 is a right side view of the body support structure shown in FIG. 45.
Figure 51:
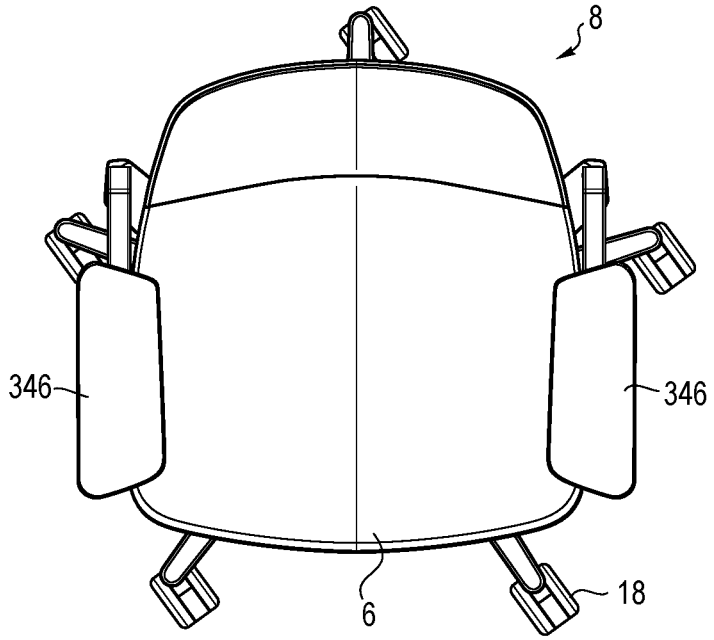
FIG. 51 is a top view of the body support structure shown in FIG. 45.
Figure 52:
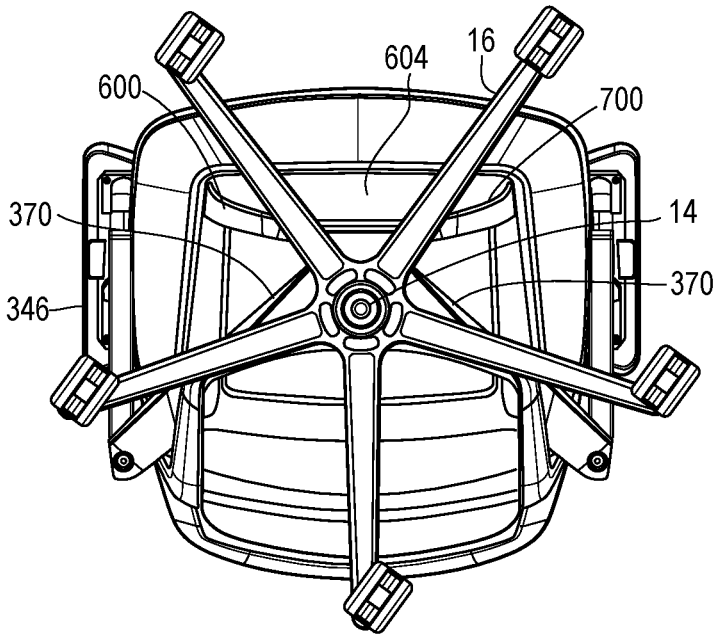
FIG. 52 is a bottom view of the body support structure shown in FIG. 45.

As mentioned, the flexible portion may also be provided with specific flex regions 1302, 1304 that provide isolated compliance at those joints, while still defining the required motion path of the backrest relative to the seat and base. For example, as shown in FIGS. 43A, 43B and 44, the end 105, 105' of the portion 1346 may rotate and translate forwardly relative to the base 12 through bending at the flex joint 1302, which extends angularly at angle β, as the portion 1346, 1346' rotates about the flex joint 1302. At the same time, the portion 1344, 1344' rotates and translates forwardly relative to the base through bending at the flex joint 1304, with the understanding that the flex joint moves (translates and rotates) with the end 105. In this embodiment, the portions 1346, 1344 of the blade may not experience any bending or twisting, but rather the motion path is defined only by bending or rotation at the flex joints 1302, 1304, with the flex joint 1302 positioned at angle β such that the portion 1346 moves forwardly and downwardly as the portion 1346 pivots about the flex joint 1302. In other embodiments, the portion 1346 may also experience some bending or twisting. As shown in FIGS. 43A and B, the end 105 of portion 1346, the portion 1344, which may be defined by the support 334, and the backrest 8 rotate about 20 degrees between an upright position and a reclined position. In other embodiments, the end 105 of portion 1346, portion 1344, support 334 and backrest 8 may rotate between 10 degrees and 30 degrees. As shown in FIGS. 43A and B and 44, the end 105, 105', portion 1344, 1344', support 334, 334' and backrest 8 are rotated about a virtual pivot axis 1345, which may be positioned above a body supporting surface 1347 of the seat 6 supporting the body of the user and in front of a body supporting surface 1349 of the backrest 8. The rotation of the backrest may also be varied by modifying the initial orientation of the portions 1332, 1346 in an at-rest position, for example by orienting the portions along a vertical plane, or by orienting the portions 1332, 1346 along a plane that is angled clockwise or counterclockwise to the vertical plane, for example at an angle §. Also, as shown for example in FIG. 37, the portion 1346 may be angled rearwardly relative to the base portion 1332, and may also be rotated about the axis 104, in the at-rest position.

Referring to FIGS. 14-22, 36, 37 and 44-59, the body support structure includes the base 12 and a body support component, e.g., seat 6 or backrest 8, movably mounted on the base. The body support component, whether the seat or backrest, is moveable relative to the base between an upright position to a reclined position. In one embodiment, the body support component includes the seat carrier 32. At least one strut 370 has a first end 372 coupled to one of the base 12 or the body support component (e.g., seat 6 or backrest 8), and a second end 374 moveably coupled to the other of the base and the body support component, wherein the second end 374, 374' is moveable relative to the other of the base and the body support component between an at-rest position and a stop position as the first end 372, 372' is moveable with the body support component. In this embodiment, the end 374, 374' is translatable, for example through sliding, and pivotable relative to the other of the base and body support component. It should be understood that in one embodiment, the strut may have a first end connected to the backrest, e.g., an upright, and a second end moveably coupled to the intermediate or base portion of the flexible portion that is connected to the base 12, or has a fixed position. The first end 372 may be connected to the base 12 or body support component for example by welding, adhesives/bonding, fasteners, co-molding, and/or combinations thereof. In one embodiment, shown for example in FIGS. 36, 37 and 44-59, the first end 372 of the strut 370 is connected to the support member 334 of the backrest 8 and defines a truss structure in combination with the torsion leaf spring 80, biasing component 300, 1300, or deformable link 340. In one embodiment, shown in FIG. 53, the end of the strut 370 overlaps with and/or is pocketed in the support member 334, for example in an cavity formed along an inner side of the support member. The end of the strut may include a lug 609 aligned with an opening in the support member. A fastener 611 is inserted through the opening and lug and secures the strut to the support member 334. In other embodiments, the strut may be integrally formed with the base or body support component, or may be coupled with fasteners, bonding or other suitable devices and combinations thereof. The truss is V-shaped or triangular shaped, and interfaces between the backrest 8 and the base 12. The strut 370 extends forwardly and inwardly from the support member 334. The strut 370, or a pair of struts, limit(s) the movement of the body support component, whether the backrest 8 or seat 6, relative to the base 12 when the strut 370 is in the stop position. In one embodiment, a pair of struts 370 connect the body support component (e.g., seat 6 or backrest 8) and base 12, although it should be understood that a single strut, or more than two struts may be incorporated. In one embodiment, the second end 374 is translatably coupled to the other of the base 12 and the body support component (e.g., the seat 6 or backrest 8), such that the second end 374 is slidable relative to the other of the base 12 and the body support component between the at-rest position and the stop position, as shown in FIGS. 22 and 44. The second end 374 may also have some rotational connection to the base 12. In one embodiment, the first end 372 is connected to the seat carrier 32, for example fixedly or rotationally connected, while the second end 374 is moveably (e.g., translatably and/or rotatably) coupled to the base 12. If the first end 372 is fixedly connected, the strut 370 may experience some bending, while if rotationally connected, the strut 370 will experience primarily (or only) compression. It should be understood that the connections may be reversed, with the first end 372 connected to the base 12 and the second end 374 connected to the seat carrier 32 and/or backrest.

In one embodiment, shown in FIG. 22, the base 12 includes a pair of slots 376 that receive the second ends of the struts 370. The inboard end 378 of the slot 376 is tapered upwardly and outwardly to partially close the top of the slot 376 and define a cavity 377 with a stop 379 to prevent the end 374 of the strut 370 from being forced out of the slot 376. As the end 374 engages the stop 379, or end of the cavity, the strut 370 limits the recline of the seat and back, thereby acting as a tilt limiter. The end 374 may slide laterally in the slot 376. Referring to FIGS. 28, 31, 32 and 56-59, a biasing component 380, 382, 384 may engage and bias the second ends 374 of the struts 370 laterally outwardly toward the at-rest position. In various embodiments, the biasing component 380 may be configured as one of a compression spring 382, a leaf spring, a torsion spring, a tension spring 384, or any other type of spring. For example, a leaf spring may be configured in a bow shape, with ends 395 thereof engaging the spaced apart second ends of the struts 370.

Figure 56:
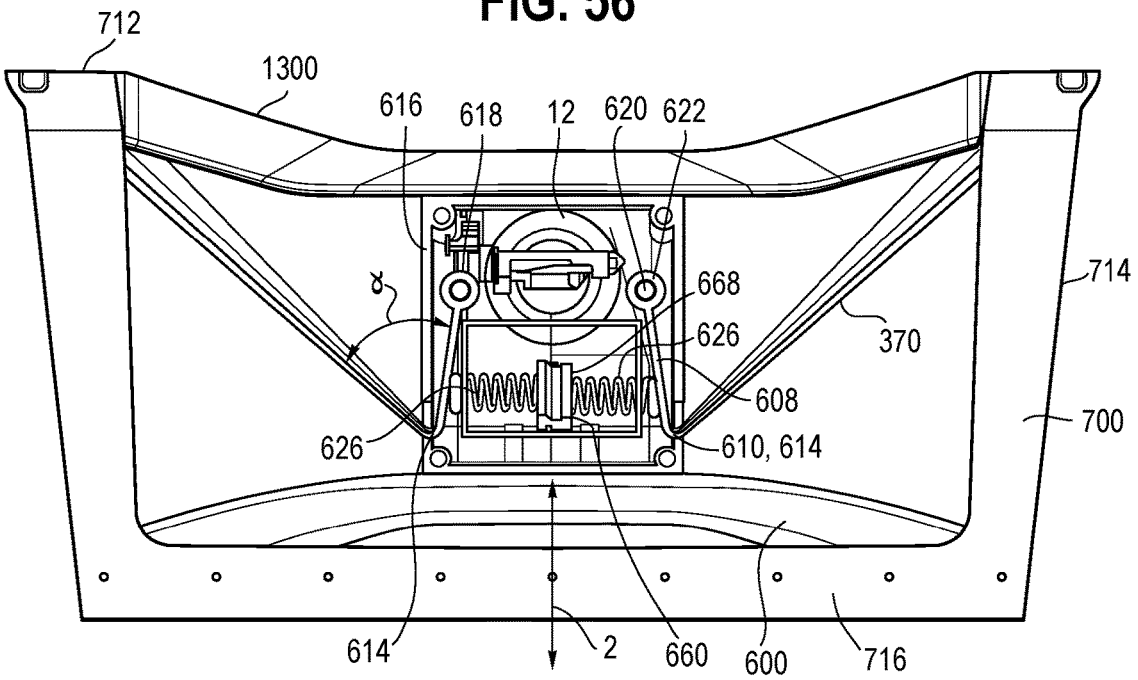
FIG. 56 a partial top view of a body support structure including a pair of struts.

Referring to the embodiments of FIGS. 53, 56, 57 and 59, each strut 370 includes a lever 608 coupled to the end of the strut 370 at a first location 614. In one embodiment, the strut 370 and lever 608 are integrally formed and connected at an elbow joint 610, with the strut and lever defining an acute angle ($\gamma$) therebetween. An opposite end 612 of the lever 608 is pivotably coupled to the other of the base and the body support component, shown as the base, at a second location 616 spaced from the first location, defining for example a vertical axis 618. A portion of a return biasing force may be applied to the strut by way of elastic bending at the elbow joint 610. In another embodiments, the lever and 608 and strut 370 may be rotationally coupled at that joint. In another embodiment, the end 612 of the lever 608 may be non-rotatably fixed to the base or body support component, wherein the lever 608 may provide an additional return biasing force to the strut through bending of the lever. The base 12 may include a pair of posts 620 pivotally engaged by sockets 622 formed at the ends of the lever and disposed over the posts, as shown in FIG. 56. Conversely, the lever 608 may include a post 630 pivotally coupled to the other of the base or body support component and defining the pivot axis 618. In an alternative embodiment, shown in FIG. 58, first and second levers are coupled with a laterally extending cross member 624, which forms a bow and provides a biasing force to the levers by way of bending. An auxiliary biasing component 626, shown as compression springs, may also bias the levers 608, e.g., laterally outwardly. The biasing component(s) 626 engages the lever(s) 608 between the first and second locations 614, 616, thereby acting as a fulcrum. In one embodiment, the biasing component may be replaced by a non-resilient member, acting as a fulcrum moving along and changing the effective length of the lever. In one embodiment, the biasing component 626 is configured as a compression spring that is moveable relative to the lever between the first and second locations, for example in the longitudinal direction 2. In one embodiment, the spring is configured as a compression spring that is translatable (e.g., slidable) relative to the lever 608 in the longitudinal direction 2. As the spring moves closer to the end 374 of the strut, or first location 614, a larger biasing force is applied to the strut 370 to bias the seat and backrest to the at-rest position. It should be understood that the biasing component may include at least one of a compression spring, a leaf spring and/or a tension spring, or combinations thereof.

Figure 33:
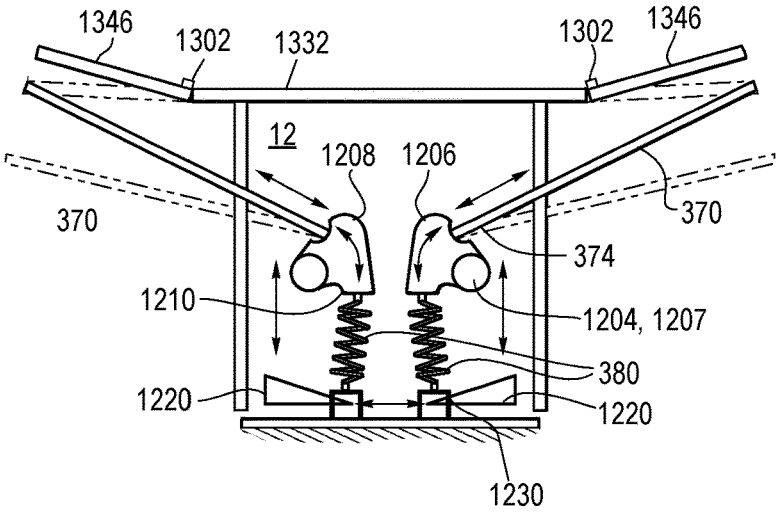
FIG. 33 is a schematic view of an alternative embodiment of an auxiliary energy system.
Figure 34:
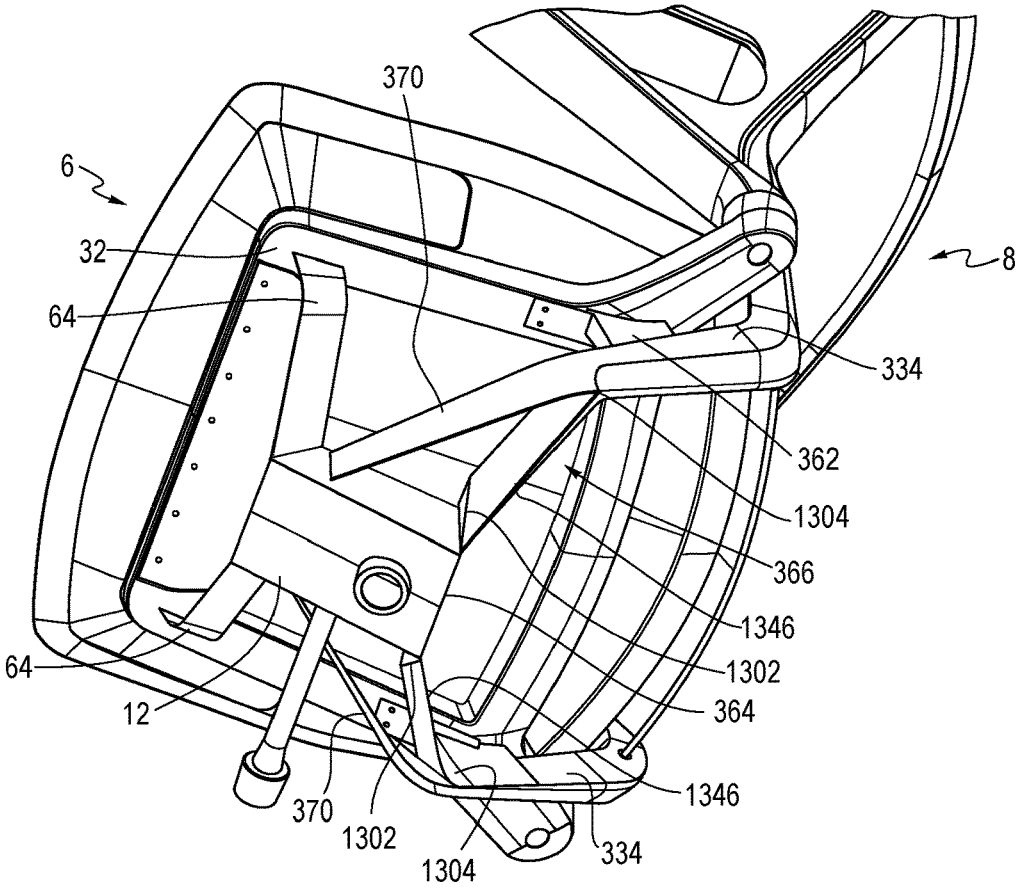
FIG. 34 is a partial bottom view of another embodiment of a body support structure.
Figure 35:
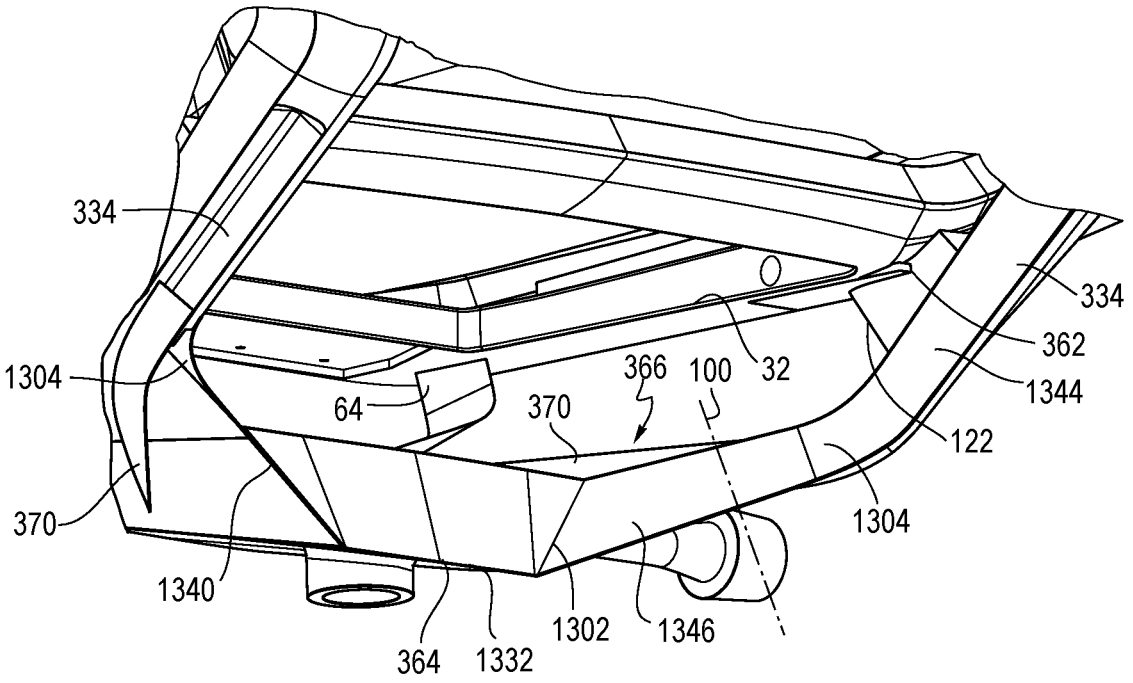
FIG. 35 is a partial rear view of the body support structure shown in FIG. 34.
Figure 36:
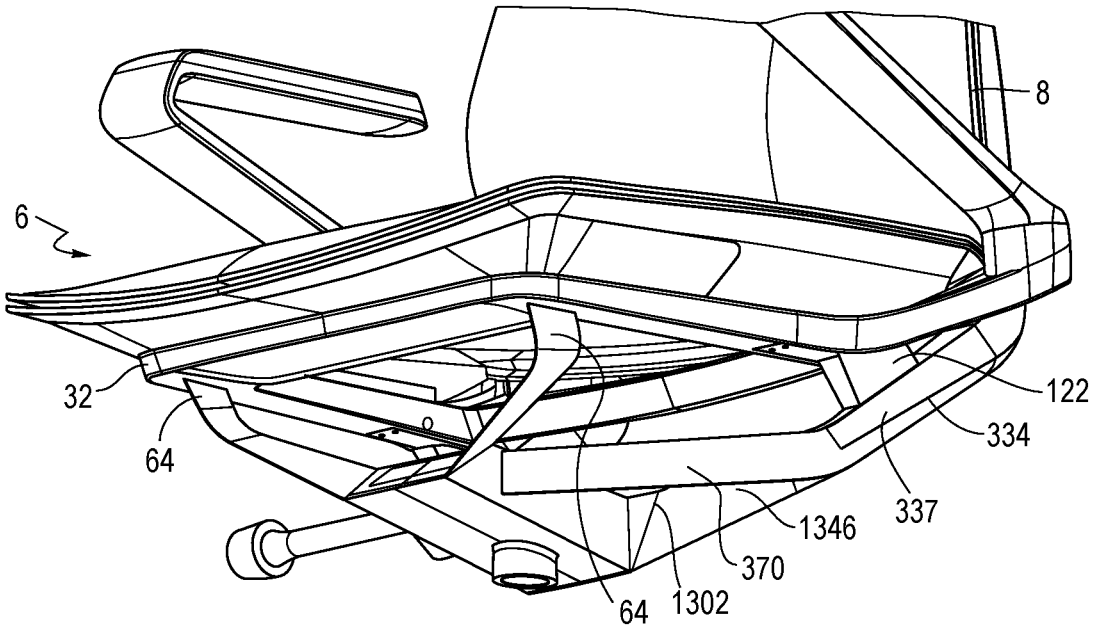
FIG. 36 is a partial front, perspective view of the body support structure shown in FIG. 34.
Figure 37:
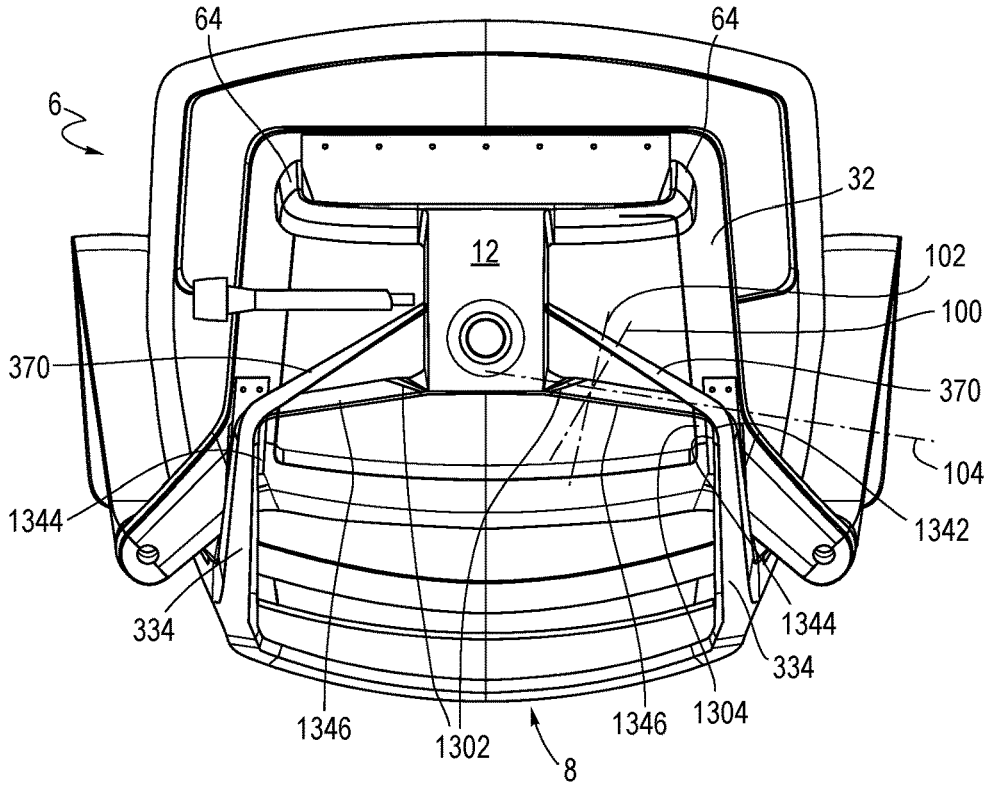
FIG. 37 is a partial bottom view of the body support structure shown in FIG. 34.
Figure 38:
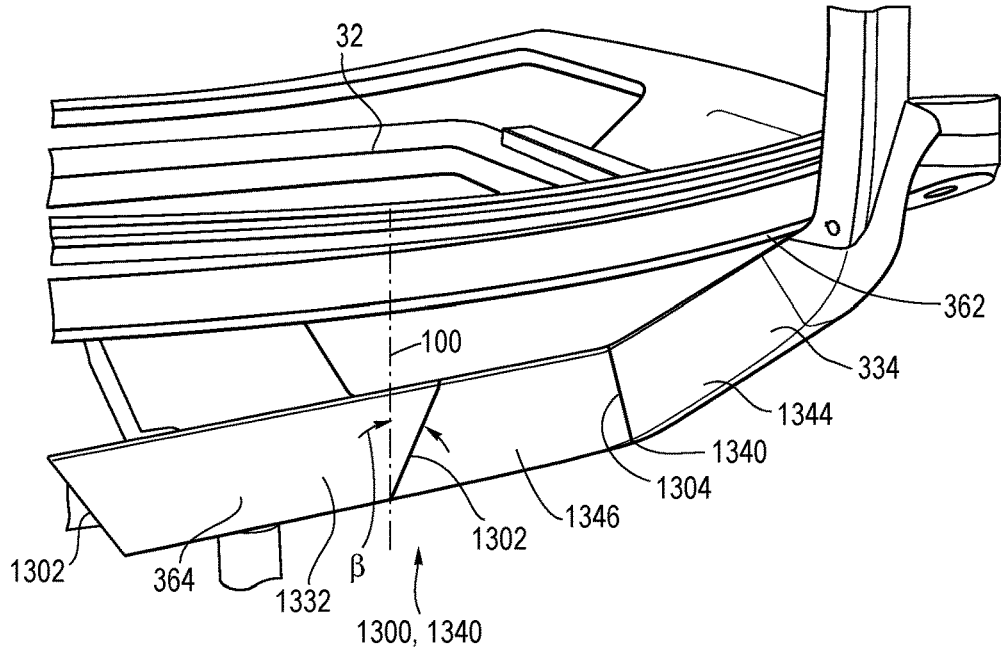
FIG. 38 is a partial, rear perspective view of the body support structure shown in FIG. 34.

Referring to FIG. 33, a rocker 1206 may be rotatably connected to the base 12 about an axis 1204, for example with a pin 1207. The second end 374 of each strut may engage a first arm or first location 1208 of the rocker spaced apart from the axis 1204. A biasing member 380, shown as a compression spring, engages a second arm, or second location 1210, spaced apart from the axis 1204 and first location 1208. In operation, the strut 370 applies a load through the second end 374 to the first location, thereby rotating the rocker about the axis 1204. The biasing component 300 applies a counterforce to the rocker at the second location 1210 resisting the rotation of the rocker 1206. An adjustment member 1220 may engage and support an opposite end 1230 of the biasing member 380. The adjustment member 1220 may be configured as a wedge, or may be moved laterally to move the end 1230 of the biasing member 380 and thereby shift the moment arm of the biasing member 380 as applied to the rocker 1206. In other words, the orientation of the biasing member 380 may be changed such that the load applied to the end 374 by the rocker 1206 is increased or decreased.

When the user sits in the chair, the struts 370 and biasing member 380, or component, provide an auxiliary, or secondary, biasing force that correlates to the weight of the user, thereby providing a weight sensitive control. In particular, as the user sits in the chair, the biasing component 300, 1300 may deflect or deform, through bending and torsion, with the struts 370 thereby moving in the slot 376 against the force of the biasing component 380, 382, 384, which provides for a secondary biasing or support of the user. The biasing component 300, 1300 may provide 30-70% of the return energy of the overall system, while the biasing component 380 may provide 70-30% of the return energy of the system.

Figure 28:
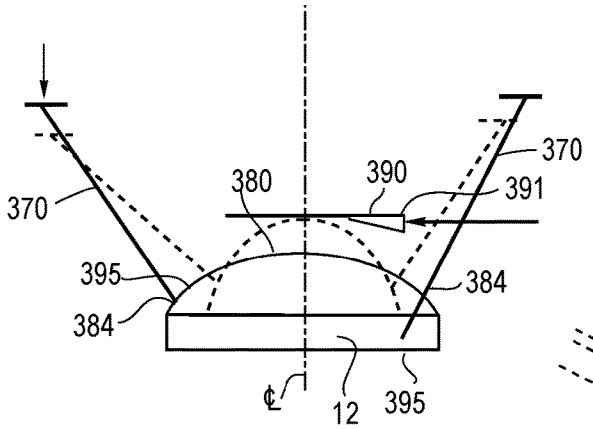
FIG. 28 is a schematic view of an auxiliary energy system.
Figure 31:
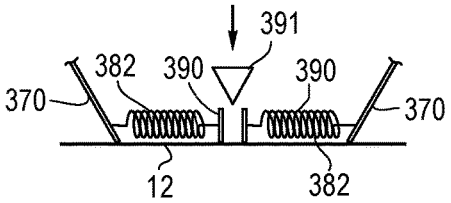
FIG. 31 is a schematic view of an alternative embodiment of an auxiliary energy system.
Figure 32:
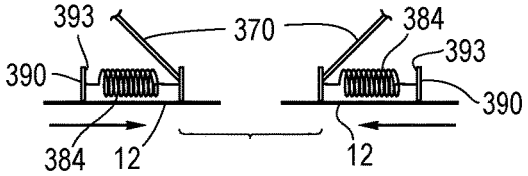
FIG. 32 is a schematic view of an alternative embodiment of an auxiliary energy system.

The amount of force applied by the biasing component 380 may be adjusted, for example with an adjuster 390 that is adjustable to vary the biasing force, shown for example in FIGS. 28 31, 32, 33, 56-59. In one embodiment, the adjuster 390 may include a wedge 391 moveable relative to the biasing member 380, 382. For example as shown in FIG. 28, the wedge 391 may be moved laterally to deflect or limit the deflection of the biasing component 380, configured as a leaf spring. Or, as shown in FIG. 31, the wedge 391 may be moved vertically to increase the compression force applied by a pair of compression springs 382. As shown in FIG. 32, the adjuster 390 may include a pair of laterally moveably supports 393 that adjust the pretension of a tension spring 384. The supports may also be incorporated into the embodiment of FIG. 31 to adjust the pretension of the compression springs. As noted above, the struts 370 may also be introduced between the backrest and the base, with one end fixed to one of the backrest and base and the other end movable relative thereto. As shown in FIG. 22, the second ends of the struts 370 are laterally moveable relative to the base, and are translatable in the slots. Moreover, as the seat reclines, the struts 370 may also rotate slightly relative to the base, with the slots configured to allow for the additional degrees of freedom. As shown in FIGS. 56-59, the struts 370, and the ends 374 in particular, extend through slots 642 formed in side walls of the base. The second ends 374 of the first and second struts are moveable, e.g., laterally, toward and away from each other.

Referring to FIGS. 56-59, the adjuster 390 may include a centrally located block or housing 660, which is moveable fore-aft in a longitudinal direction 2. A pair of biasing components 626, configured as springs, are engaged/coupled to opposite sides 664, 666 of the housing. The housing 660 may be moveably coupled to base along a longitudinally extending track 668, formed for example along a top or bottom of the base. An actuator (not shown) may be engaged to rotate a spur gear 670 about a horizontal axis meshing or engaged with the track, which may include a linear rack 672, so as to move the housing and biasing components in the longitudinal direction 2.

Figure 57:
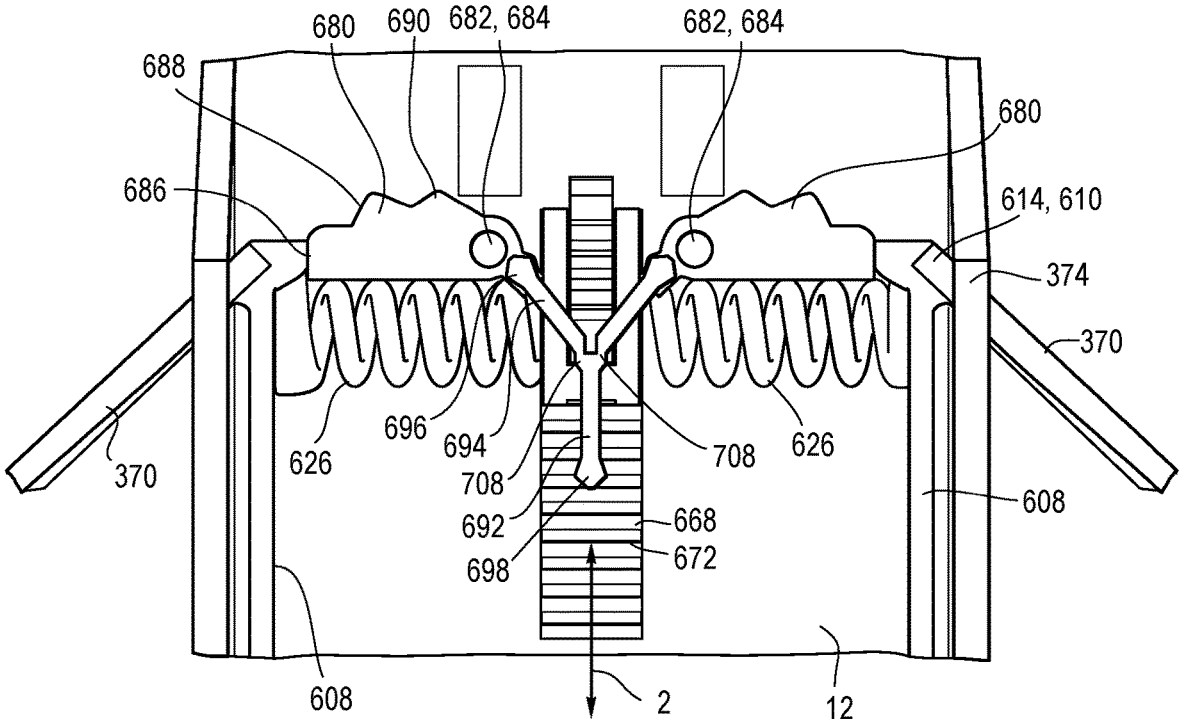
FIG. 57 is a partial top view of a biasing mechanism engaging a pair of struts.
Figure 58:
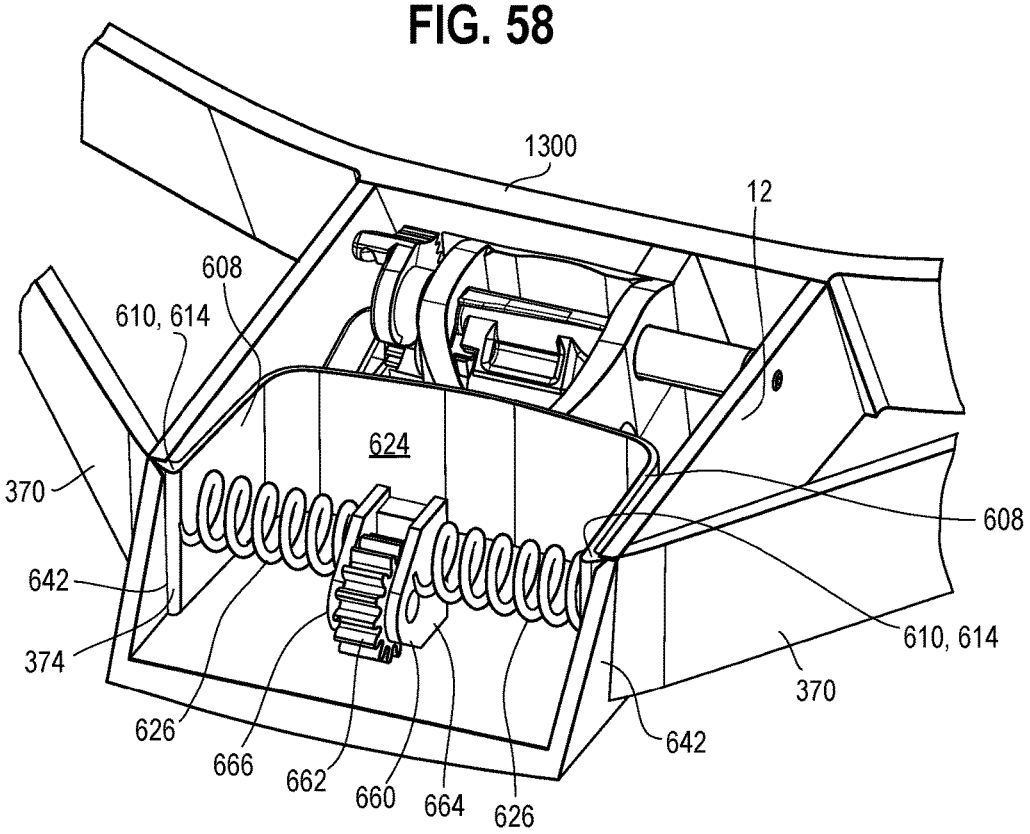
FIG. 58 is a front, partial perspective view of a biasing mechanism engaging a pair of struts.
Figure 59:
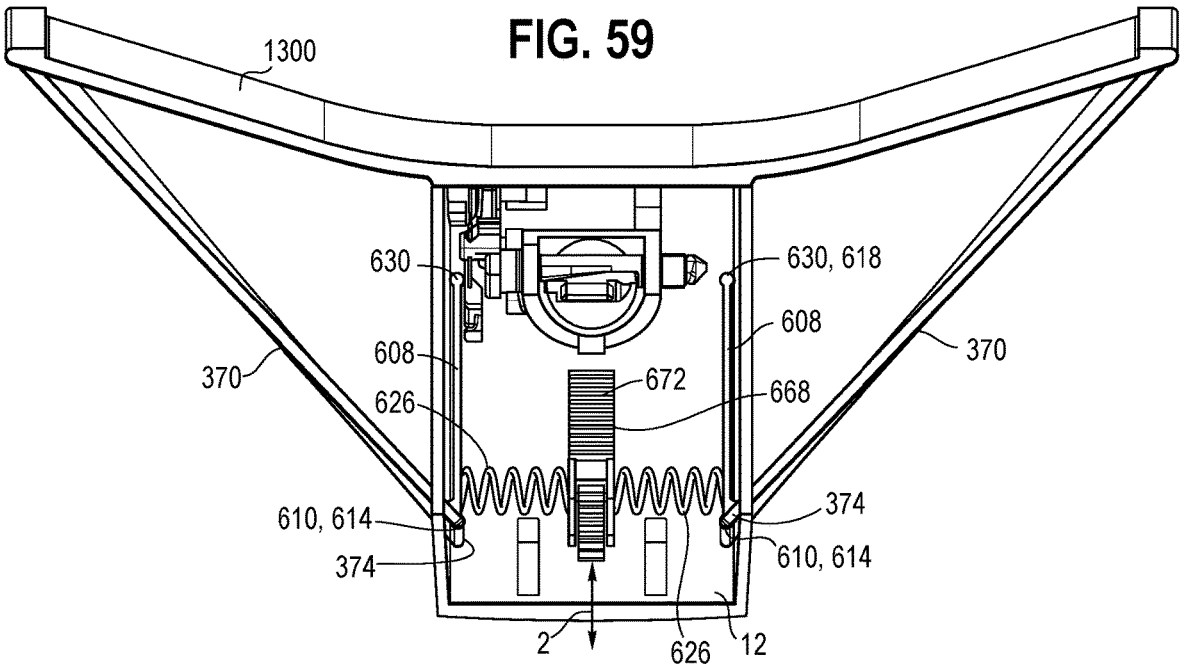
FIG. 59 is a top view of another biasing mechanism embodiment.
Figure 60:
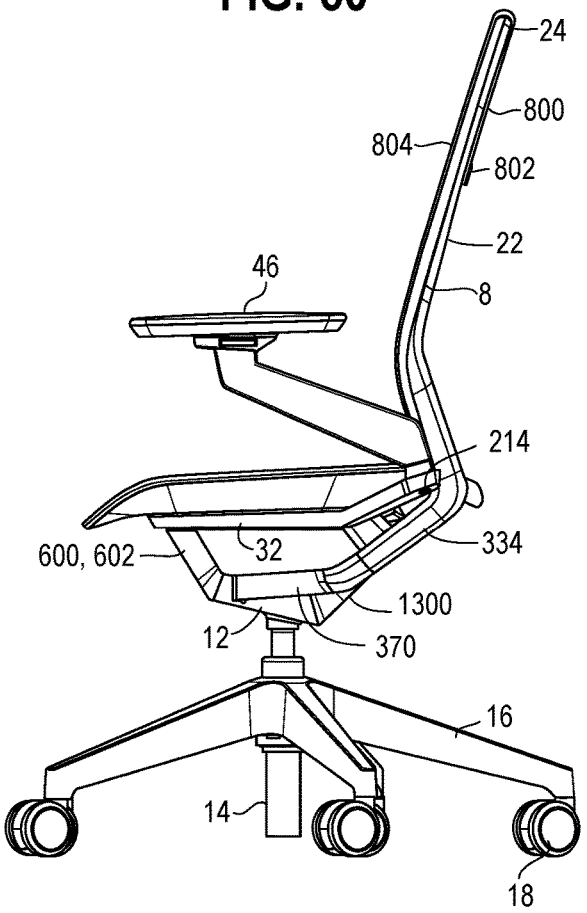
FIG. 60 is a side view of another embodiment of a body support structure.
Figure 61:
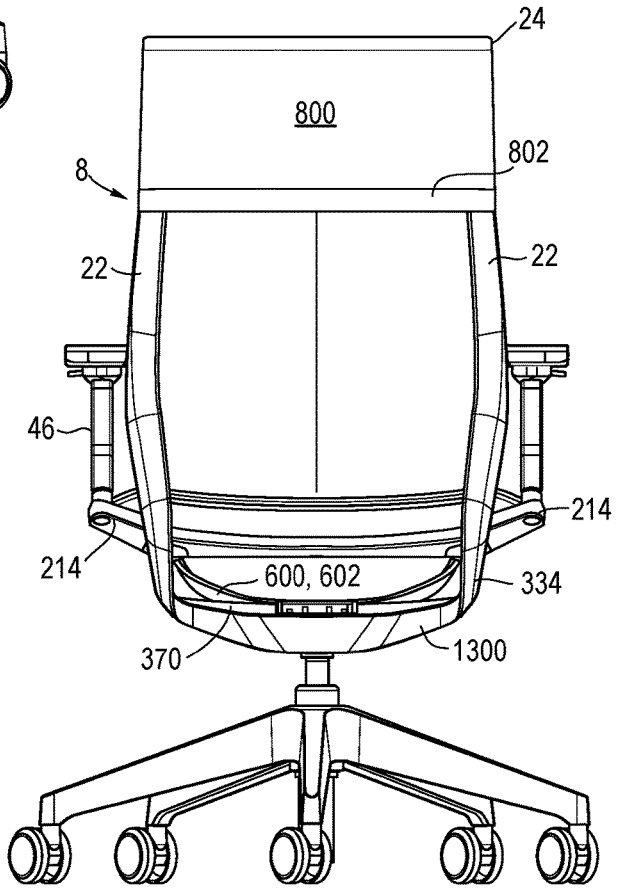
FIG. 61 is a rear view of the body support structure shown in FIG. 60.

Referring to 57, a pair of variable back stops 680 are provided to engage the ends 374 of the struts 370 and limit the movement thereof and the associated recline of the backrest 8 and seat 6. The back stops 680 are moveable relative to the struts 370. In one embodiment, the back stops 680 are rotatable about a post 684 defining a vertical axis 682. Each variable back stop includes a plurality of stop surfaces 686, 688, 690, shown as teeth. In one embodiment, the back stops 680 are pivotally coupled to the base about a pair of pivot axes 682. The back stops 680 may be pivoted to present/align the different stop surfaces 686, 688, 690 with the ends 374 of the struts. For example, as shown in FIG. 57, the back stops 680 are positioned to prevent any recline, or maintain the backrest and seat in a full upright position, with the stop surface 686 engaging the end 374 of the strut. As the back stops 680 are rotated, two additional stop surfaces 688, 690 may be aligned with the struts 370 to provide an intermediate stop and a full-recline stop.

An actuator 692 includes a pair of arms 694 pivotally connected to the back stops 680 at a location 696 spaced from the pivot axis 682. A pull member 698 is pivotally or hingedly connect to the arms 694 about flex joints 708. The pull member 698 may be actuated fore and aft along the longitudinal direction 2 to move the arms 694 and thereby rotate or pivot the back stop 680 to the desired position. In other embodiments, the back stops may be translated, or slid to various stop positions, rather than being rotated, or the back stops may undergo both translation and rotation. A cable, or other movement input, may be coupled to the pull member to effect movement of the actuator 692.

Referring to FIGS. 7-13, another embodiment of a body support structure 13, configured as a chair, includes a base 112 defining a platform 114 or bottom member. The base 112 is connected to a support column 14 and extends, or is cantilevered, forwardly from the support column 14. In this embodiment, the backrest includes a pair of laterally spaced support members 116 that extend forwardly from the uprights 22 and define a rear link or bar 118 connecting the base 112 and seat 6. The support members, or rear link 118, are connected to the base 112 at a first pivot joint 120 and to a portion of the seat, such as the seat carrier 32, at a second pivot joint 122 positioned upwardly and rearwardly from the first pivot joint 120. Likewise, referring to FIGS. 14-21, support members 334 include upstanding arms 337 that are joined to the seat carrier 32 at pivot joint 122 positioned rearwardly of pivot joint 60.

Referring to FIGS. 7-13, a front link 124 or bar is are connected to the base 112 at a third pivot joint 126 and to the seat 6 at a fourth pivot joint 129 positioned upwardly and forwardly from the third pivot joint 126. The seat platform/carrier 32 and base 112 define two other links (bars) of a four-bar mechanism, with the base 112 remaining stationary. It should be understood that the rear link 118 may alternatively be a single rear link, and that the front link 124 may be a single link, or two or more laterally spaced links. A leaf spring 119 extends between the base adjacent a connection to the rear link 118 and the seat carrier or platform 32, adjacent a connection to the front link 124, and provides a biasing return force for the chair.

Figure 11:
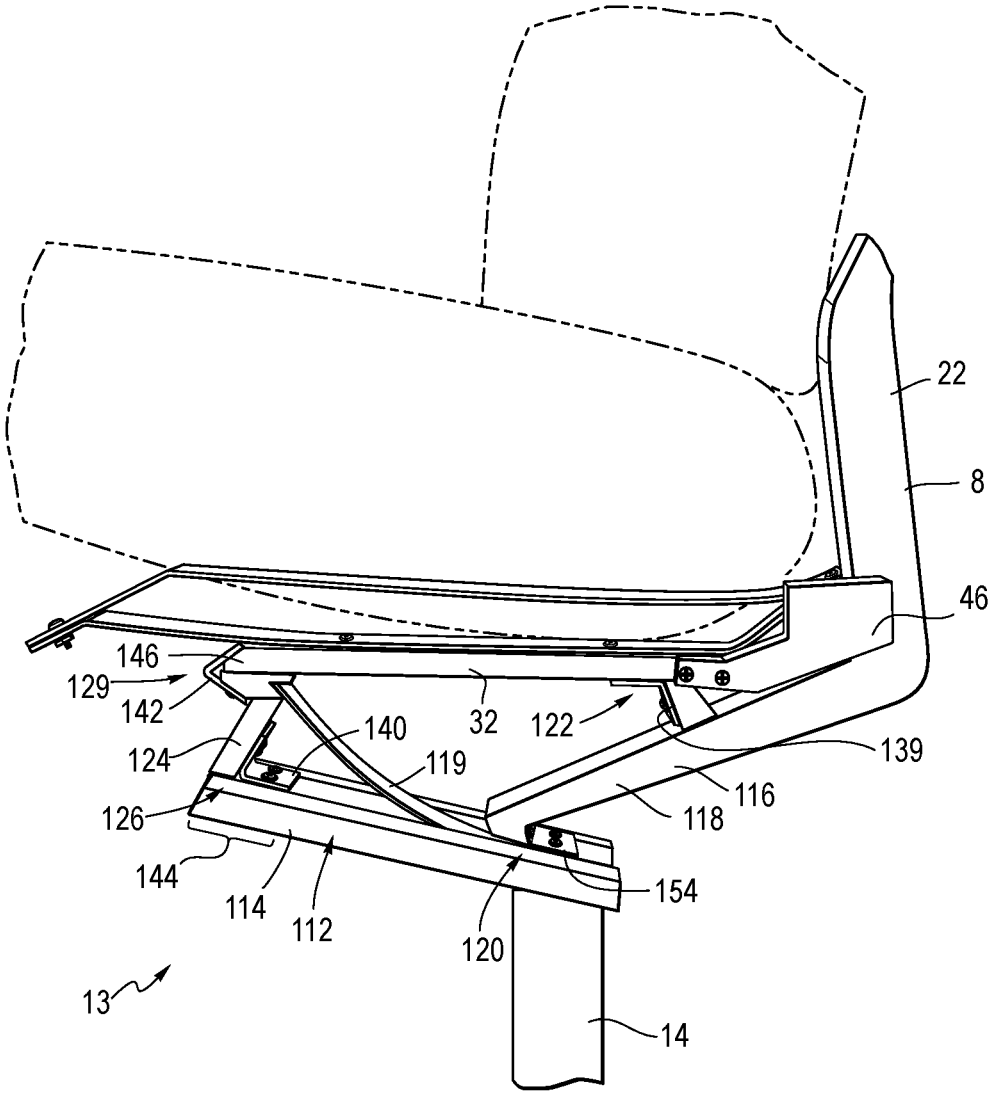
FIG. 11 is a side view of an alternative embodiment of a tilt control mechanism.
Figure 12:
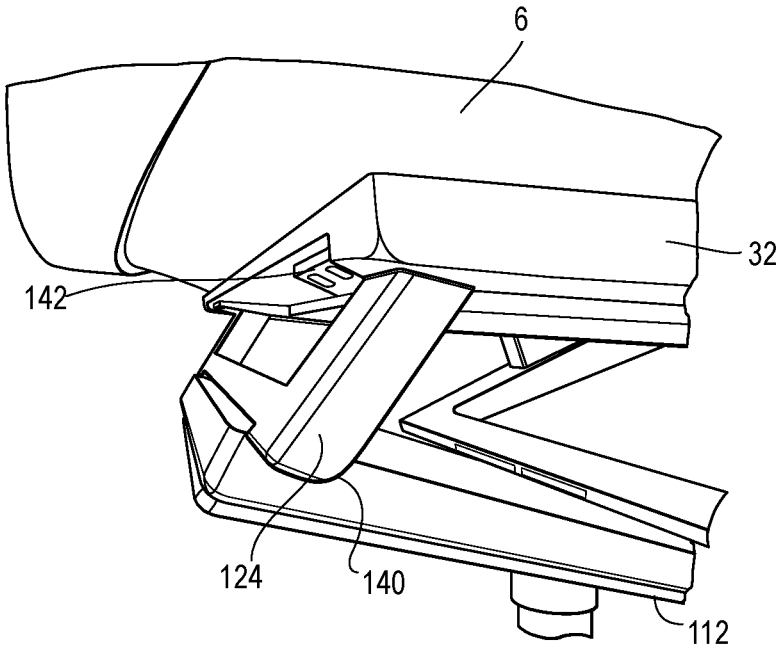
FIG. 12 is a schematic representation of a link incorporated into a tilt control mechanism.
Figure 13:
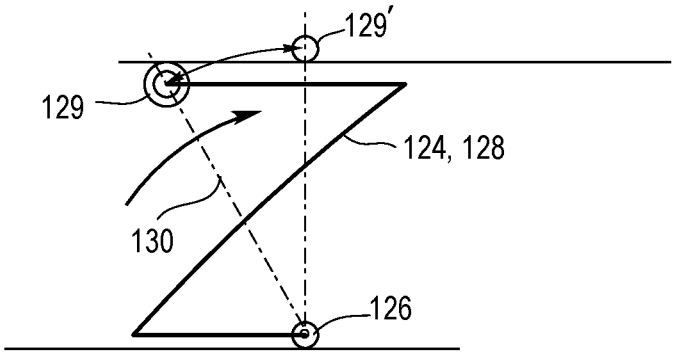
FIG. 13 is a partial, bottom perspective view of the front link of the mechanism shown in FIG. 11.

Referring to FIGS. 11-13, the front link 124 has a centerline 128 defined along a length thereof, which centerline 128 may be linear or curved, and which is defined as the neutral axis of the front link 124. The front link 124 extends between and movably supports a body support component, e.g., the seat carrier or platform 32, on the base 112. The front link 124 is pivotally connected to the base 112 at the pivot joint 126 positioned on a first side of the centerline 128. The front link 124 is pivotally connected to the body support component at the pivot joint 129 on a second side of the centerline 128 opposite the first side. A virtual link 130, defined between the pivot joints 126, 129 or virtual pivot axis defined by the pivot joints, crosses or intersects the centerline 128 between the opposite ends of the centerline. In one embodiment, at least an intermediate portion of the front link 124 is linear and defines the centerline 128. The centerline 128 may have a first orientation defining a first acute angle relative to a vertical axis, wherein the first orientation has a positive slope, while the virtual link 130 has a second orientation defining a second acute angle relative to the vertical axis, wherein the second orientation has a negative slope, with the understanding that the slopes are viewed from the left hand side of the body support structure as shown in FIGS. 11-13. It should be understood that the first slope of the centerline 128, if not linear, is measured at the midpoint of the centerline 128, for example a tangent of the centerline at the midpoint if the centerline is curved.

As shown, the body support structure 13, or component, is configured as a seat 6. It should be understood, however, that the body support component may alternatively be configured as, or include, a backrest or other component. At the same time, it should be understood that the link 124 may be positioned at any location, including a rear link location, and may interconnect any two components. In the configuration where the link 124 supports a front of the seat, movement of the front of the seat is weight activated, meaning the weight of the user is taken into account when reclining since the increase in potential energy is offset by the kinetic energy required to recline. In this way, the system may provide more resistance to a heavier user to help counterbalance the user. Due to this orientation, and the configuration of the front link 124 and pivot joints 126, 129, the front of the seat does not move, forwardly, downwardly or rearwardly, when loaded vertically as the user sits on the chair. Rather, the front link 124 acts as a stop between the seat and the base, such that the entire seat does not move downwardly in response to a vertical load. Rather, the seat and backrest only move when the user reclines, meaning the user has to actively recline.

In operation, due to the crossing or intersection of the virtual link 130 and centerline 128, the link 124 provides a counterintuitive motion during recline. In particular, the link 124, with its rearwardly inclined orientation of the centerline and positive slope (when viewed from the left side), would intuitively lead to the upper end of the link 124 dropping during recline. In reality, however, the virtual link 130 defines the arc of rotation, which with the forwardly inclined orientation of the virtual link 130 and negative slope (when viewed from the left hand side) results in the upper end of the link 124 raising during recline as the pivot joint 129 follows a curved trajectory to 129'. It should be understood that the visual may be reversed, with an upper portion of the link 124 having an appearance of being raised during recline, while in reality the upper portion drops during recline due to the orientation of the virtual axis 130.

Referring to FIGS. 11-20, the pivot joints 122, 126, 129, 362 may be configured as a living hinge 139, 140, 142, formed for example from a bent panel secured between the components for example with fasteners, adhesives or other suitable connections. It should be understood that the pivots may be configured as other pivot joints, including a hinge pin. The link 124 and the portions 144, 146 of the base and/or body support component (e.g., seat) attached to the link 124, for example the portions 144, 146 underlying/overlying and coupled to the living hinges 140, 142 at the first and second pivots, have a Z-shape as shown in FIGS. 11-13. The pivot joints 126, 129 may also be configured with a flexible blade, creating a "peelable" joint as further disclosed below.

Figure 53:
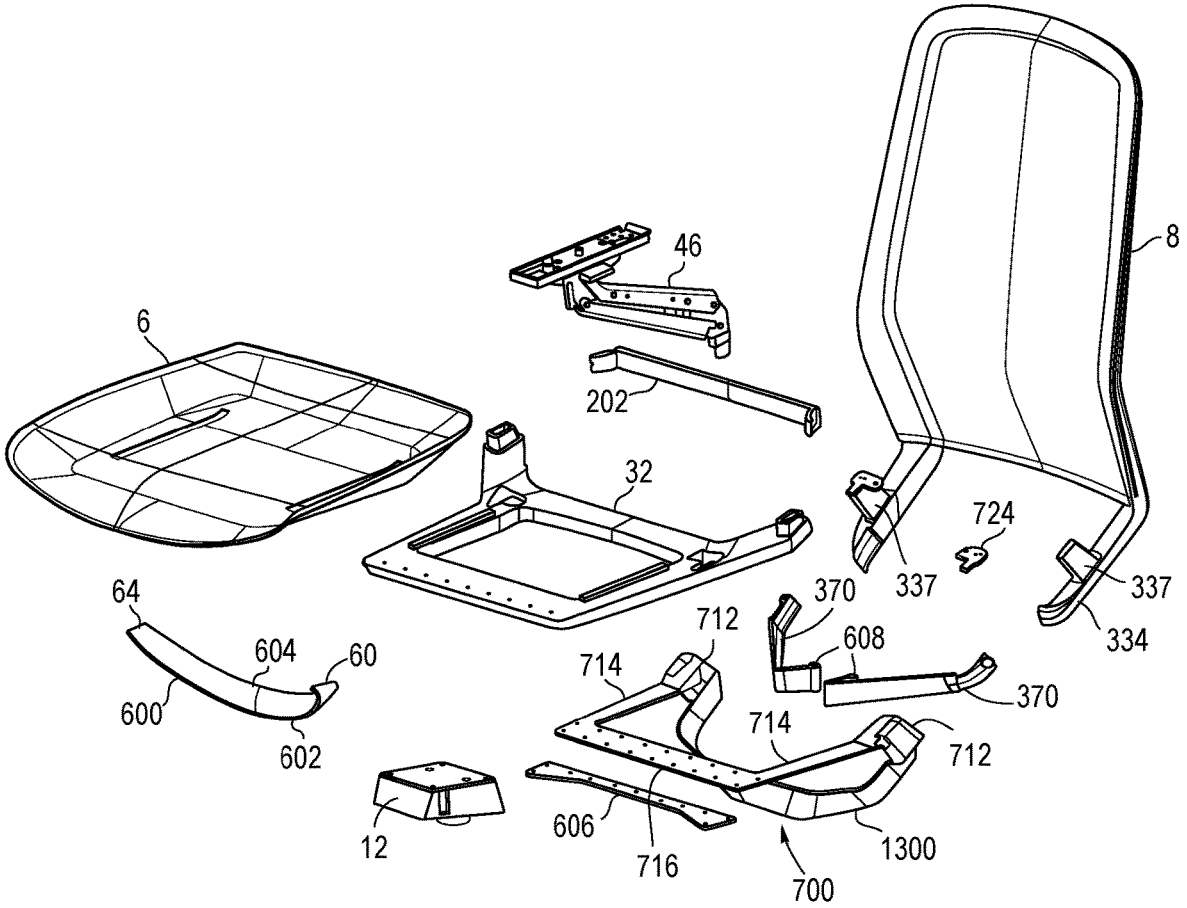
FIG. 53 is a partial, exploded perspective view of the body support structure shown in FIG. 45.
Figure 55:
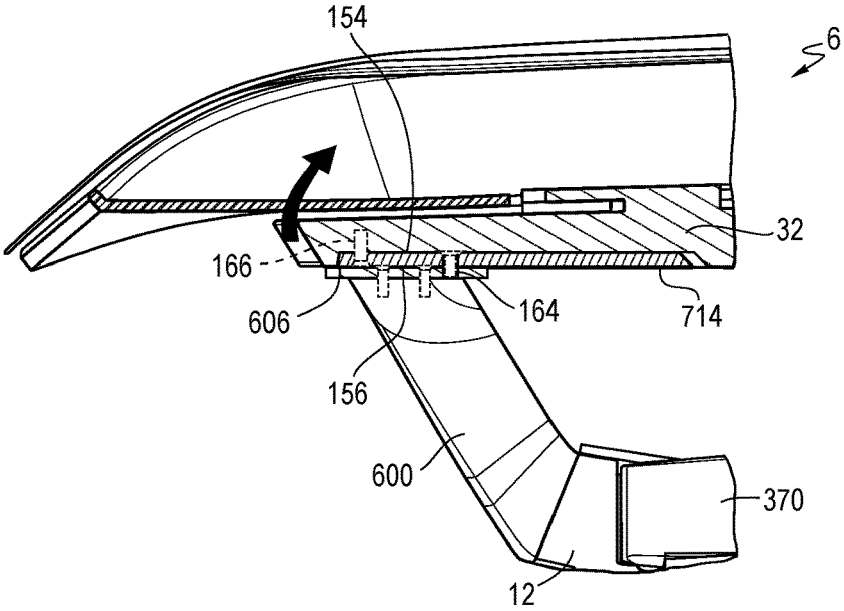
FIG. 55 is a partial cross-sectional view of the seat and base support.

Referring to FIGS. 7-10 and 14-20, the pair of rear links 118, or backrest support members 334, are shown as being coupled to the base 112, 12. In the embodiment of FIGS. 7-10, the link(s) 118 have a bottom surface 150 that overlies a portion/surface 152 of the base, or support. A flexible blade 154, or panel, includes a first surface 156 abutting and connected to the base, or support, at a first location 158, for example with a fastener 164, adhesive, or other suitable attachment system. Alternatively, as shown in FIGS. 53 and 55, the flexible blade 154 connects the yoke 600, and plate 606 in particular, with the seat carrier 32, with the first surface 156 abutting and connected to the yoke 600 or plate 606 at the first location with the fastener 164. The blade 154 includes a second surface 160 opposite the first surface abutting and connected to the bottom of the link 118, or bottom of the seat carrier, at a second location 162, for example with a fastener 166, adhesive, or other suitable attachment system. The first and second locations 158, 162 are longitudinally spaced apart along the blade. In one embodiment, the blade 154 is planar. The flexible blade 154 functions as a hinge and is bendable/peelable, or elastically deformable, between an at-rest configuration and a biased configuration. The link 118 is pivoted relative to the base 112 from a first position to a second position as the blade 154 is bent, or peeled upwardly, between the at-rest configuration and the biased configuration. At the same time, due to the elastic deformation of the blade 154, the blade 154 biases the link 118 toward the first position from the second position. In various embodiments, the blade 154 may be made of metal, such as steel, or various plastic and composite materials, including thermoplastic materials. The same type of peelable joint may be incorporated between the back support member 334 and the seat carrier 32 at pivot location 362, and also at pivot joint location 360 between the base 12 and the seat carrier 32.

A stop 170, or limit, may be engageable with the link 118 to limit pivoting of the link 118 relative to the base 112 at the second position. The stop 170 may be connected to the support or the link and engage the other of the link or the support. In one embodiment, the stop 170 may engage the link adjacent the first location 158. For example, the stop 170 may be disposed between the link and one of the blade and/or support. The stop 170 may be configured as a block with an engagement surface 172 that is angled to mate with and abut an engagement surface 174 of the link 118 as the link pivots to the second position. In this embodiment, the stop 170 acts in compression as the link 118 is pivoted to the second position. Alternatively, the stop 170 may be fixed to the link 118 and engage the link 118 or the surface 160 of the blade 154, while still acting in compression.

Figure 7:
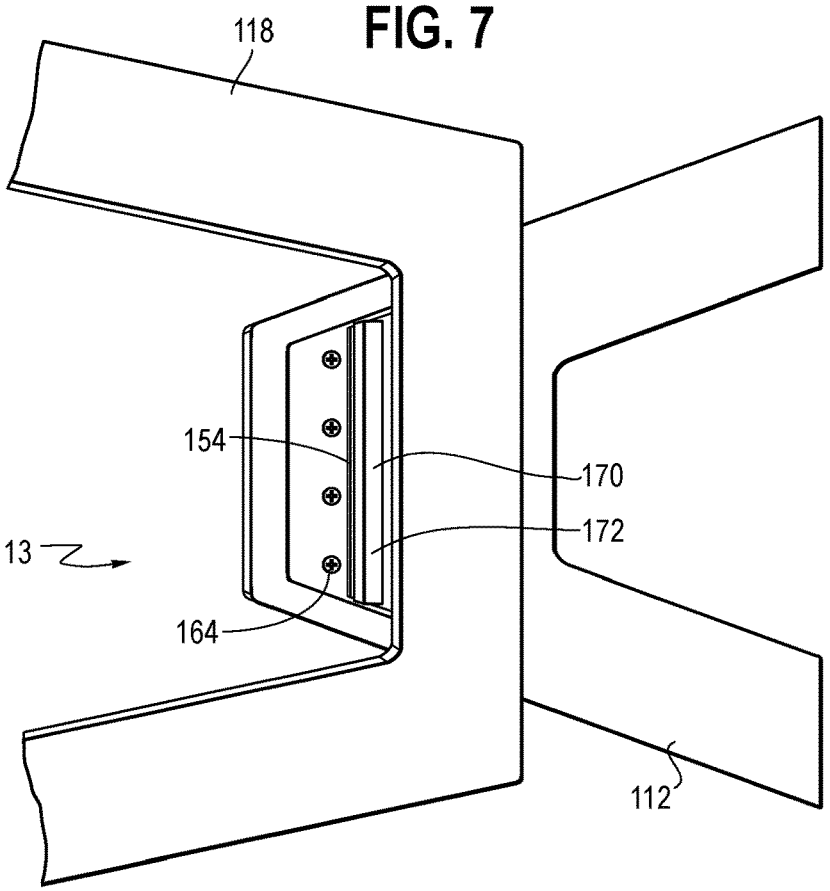
FIG. 7 is a top view of a portion of a linkage incorporated into an alternative embodiment of a tilt control mechanism.
Figure 8:
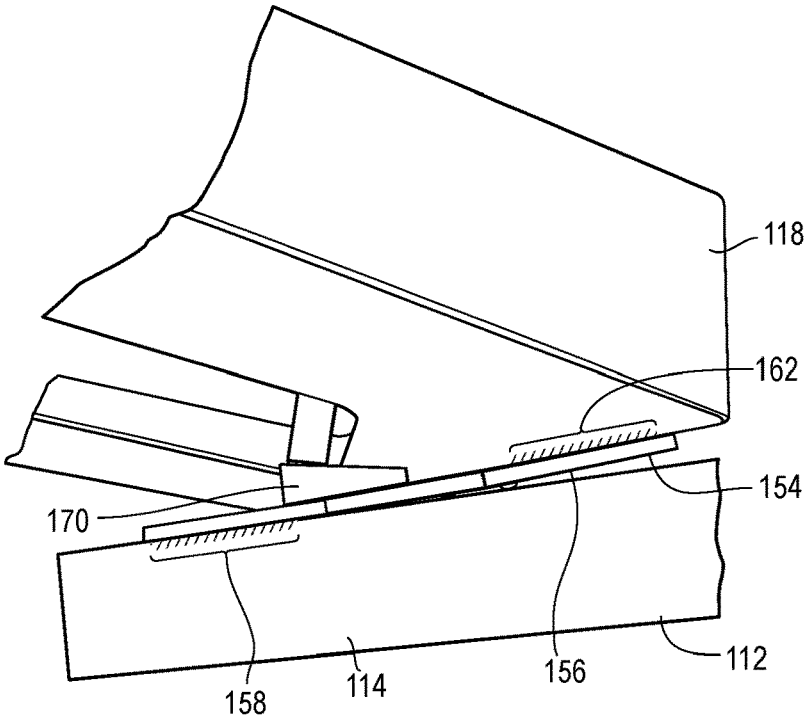
FIG. 8 is a partial side view of a pivot joint incorporated into the linkage shown in FIG. 7.
Figure 9:
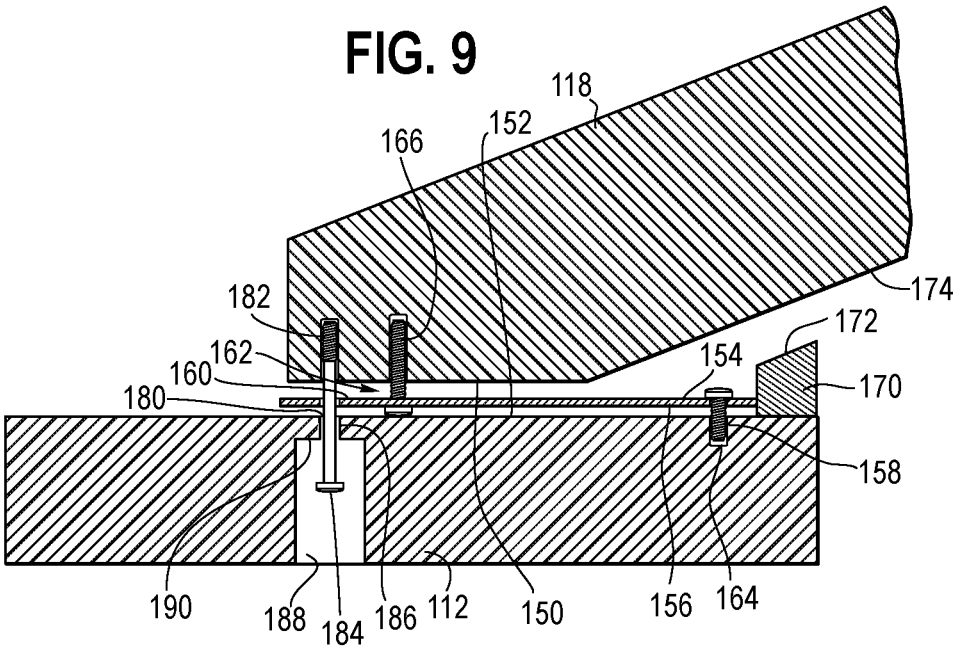
FIG. 9 is a cross-sectional view of the pivot joint shown in FIG. 8.
Figure 10:
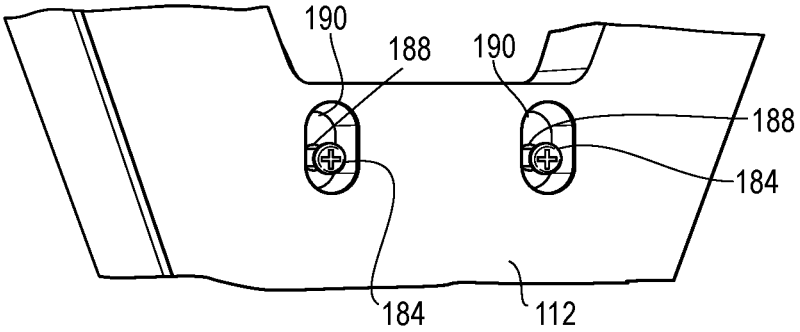
FIG. 10 is a partial bottom view of the linkage shown in FIG. 7.

In one embodiment, a stop 180 engages the link 118 adjacent the second location 162. In this embodiment, the stop 170 acts in tension as the link 118 is pivoted to the second position. The stop 180 may be configured as a post, such as a screw having a shaft 182 secured in the link 118 and a head 184 at one end of the shaft. The shaft 182 is coupled to the bottom surface of the link 118 and extends through an opening in 186 the support. The head defines an engagement portion, which engages a stop surface 190 on the support. The support 112 may include a cavity 188 in which the stop member moves during recline until the engagement portion engages the stop surface 190, configured as an upper wall of the cavity. It should be understood that the stop 180 may be secured to the link 112 and have a stop surface that engages the link 118. Although the link of FIGS. 7-9 is shown as being connected between the base and backrest in FIG. 11, it should be understood that the link may alternatively be connected between the base and seat, or between other components.

It should be understood that two or more of the various links 112, 124, 118, 32 and living hinges 139, 140, 142, and/or blade 154 may be integrally formed as a unitary component, for example from additive manufacturing such as 3-D printing. Similarly, two or more of the leaf spring 80/300, backrest uprights 22 and/or base 12 may be integrally formed as a unitary component, for example from additive manufacturing such as 3-D printing.

Figure 54A:
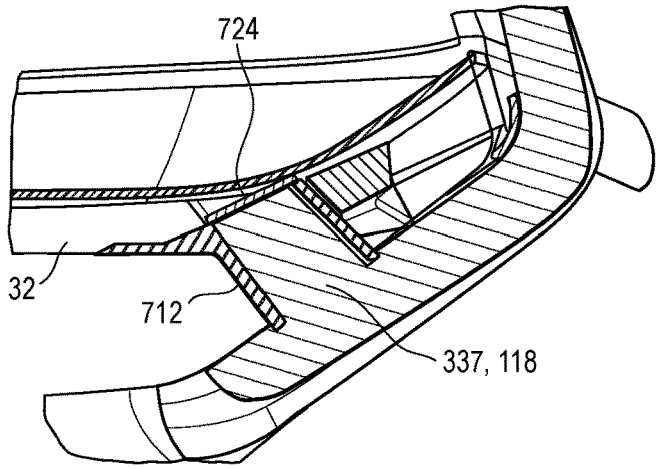
FIG. 54A is a partial cross-sectional view of the seat and backrest in an at-rest position.
Figure 54B:
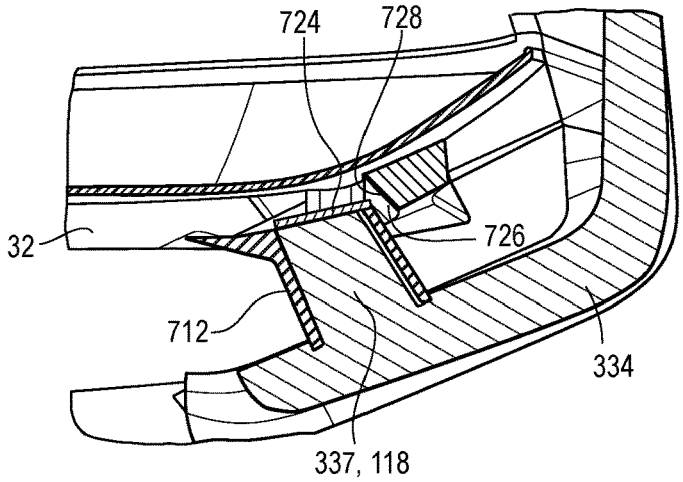
FIG. 54B is a partial cross-sectional view of the seat and backrest in a reclined position.

For example, as shown in FIGS. 53-54B, an energy loop 700 is integrally formed to define the flexible blade 154, the biasing component 1300 and a living hinge 702 connecting the upstanding arms 337 of the rear link 118 with the seat carrier 32. The energy loop includes a pair of laterally spaced enclosures 712, defining tubes, that fitted over/around the arms 337. The energy loop includes a pair of bands 714, or connectors, that extend forwardly from the enclosures 712 and define in part the flexible blade 154. The energy loop further includes a laterally extending cross member 716 connecting the bands 714, which are secured to the bottom of the seat carrier 32. The cross member 716 also defines in part the laterally extending flexible blade 154, which forms the peel joint. The cross member 716 is also secured to the plate 606 along the length thereof with a plurality of fasteners 166 at a location spaced apart from the fasteners 164 securing the cross member to the seat carrier, thereby allowing the flexible blade 154 to bend and define the peel joint as the seat 6 is rotated relative to the yoke 600. The energy loop is coupled to the bottom of the seat carrier, for example along the cross member 716 and along the bands 714.

The energy loop is also coupled to the backrest by way of the enclosures 712 fitted over the arms 337, and connects the backrest to the seat and defines the pivot joint therebetween. A pair of stops 724, configured as plates, are secured to the top of each of the upstanding arms 337. The stops 724 are disposed in an opening or cavity 726 formed in the bottom of the seat carrier, and engage a rear surface 728 of the cavity when the seat and backrest are moved to the reclined position as shown in FIG. 54B. The yoke 600 may be made of metal, such as aluminum, while the plate 606 and stops 724 may be made of metal, such as steel. As the seat and backrest are reclined, a portion of the bands 714 adjacent the enclosures 712 of the energy loop flex to provide for pivoting between the seat and backrest. The seat carrier, energy loop and struts may be made of a glass reinforced polymer, or thermoplastic (e.g., nylon plastic), and may include glass reinforced tape in-molded with the energy loop at various locations.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A body support structure comprising:

a base;

a body support component movably mounted on the base, wherein the body support component is moveable relative to the base between an upright position to a reclined position;

at least one strut having a first end coupled to one of the base and the body support component, and a second end moveably coupled to the other of the base and the body support component, wherein the second end is translatable relative to the other of the base and the body support component between an at-rest position and a reclined position, and wherein the second end is laterally moveable between the at-rest position and the reclined position; and a biasing component biasing the second end toward the at-rest position.

2. A body support structure comprising:

a base;

a body support component movably mounted on the base, wherein the body support component is moveable relative to the base between an upright position to a reclined position;

at least one strut having a first end coupled to one of the base and the body support component, and a second end moveably coupled to the other of the base and the body support component, wherein the second end is translatable relative to the other of the base and the body support component between an at-rest position and a reclined position; wherein the at least one strut comprises a lever coupled to the second end at a first location, wherein the lever is pivotably coupled to the other of the base and the body support component at a second location spaced from the first location; and a biasing component biasing the second end toward the at-rest position.

3. The body support structure of claim 2 wherein the at least one strut comprises first and second struts each having a first end coupled to one of the base and the body support component, a second end moveably coupled to the other of the base and the body support component, wherein the second ends of the first and second struts are moveable toward and away from each other, and first and second levers coupled to the second ends of the first and second struts respectively at a pair of first locations.

4. The body support structure of claim 3 wherein the first and second levers are coupled with a laterally extending cross member.

5. The body support structure of claim 3 further comprising at least one biasing member biasing the second ends of the first and second struts toward the at rest position.

6. The body support structure of claim 2 wherein the biasing component engages the lever between the first and second locations.

7. The body support structure of claim 6 wherein the biasing component comprises a spring moveable relative to the lever between the first and second locations.

8. The body support structure of claim 7 wherein the spring comprises a compression spring translatable relative to the lever.

9. The body support structure of claim 2 wherein the strut and the lever are integrally formed.

10. The body support structure of claim 1 wherein the biasing component comprises at least one of a compression spring, a leaf spring and/or a tension spring.

11. The body support structure of claim 1 further comprising an adjuster adjustable to vary a biasing force applied by the biasing component.

12. The body support structure of claim 1 further comprising a deformable link connected between the body support component and the base, wherein the deformable link controls the path of movement of the body support component relative to the base.

13. The body support structure of claim 12 wherein the deformable link comprises at least one flex region.

14. A body support structure comprising:

a base;

a body support component movably mounted on the base, wherein the body support component is moveable relative to the base between an upright position to a reclined position;

at least one strut having a first end coupled to one of the base and the body support component, and a second end moveably coupled to the other of the base and the body support component, wherein the second end is moveable relative to the other of the base and the body support component between an at-rest position and a stop position, wherein the second end is laterally moveable, and wherein the at least one strut limits the movement of the body support component relative to the base when the strut is in the stop position; and a deformable link connected between the body support component and the base, wherein the deformable link controls the path of movement of the body support component relative to the base.

15. The body support structure of claim 14 wherein the second end is translatably coupled to the other of the base and the body support component, wherein the second end is slidable relative to the other of the base and the body support component between the at-rest position and the stop position.

16. The body support structure of claim 15 further comprising a biasing component biasing the second end toward the at-rest position.

17. The body support structure of claim 16 wherein the biasing component comprises at least one of a compression spring, a leaf spring and/or a tension spring.

18. The body support structure of claim 16 further comprising an adjuster adjustable to vary a biasing force applied by the biasing component.

19. The body support structure of claim 14 wherein the at least one strut comprises first and second struts each having a first end coupled to one of the base and the body support component, and a second end moveably coupled to the other of the base and the body support component, wherein the second ends of the first and second struts are moveable toward and away from each other.

20. The body support structure of claim 19 further comprising a biasing member biasing the second ends of the first and second struts toward the at rest position.

21. The body support structure of claim 14 wherein the deformable link comprises at least one flex region.

22. The body support structure of claim 21 wherein the at least one flex region defines an angle between 20 and 60 degrees relative to a principle axis of the deformable link.

23. The body support structure of claim 21 wherein the at least one flex region is a first flex region, and further comprising a second flex region positioned outboard of the first flex region.

24. The body support structure of claim 23 wherein the second flex region is parallel to a principle axis of the deformable link.

* * * * *